US012480699B1

(12) United States Patent
Notaney et al.

(10) Patent No.: US 12,480,699 B1
(45) Date of Patent: Nov. 25, 2025

(54) DEVICES FOR SHAPING CLEAR ICE PRODUCTS AND RELATED METHODS

(71) Applicant: Abstract Ice, Inc., Petaluma, CA (US)

(72) Inventors: Ashok Kumar Notaney, San Francisco, CA (US); Todd Stevenson, Novato, CA (US); Larry Allen Mercier, Jr., Ann Arbor, MI (US); James Anthony Coller, Ann Arbor, MI (US); Andrew James Whalen, Windsor, CA (US); Kayla Curtis, Ypsilanti, MI (US)

(73) Assignee: Abstract Ice, Inc., Petaluma, CA (US)

( * ) Notice: Subject to any disclaimer, the term of this patent is extended or adjusted under 35 U.S.C. 154(b) by 0 days.

(21) Appl. No.: 19/079,679

(22) Filed: Mar. 14, 2025

Related U.S. Application Data

(63) Continuation of application No. PCT/US2024/014232, filed on Feb. 2, 2024.

(60) Provisional application No. 63/482,841, filed on Feb. 2, 2023.

(51) Int. Cl.
*F25C 5/14* (2006.01)

(52) U.S. Cl.
CPC ..... *F25C 5/14* (2013.01)

(58) Field of Classification Search
CPC ..... F25C 5/14
See application file for complete search history.

(56) References Cited

U.S. PATENT DOCUMENTS

| | | | |
|---|---|---|---|
| 230,318 | A | 7/1880 | Miller |
| 329,400 | A | 10/1885 | Loring et al. |
| 370,928 | A | 10/1887 | Carsley |
| 482,206 | A | 9/1892 | Smith |
| 706,510 | A | 8/1902 | Barrath |
| 1,380,933 | A | 6/1921 | Smith |
| 1,478,863 | A | 12/1923 | Stewart |
| 1,529,972 | A | 3/1925 | Uline |
| 1,707,847 | A | 4/1929 | Edel |
| 2,036,706 | A | 4/1936 | Law |

(Continued)

FOREIGN PATENT DOCUMENTS

| | | |
|---|---|---|
| CN | 101077094 B | 11/2011 |
| CN | 204943995 | 1/2016 |

(Continued)

OTHER PUBLICATIONS

English translation of WO-2022247459-A1 by EPO. (Year: 2022).*

(Continued)

*Primary Examiner* — Xiao S Zhao
*Assistant Examiner* — Inja Song
(74) *Attorney, Agent, or Firm* — Aurora Consulting LLC; Kristen J. Hansen; Ashley Sloat

(57) ABSTRACT

Methods and devices are described for shaping ingots of ice. The devices may include an apparatus including at least a support frame; a mold for shaping ice ingots, and a positioning means configured to dispose a first surface of a first clamshell part against a first side surface of an elongate ice ingot and a second surface of a second clamshell part against a second side surface of the elongate ice ingot, the first side surface of the elongate ice ingot being opposite the second side surface of the elongate ice ingot, and at least one fluid inlet valve for each of the first clamshell part and the second clamshell part.

25 Claims, 30 Drawing Sheets

(56) References Cited

U.S. PATENT DOCUMENTS 2,129,116 A 9/1938 Buffehr
2,153,438 A 4/1939 Sheldon et al.
2,156,247 A 4/1939 Smith
2,169,133 A 8/1939 Barr
2,221,847 A 11/1940 Rodgers
2,238,805 A 4/1941 Dotterweich
2,334,941 A 11/1943 Linden
2,677,249 A 5/1954 Mason
2,717,504 A 9/1955 Knerr
2,749,721 A 6/1956 Trepaud
3,029,609 A 4/1962 Zearfoss, Jr.
3,053,058 A 9/1962 Kocher
3,173,175 A 3/1965 Lemelson
3,226,944 A 1/1966 Connors
3,261,383 A 7/1966 Coblentz
3,274,794 A 9/1966 Wilbushewich
3,491,807 A 1/1970 Underwood
3,759,061 A 9/1973 Nilsson et al.
3,796,063 A 3/1974 Wulke et al.
3,812,686 A 5/1974 Tester
3,911,146 A 10/1975 Hara et al.
3,940,232 A 2/1976 Stock
3,952,539 A 4/1976 Hanson et al.
3,984,996 A 10/1976 Bright
4,112,921 A 9/1978 MacCracken
4,164,343 A 8/1979 Graebner
4,189,928 A 2/1980 Cerny
4,192,151 A 3/1980 Carpenter
4,335,155 A 6/1982 Blake et al.
4,455,843 A 6/1984 Quarles
4,498,595 A 2/1985 Wilson
4,550,575 A 11/1985 DeGaynor
4,590,774 A 5/1986 Povajnuk
4,601,174 A 7/1986 Wilson
4,620,422 A 11/1986 Hosokawa et al.
4,767,239 A 8/1988 Erwin
4,776,566 A 10/1988 Girdley
4,833,894 A 5/1989 Chesnut
4,834,340 A 5/1989 Girdley
4,852,359 A 8/1989 Manzotti
4,954,151 A 9/1990 Chang et al.
4,966,015 A 10/1990 Wessa
4,970,869 A 11/1990 Igarashi et al.
4,990,169 A 2/1991 Broadbent
5,032,157 A 7/1991 Ruff
5,038,573 A 8/1991 McAllister
5,054,547 A 10/1991 Shipley
5,069,044 A 12/1991 Holum et al.
5,076,069 A 12/1991 Brown
5,105,631 A * 4/1992 Watanabe ..... F25C 5/24 198/550.12
5,127,236 A 7/1992 Blanquet
5,167,132 A 12/1992 Meier
5,187,948 A 2/1993 Frohbieter
5,189,939 A 3/1993 Allen, Jr.
5,254,355 A 10/1993 Smith et al.
5,419,285 A 5/1995 Gurevich et al.
5,431,027 A 7/1995 Carpenter
5,460,068 A 10/1995 Gwosdz
5,555,747 A 9/1996 Conlon
5,606,869 A 3/1997 Joo
5,618,463 A 4/1997 Rindler et al.
5,749,242 A 5/1998 Mowery
5,778,677 A 7/1998 Hung et al.
5,786,004 A 7/1998 Yamauchi
5,948,456 A 9/1999 Jones et al.
5,970,735 A 10/1999 Hobelsberger
6,089,035 A 7/2000 Mildengren
6,105,385 A 8/2000 Kato et al.
6,233,962 B1 5/2001 Scherer et al.
6,284,294 B1 9/2001 French et al.
6,328,236 B1 12/2001 Upson
6,357,720 B1 3/2002 Shapiro et al.
6,536,224 B2 3/2003 Frank et al.
6,666,246 B2 12/2003 Gilbert
6,705,090 B2 3/2004 Billman et al.
6,857,277 B2 2/2005 Somura
6,935,124 B2 8/2005 Takahashi et al.
7,021,081 B2 4/2006 Becker
7,082,782 B2 8/2006 Schlosser et al.
7,210,298 B2 5/2007 Lin
7,318,323 B2 1/2008 Tatsui et al.
7,340,913 B2 3/2008 Miller et al.
7,444,829 B2 11/2008 Mori et al.
7,448,863 B2 11/2008 Yang
7,540,161 B2 6/2009 Broadbent et al.
7,703,299 B2 4/2010 Schlosser et al.
7,832,219 B2 11/2010 Baranowski et al.
8,042,344 B2 10/2011 Morimoto et al.
8,783,046 B2 7/2014 Doyle et al.
8,882,489 B1 11/2014 Coomer
9,074,802 B2 7/2015 Culley et al.
9,080,800 B2 7/2015 Culley
9,163,867 B2 10/2015 Culley
9,200,823 B2 12/2015 Boarman et al.
9,248,516 B2 2/2016 Shirk
9,273,891 B2 3/2016 Boarman et al.
9,310,116 B2 4/2016 Culley et al.
9,459,034 B2 10/2016 Boarman et al.
9,470,448 B2 10/2016 Culley et al.
9,476,629 B2 10/2016 Boarman
9,518,770 B2 12/2016 Boarman et al.
9,568,228 B2 2/2017 Joung et al.
9,581,372 B2 2/2017 Lee et al.
9,651,290 B2 5/2017 Boarman et al.
9,677,808 B2 6/2017 Culley et al.
9,696,079 B2 7/2017 Boarman et al.
9,733,003 B2 8/2017 Hoti
9,784,492 B2 10/2017 Little et al.
9,803,908 B2 10/2017 Amo
9,874,387 B2 1/2018 Jobb
9,890,986 B2 2/2018 Boarman
9,989,292 B2 6/2018 Culley
9,995,519 B2 6/2018 Boarman et al.
9,995,520 B2 6/2018 Toma
9,995,521 B2 6/2018 Mogilevsky
10,006,688 B2 6/2018 Zuccolo et al.
10,047,996 B2 8/2018 Boarman et al.
10,066,861 B2 9/2018 Gooden et al.
10,151,519 B2 12/2018 Little et al.
10,184,710 B2 1/2019 Goerz
10,539,354 B2 1/2020 Shi et al.
10,544,974 B2 1/2020 Goldfarbmuren et al.
10,605,511 B2 3/2020 Bertolini et al.
10,605,534 B2 3/2020 Persson
10,724,779 B2 7/2020 Flores
10,746,452 B2 8/2020 Chen et al.
10,746,453 B2 * 8/2020 Tarr ..... F25C 5/08
10,760,843 B2 9/2020 Schoonen
10,788,250 B2 9/2020 Junge et al.
10,801,768 B2 10/2020 Junge et al.
11,408,659 B2 8/2022 Notaney et al.
11,408,661 B2 * 8/2022 Junge ..... F25C 5/08
11,725,862 B2 8/2023 Boarman et al.
2001/0027654 A1 10/2001 Shapiro et al.
2003/0129282 A1 7/2003 Solorio et al.
2004/0025527 A1 2/2004 Takahashi et al.
2004/0099004 A1 5/2004 Somura
2004/0206250 A1 10/2004 Kondou et al.
2004/0258805 A1 12/2004 Halevy et al.
2006/0286254 A1 12/2006 Weisberg
2006/0288725 A1 12/2006 Schlosser et al.
2006/0288726 A1 12/2006 Mori et al.
2007/0048429 A1 3/2007 Griffiths et al.
2008/0075820 A1 3/2008 Fernandez
2008/0092574 A1 4/2008 Doberstein
2008/0216677 A1 9/2008 Yang et al.
2009/0152438 A1 6/2009 Chu
2009/0208611 A1 8/2009 Williams
2009/0249804 A1 10/2009 Davis et al.
2010/0139295 A1 6/2010 Zuccolo et al.
2011/0300264 A1 12/2011 Neta et al.
2012/0192584 A1 8/2012 Fiaschi
2012/0277906 A1 11/2012 Fassberg et al.

(56) References Cited

U.S. PATENT DOCUMENTS

| | | | | |
|---|---|---|---|---|
| 2012/0324915 | A1 | 12/2012 | Bortoletto et al. | |
| 2012/0324916 | A1 | 12/2012 | Bortoletto et al. | |
| 2012/0324917 | A1 | 12/2012 | Bortoletto et al. | |
| 2013/0061626 | A1 | 3/2013 | Son et al. | |
| 2013/0221031 | A1 | 8/2013 | Guido | |
| 2013/0232992 | A1 | 9/2013 | Bisceglie | |
| 2013/0340462 | A1 | 12/2013 | Bush et al. | |
| 2014/0004219 | A1 | 1/2014 | Cirette et al. | |
| 2014/0047859 | A1* | 2/2014 | Schwulst | F25C 5/08 62/340 |
| 2014/0151928 | A1 | 6/2014 | Zhen et al. | |
| 2014/0165598 | A1* | 6/2014 | Boarman | F25C 1/22 62/347 |
| 2014/0165602 | A1 | 6/2014 | Boarman | |
| 2014/0165604 | A1 | 6/2014 | Boarman et al. | |
| 2014/0165618 | A1 | 6/2014 | Culley et al. | |
| 2014/0165619 | A1 | 6/2014 | Culley | |
| 2014/0165620 | A1 | 6/2014 | Culley | |
| 2014/0165624 | A1 | 6/2014 | Boarman et al. | |
| 2014/0167321 | A1 | 6/2014 | Culley et al. | |
| 2014/0216072 | A1 | 8/2014 | Matsumoto | |
| 2014/0238053 | A1 | 8/2014 | Bortoletto et al. | |
| 2015/0021458 | A1 | 1/2015 | Zorovich et al. | |
| 2015/0027142 | A1 | 1/2015 | Little et al. | |
| 2015/0040587 | A1 | 2/2015 | Zisholtz et al. | |
| 2015/0107275 | A1 | 4/2015 | Papalia | |
| 2016/0131406 | A1 | 5/2016 | Schoonen | |
| 2016/0201966 | A1 | 7/2016 | Nelson | |
| 2017/0030624 | A1 | 2/2017 | Boarman et al. | |
| 2017/0038112 | A1 | 2/2017 | Papalia | |
| 2017/0042181 | A1 | 2/2017 | Fiaschi | |
| 2017/0082338 | A1 | 3/2017 | Wobrock et al. | |
| 2017/0122637 | A1 | 5/2017 | Mor | |
| 2018/0017303 | A1 | 1/2018 | Hsu | |
| 2018/0252454 | A1 | 9/2018 | Christensen et al. | |
| 2018/0306479 | A1 | 10/2018 | Vazquez | |
| 2019/0011158 | A1 | 1/2019 | Sul et al. | |
| 2019/0093933 | A1 | 3/2019 | Little et al. | |
| 2019/0257576 | A1 | 8/2019 | Pankaj | |
| 2019/0264970 | A1 | 8/2019 | Tarr et al. | |
| 2019/0338995 | A1 | 11/2019 | Bertolini et al. | |
| 2020/0025426 | A1 | 1/2020 | Wilkins et al. | |
| 2020/0041186 | A1 | 2/2020 | Junge et al. | |
| 2020/0158396 | A1 | 5/2020 | Kim et al. | |
| 2020/0158402 | A1 | 5/2020 | Kim et al. | |
| 2020/0182535 | A1 | 6/2020 | Scalf | |
| 2021/0092108 | A1 | 3/2021 | Jen et al. | |
| 2021/0333032 | A1 | 10/2021 | Harrell | |
| 2021/0381746 | A1 | 12/2021 | Boarman et al. | |
| 2022/0146175 | A1 | 5/2022 | Haider | |
| 2022/0163249 | A1 | 5/2022 | Notaney et al. | |
| 2022/0243971 | A1 | 8/2022 | Harrell | |
| 2022/0316782 | A1* | 10/2022 | Mitchell | F25C 5/06 |
| 2023/0221053 | A1* | 7/2023 | Mitchell | F25C 1/10 62/356 |
| 2023/0263175 | A1* | 8/2023 | Finnsson | F25D 3/06 53/473 |
| 2024/0027118 | A1 | 1/2024 | Notaney et al. | |
| 2024/0167747 | A1 | 5/2024 | Notaney et al. | |

FOREIGN PATENT DOCUMENTS

| | | | | |
|---|---|---|---|---|
| CN | 106135628 | A | 11/2016 | |
| CN | 206281268 | U | 6/2017 | |
| CN | 106949685 | A | 7/2017 | |
| CN | 208606446 | U | 3/2019 | |
| CN | 208804924 | U | 4/2019 | |
| CN | 111426111 | | 7/2020 | |
| CN | 111829243 | A | 10/2020 | |
| CN | 114234508 | A | 3/2022 | |
| DE | 000003909316 | A1 | 9/1990 | |
| DE | 202004002823 | U1 | 4/2004 | |
| EP | 0364686 | A1 | 4/1990 | |
| FR | 2330977 | A1 | 6/1977 | |
| JP | 01006664 | S | 1/1989 | |
| JP | S646664 | A | 1/1989 | |
| JP | H0367973 | A | 3/1991 | |
| JP | H03170759 | A | 7/1991 | |
| JP | 2883315 | B2 | 4/1999 | |
| JP | 3340185 | B2 | 11/2002 | |
| JP | 2003279208 | A | 10/2003 | |
| JP | 2007078215 | A | 3/2007 | |
| JP | 2009287787 | A | 12/2009 | |
| JP | 2015154764 | A | 8/2015 | |
| JP | 2016054654 | A | 4/2016 | |
| KR | 200317463 | Y1 | 6/2003 | |
| KR | 20120064026 | A | 6/2012 | |
| KR | 20120111710 | A | 10/2012 | |
| KR | 101225651 | B1 | 1/2013 | |
| KR | 20170052100 | A * | 5/2017 | F25C 1/18 |
| KR | 20170077363 | A | 7/2017 | |
| KR | 20180000152 | A | 1/2018 | |
| TW | M512121 | U | 11/2015 | |
| WO | 1990011481 | A2 | 10/1990 | |
| WO | 2006127867 | A2 | 11/2006 | |
| WO | 2008061179 | A3 | 10/2008 | |
| WO | 2014174314 | A2 | 10/2014 | |
| WO | 2014178710 | A1 | 11/2014 | |
| WO | 2017216294 | A1 | 12/2017 | |
| WO | 2019175909 | A1 | 9/2019 | |
| WO | 2019183327 | A1 | 9/2019 | |
| WO | 2021092108 | A1 | 5/2021 | |
| WO | 2022067375 | A1 | 4/2022 | |
| WO | WO2022109201 | A1 | 5/2022 | |
| WO | WO2022109237 | A1 | 5/2022 | |
| WO | WO-2022247459 | A1 * | 12/2022 | F25C 1/04 |
| WO | WO2024192331 | A2 | 9/2024 | |

OTHER PUBLICATIONS

English translation of KR-20170052100-A by EPO. (Year: 2017).*

Extended European Search Report dated Sep. 23, 2024 re EP 21895650.6 (11 pages).

Extended European Search Report re 21895628.2-1201 / 4248152 PCT/US202105998 dated Nov. 13, 2024 (8 pages).

Extended European Search Report re EP Application No. 21895651.4-1201 / 424815 dated Dec. 9, 2024 (11 pages).

International Search Report and Written Opinion for PCT/US2021/060039 dated Mar. 22, 2022, 8 pages.

International Search Report and Written Opinion from the International Searching Authority for PCT/US2021/059988 dated Mar. 16, 2022, 15 pages.

International Search Report and Written Opinion re PCT/US24/14232 dated May 22, 2024 (13 pages).

International Search Report and Written Opinion re PCT/US24/20107 mailed Jul. 11, 2024 (11 pages).

International Search Report mailed Mar. 15, 2024 re PCT/US2023/080698 (4 pages).

International Search Report re PCT/US20/59014 mailed Feb. 2, 2021 (3 pages).

International Search Report re PCT/US21/59988 mailed Mar. 16, 2022 (4 pages).

International Search Report re PCT/US21/60037 mailed Mar. 16, 2022 (4 pages).

International Search Report re PCT/US23/67076 mailing date Nov. 9, 2023 (4 pages).

International Search Report re PCT/US24/11274 dated Jun. 21, 2024 (4 pages).

Written Opinion mailed Mar. 15, 2024 re PCT/US2023/080698 (7 pages).

Written Opinion re PCT/US20/59014 mailed Feb. 2, 2021 (10 pages).

Written Opinion re PCT/US21/59988 mailed Mar. 16, 2022 (10 pages).

Written Opinion re PCT/US21/60037 mailed Mar. 16, 2022 (6 pages).

Written Opinion re PCT/US23/67076 mailing date Nov. 9, 2023 (6 pages).

(56) References Cited

OTHER PUBLICATIONS

Written Opinion re PCT/US24/11274 dated Jun. 21, 2024 (15 pages).

* cited by examiner

DEVICES FOR SHAPING CLEAR ICE PRODUCTS AND RELATED METHODS

CROSS-REFERENCE TO RELATED APPLICATION

This application is a continuation of International Application No. PCT/US2024/014232, filed on Feb. 2, 2024, which claims the priority benefit of U.S. Provisional Application No. 63/482,841, filed on Feb. 2, 2023, the disclosures of each of which are herein incorporated by reference in their entireties.

TECHNICAL FIELD

This disclosure relates generally to the field of ice manufacturing, and more specifically to the field of clear ice manufacturing. Described herein are devices and methods for producing and shaping clear ice.

BACKGROUND

From the end of the prohibition era to modern day, craft cocktails are a mainstay in most restaurants and bars. To enhance the overall experience, many restaurants and bars add garnishes and/or specialty ice to the cocktails. Currently, these restaurants and bars buy large blocks of ice that are then cut down in-house to the appropriate size for each drink. Some companies in the space claim to produce clear ice using directional freezing, but the clarity of the ice and scalability of the technology are questionable. Further, issues with standard ice machines include cracking, trapped air bubbles, and water impurities resulting in ice that lacks the desired appeal and appearance. There is a need for new and useful devices and methods for shaping ice.

SUMMARY

Systems and methods are described for shaping ice ingots. In some aspects, the techniques described herein relate to an apparatus including: a support frame; a mold for shaping ice ingots, the mold including: a first clamshell part coupled to a first pivot point installed on the support frame, the first clamshell part having a first plurality of mold cavities on a first surface and a first channel embedded behind the first surface and configured to receive a first flow of fluid; a second clamshell part coupled to a second pivot point installed on the support frame and substantially adjacent to the first pivot point, the second clamshell part having a second plurality of mold cavities on a second surface and a second channel embedded behind the second surface and configured to receive a second flow of fluid; a positioning means configured to dispose the first surface of the first clamshell part against a first side surface of an elongate ice ingot and a second surface of the second clamshell part against a second side surface of the elongate ice ingot, the first side surface of the elongate ice ingot being opposite the second side surface of the elongate ice ingot; and at least one fluid inlet valve for each of the first clamshell part and the second clamshell part, the at least one fluid inlet valve being configured to control the first flow of fluid through the first channel associated with the first clamshell part, and the second flow of fluid through the second channel associated with the second clamshell part.

In some aspects, the techniques described herein relate to an apparatus, wherein: the first clamshell part is configured to turn about the first pivot point to arrange the first surface from about zero degrees to about 30 degrees from a longitudinal plane of the apparatus and toward the second surface; the second clamshell part is configured to turn about the second pivot point to arrange the second surface from about zero degrees to about 30 degrees from the longitudinal plane of the apparatus and toward the first surface.

In some aspects, the techniques described herein relate to an apparatus, wherein the positioning means is further configured to: cause the first clamshell part and the second clamshell part to compress the elongate ice ingot during the first and second flows of the fluid such that the elongate ice ingot selectively melts to form a plurality of sufficiently distinct ice structures as defined by the first plurality of mold cavities and the second plurality of mold cavities.

In some aspects, the techniques described herein relate to an apparatus, wherein the plurality of sufficiently distinct ice structures include a plurality ice spheres shaped according to the first plurality of mold cavities and the second plurality of mold cavities and formed by compressing the elongate ice ingot until joining the first surface to the second surface over a predefined time period.

In some aspects, the techniques described herein relate to an apparatus, wherein: a plurality of shaped cavities is defined when the first surface of the first clamshell part is placed adjacent to the second surface of the second clamshell part.

In some aspects, the techniques described herein relate to an apparatus, wherein: the first clamshell part further includes a first set of outlets for draining the flow of fluid away from the first clamshell part; and the second clamshell part further includes a second set of outlets for draining the flow of fluid away from the second clamshell part.

In some aspects, the techniques described herein relate to an apparatus, wherein: at least one cavity in the first plurality of mold cavities includes a pressure relief pin hole; and at least one cavity in the second plurality of mold cavities includes a pressure relief pin hole.

In some aspects, the techniques described herein relate to an apparatus, further including an input chamber and an output chamber in a first layer of the first clamshell part; wherein the first channel associated with the first clamshell part includes a plurality of input channels and a plurality of output channels, wherein: the plurality of input channels and the plurality of output channels are located in a second layer of the first clamshell part, the plurality of input channels being fluidly connected to the input chamber and the plurality of output channels being fluidly connected to the output chamber.

In some aspects, the techniques described herein relate to an apparatus, wherein the fluid is water and the first flow of fluid and the second flow of fluid are constant during a shaping process, the fluid being at a temperature between about 37 degrees Celsius and about 98 degrees Celsius.

In some aspects, the techniques described herein relate to an apparatus, wherein the positioning means is configured to cause the first clamshell part to turn about the first pivot point in a first direction toward the second surface and cause the second clamshell part to turn about the second pivot point in a second direction toward the first surface to at least partially encapsulate the elongate ice ingot until the first surface of the first clamshell part contacts the second surface of the second clamshell part.

In some aspects, the techniques described herein relate to an apparatus, wherein the positioning means is further configured to cause the first clamshell part and the second clamshell part to maintain a constant force on the elongate ice ingot until completion of an ice shaping process. further including a conveyor system including a conveyance portion and a plurality of offset supports, the conveyor system being arranged substantially parallel to the mold and beneath a bottom surface of the mold, wherein the conveyor system is configured to: receive the elongate ice ingot at two or more of the offset supports and advance the conveyance portion to move the elongate ice ingot to a predefined position substantially along a bottom surface of the mold; and transport a plurality of sufficiently distinct ice structures formed in the plurality of mold cavities at completion of an ice shaping process.

In some aspects, the techniques described herein relate to an apparatus, further including a computing device, the computing device including at least one processor and memory storing instructions that when executed cause the at least one processor to generate and trigger display of at least one user interface configured to receive user input corresponding to at least one of: a mold clamping metric, a recipe for shaping the elongate ice ingot, or a mold size.

In some aspects, the techniques described herein relate to an apparatus, wherein the mold further includes a drain system that drains fluid from the first plurality of mold cavities and the second plurality of mold cavities.

In some aspects, the techniques described herein relate to an apparatus, wherein the first and second plurality of mold cavities are arranged to form a shape selected from the group consisting of: a cuboid shape, a polyhedron shape, a sphere shape, a heart shape, a diamond shape, a clover shape, a polygon shape, and a hemispherical shape.

In some aspects, the techniques described herein relate to a method of manufacturing a plurality of ice structures, the method including: providing a mold for shaping ice, the mold including: a first clamshell part coupled to a first pivot point installed on a support, the first clamshell part having a first plurality of mold cavities on a first surface and a first channel embedded behind the first surface; a second clamshell part coupled to a second pivot point installed on the support and substantially adjacent to the first pivot point, the second clamshell part having a second plurality of mold cavities on a second surface and a second channel embedded behind the second surface, wherein the first surface substantially faces the second surface at a predefined angle from a longitudinal plane of the mold; receiving an elongate ice ingot at the mold; causing the first clamshell part to turn about the first pivot point toward the second surface and causing the second clamshell part to turn about the second pivot point toward the first surface to at least partially encapsulate the elongate ice ingot; causing a first flow of fluid through the first channel; causing a second flow of fluid through the second channel, wherein the first flow of fluid and the second flow of fluid are thermally heated to a predefined temperature; and causing the first clamshell part and the second clamshell part to compress the elongate ice ingot during the first and second flows of the fluid such that the elongate ice ingot selectively melts to form a plurality of sufficiently distinct ice structures as defined by the first plurality of mold cavities and the second plurality of mold cavities.

In some aspects, the techniques described herein relate to a method, wherein: the first clamshell part is configured to turn about the first pivot point to arrange the first surface from about zero degrees to about 30 degrees from a longitudinal plane of a device housing the mold and toward the second surface; the second clamshell part is configured to turn about the second pivot point to arrange the second surface from about zero degrees to about 30 degrees from the longitudinal plane of a device housing the mold and toward the first surface.

In some aspects, the techniques described herein relate to a method, wherein causing the first clamshell part and the second clamshell part to compress the elongate ice ingot includes providing, by the first clamshell part, a tension force on a first side of the elongate ice ingot while the second clamshell part provides an equal and opposite tension force on a second and opposite side of the elongate ice ingot.

In some aspects, the techniques described herein relate to a method, wherein the plurality of sufficiently distinct ice structures include a plurality ice spheres shaped according to the first plurality of mold cavities and the second plurality of mold cavities and formed by joining the first surface to the second surface over a predefined time period.

In some aspects, the techniques described herein relate to a method, wherein the method further includes: providing a conveyor system including a conveyance portion and a plurality of offset supports, the conveyor system being arranged substantially parallel to the mold and beneath a bottom surface of the mold; and causing the conveyor system to receive the elongate ice ingot at two or more of the offset supports and advance the conveyance portion to move the elongate ice ingot to a predefined position substantially along a bottom surface of the mold; causing, transport of the plurality of sufficiently distinct ice structures when released from the plurality of mold cavities and in response to detecting completion of an ice shaping process.

In some aspects, the techniques described herein relate to a method, wherein the mold further includes a drain system that drains fluid from the first plurality of mold cavities and the second plurality of mold cavities.

In some aspects, the techniques described herein relate to a method, wherein the drain system includes: a pressure relief pin hole in each of the first plurality of mold cavities; and a pressure relief pin hole in each of the second plurality of mold cavities.

In some aspects, the techniques described herein relate to a method, wherein the first and second plurality of mold cavities are arranged to form a shape selected from the group consisting of: a cuboid shape, a polyhedron shape, a sphere shape, a heart shape, a diamond shape, a clover shape, a polygon shape, and a hemispherical shape.

BRIEF DESCRIPTION OF THE DRAWINGS

The foregoing is a summary, and thus, necessarily limited in detail. The above-mentioned aspects, as well as other aspects, features, and advantages of the present technology are described below in connection with various embodiments, with reference made to the accompanying drawings.

Figure 1A:
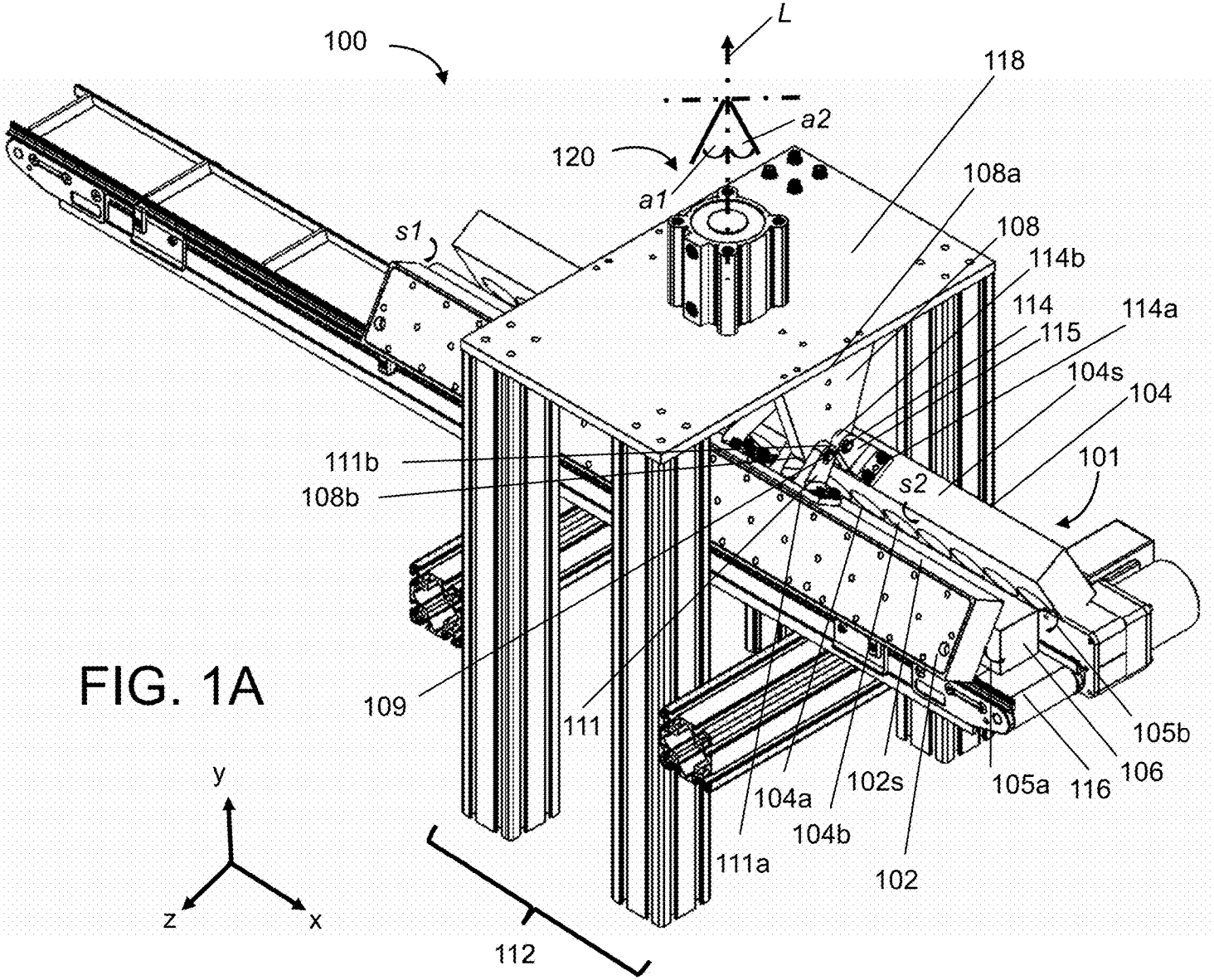
FIGS. 1A-1F illustrate an example device for shaping ice ingots.

The illustrated embodiments are merely examples and are not intended to limit the disclosure. The schematics are drawn to illustrate features and concepts and are not necessarily drawn to scale.

DETAILED DESCRIPTION

The foregoing is a summary, and thus, necessarily limited in detail. The above-mentioned aspects, as well as other aspects, features, and advantages of the present technology will now be described in connection with various embodiments. The inclusion of the following embodiments is not intended to limit the disclosure to these embodiments, but rather to enable any person skilled in the art to make and use the contemplated invention(s). Other embodiments may be utilized, and modifications may be made without departing from the spirit or scope of the subject matter presented herein. Aspects of the disclosure, as described and illustrated herein, can be arranged, combined, modified, and designed in a variety of different formulations, all of which are explicitly contemplated and form part of this disclosure.

This disclosure relates generally to devices, systems, and methods for shaping and harvesting ice ingots. For example, the devices, systems, and methods described herein may be configured to shape and harvest ice in a variety of shapes that are ready for use in beverages. In general, the ice shaped by the devices, systems, and methods described herein is generated from elongate ingots of ice generated by an ice making machine. The elongate/elongated ice ingots may be obtained or otherwise received by the devices described herein in a clear, crystalline form. However, the devices, systems, and methods described herein may be configured to function with ice of any clarity, shape, and/or size.

In some embodiments, the elongate ice ingots are substantially rectangular in shape and have a bottom surface, a top surface, a first side surface, a second side surface, a first end surface, and a second end surface. The bottom surface is opposite the top surface. The first side surface is opposite the second side surface. The first end surface is opposite the second end surface. In some embodiments, the ice ingots shaped by the devices and methods described herein may measure about 1 meter to about 4 meters in length. In some embodiments, the ice ingots are cylindrical or semi-cylindrical or non-symmetrical and may have a radius of about 1.25 centimeters to about 8 centimeters. In some embodiments, the ice ingots are cylindrical or semi-cylindrical and may have a radius of about 2 centimeters to about 5 centimeters. In some embodiments, the ice ingots are cylindrical or semi-cylindrical and may have a radius of about 5 centimeters to about 8 centimeters.

In some embodiments, the devices described herein may be installed with or coupled to one or more molds. The molds may be used to process (e.g., shape) elongate ice ingots to produce multiple pieces (e.g., structures) of shaped ice structures per cycle. In some embodiments, the molds may include one, two, or more than two mold portions arranged to receive a flow of water within mold cavities formed by the mold portions. In some embodiments, each mold portion may be a single cavity mold. In some embodiments, each mold portion may be a multicavity mold. For example, the mold may be a multi-plate mold with a number of separate portions (e.g., plates) that may be heated and/or cooled by flowing water and/or heat transfer fluid throughout one or more cavities and/or channels within one or more of the mold plates.

As used herein, the term "shaping" may include forming, cutting, melting, embossing, etching, planing, or any other methods of producing ice having a desired shape, form, or appearance. As used herein, the term "shape" may include any three-dimensional forms including, but not limited to a cuboid shape, a polyhedron shape, a sphere shape, a heart shape, a diamond shape, a clover shape, a polygon shape, a hemispherical shape, and the like.

In some embodiments, a shape may represent a portion and/or an entirety of a mold cavity. In some embodiments, a mold may include a plurality of mold cavities where each mold cavity is formed as a shape such as a cuboid shape, a polyhedron shape, a sphere shape, a heart shape, a diamond shape, a clover shape, a polygon shape, and a hemispherical shape. Although one of skill in the art will appreciate that any of the molds or devices or systems described herein may be adapted for processing a singular ice structure, such as a cube or sphere (or other shape) resulting from a mold cavity of about 1 cubic inch (e.g., 16.4 cubic centimeters) to about a 2.75 cubic inches (e.g., 45 cubic centimeters). Any mold size may be configured to create any sized ice form therein for processing by any of the devices, systems, and methods described herein.

Systems and Devices

The devices (e.g., systems, apparatuses) described herein may operate to produce shaped ice. For example, such devices may be used for shaping ice in any situation where transparent (e.g., unclouded) or non-transparent ice is desired, such as for consumption in cocktails and other beverages, but can additionally or alternatively be used for any suitable applications where a liquid material (e.g., fluid, water, etc.) is frozen. As used herein, shaping ice may refer to heating and cooling molds (or mold portions) to respectively melt liquid from ice ingots and/or refreeze liquid to form several shaped structures according to one or more cavity shapes defined by a particular mold. In some embodiments, the devices described herein function to shape ice ingots into a number of different shapes and sizes by strategically melting portions of the ice ingots that are seated partially or wholly within one or more molds.

The molds described herein may include mold cavities of particular sizes and/or shapes. The molds described herein may be interchangeably installed into an ice shaping device. For example, the molds may be single part or multipart and may be interchangeable with other molds for purposes of shaping ice with a plurality of different shapes and sizes. For example, a mold (or mold assembly) may be configured to generate 1 to 10; 10 to 50; or 1 to 50 shaped ice structures from an elongate, ice ingot. The elongate ice ingot may be substantially rectangular, asymmetric (e.g., one side that is substantially semi-circular opposite a second side that is substantially rectangular), symmetric, cylindrical, etc. Further, the molds may be adapted to form other sizes and shapes of ice ingots and may be configured to generate ice structures with any other moldable shape or size associated with a particular installed mold (or mold assembly).

In operation, the ice shaping devices (e.g., apparatuses, systems) described herein may function to shape ice ingots using heating and/or cooling steps. Such steps may be carried out using a combination of materials configured to heat and/or cool molds, mold portions, or containers that may encapsulate and/or partially encapsulate ice ingots. The ice shaping devices described herein may employ electrical heating or cooling techniques, plumbed heating or cooling techniques via thermal transfer (e.g., using a heated or cooled fluid), induction heating or cooling techniques, or a combination thereof. In some embodiments, the ice shaping devices described herein may be configured to heat and/or cool ice ingots by heating or cooling a mold portion configured to generate, hold, or encase an ice ingot. The heating and cooling may function to generate a specific shape of ice from a larger block or ingot of ice. For example, heated water may be constantly flowed throughout a multi-plate manifold of a first mold housing and/or a second mold housing to heat the respective assemblies or shaped mold cavities that surround and/or press against at least two surfaces of an ice ingot. In particular, the heated water (or other fluid) may be in thermal communication with the shaped mold cavities, but may not be in fluid communication with the shaped mold cavities. The mold assemblies may be pressed together (or one pressed toward another) to form the shaped mold cavities as the ice ingot melts to form ice structures within the shaped mold cavities of the mold assemblies/housings. In some embodiments, the ice ingot may be compressed on at least two sides by a clamshell mold that compresses from a substantially hinged (e.g., pivot point) joint to at least partially surround the ice ingot. Such a mold may compress for a predefined amount of time and/or until both sides of the clamshell mold meet surrounding ice structures in the shaped mold cavities. Upon completion of generating (e.g., shaping) the ice structures, the devices described herein may expel the ice structures into one or more devices that may receive, hold, and/or transport (e.g., roll) ice into a container, a conveyor, or other assembly, device, or structure for transporting the shaped ice structures.

FIG. 1A illustrates a top down front perspective view of an example device 100 for shaping an ingot of ice. The device 100 represents an ice shaping device that may receive an elongate ice ingot and perform heating and/or cooling steps to shape the received elongate ice ingot into many distinct and separate ice shapes (e.g., ice structures). The shape may be dependent on a selected and/or installable mold 101 that includes one or more cavities, each of a particular shape. In general, the device 100 may employ subtractive manufacturing techniques to shape ice products. In particular, the device 100 may use one or more mold housings to generate one or more (or multiple) ice shapes at a time by heating portions of the mold housings to eventually exchange heat (from the portions of the mold housings) to the shaped mold cavities, which may in turn, transfer the heat to an ice ingot to melt away unwanted ice portions and subsequently shape and mold ice structures within the cavities.

At a high level, the device 100 includes a support frame 112, a first ice mold housing (e.g., clamshell part 102), a second ice mold housing (e.g., clamshell part 104), and a processing conveyor system 116 to provide an ice ingot (e.g., ice ingot 106) to the parts 102, 104. In some embodiments, a computing station (not shown) is also communicatively connected to device 100 to, for example, receive commands to operate the device 100, display graphical user interfaces, and/or otherwise interface between device 100 and users and/or other devices communicatively coupled to device 100.

As shown in FIG. 1A, the device 100 includes a mold 101 for shaping ice ingots into a particular cavity shape. The mold 101 may be formed by, or generally comprised of a first mold housing that includes a first clamshell part 102 and a second mold housing that includes a second clamshell part 104.

The first clamshell part 102 includes a first surface s1 having a first plurality of mold cavities (not shown). The first clamshell part 102 may be movably coupled to a support structure 108 at a first pivot point 109. The support structure 108 may be coupled to a surface 118 of the support frame 112 at a first end 108*a* of the support structure 108 and to the first pivot point 109 substantially adjacent to a second end 108*b* of the support structure 108. A first support arm 111 may be coupled to or (otherwise shaped into) a sidewall 102*s* of the first clamshell part 102 at a first end portion 111*a*. The first support arm 111 includes an aperture within a distance of a second end portion 111*b* in which to receive (or otherwise thread onto, fit to, or mount to) the first pivot point 109.

Figure 1B:
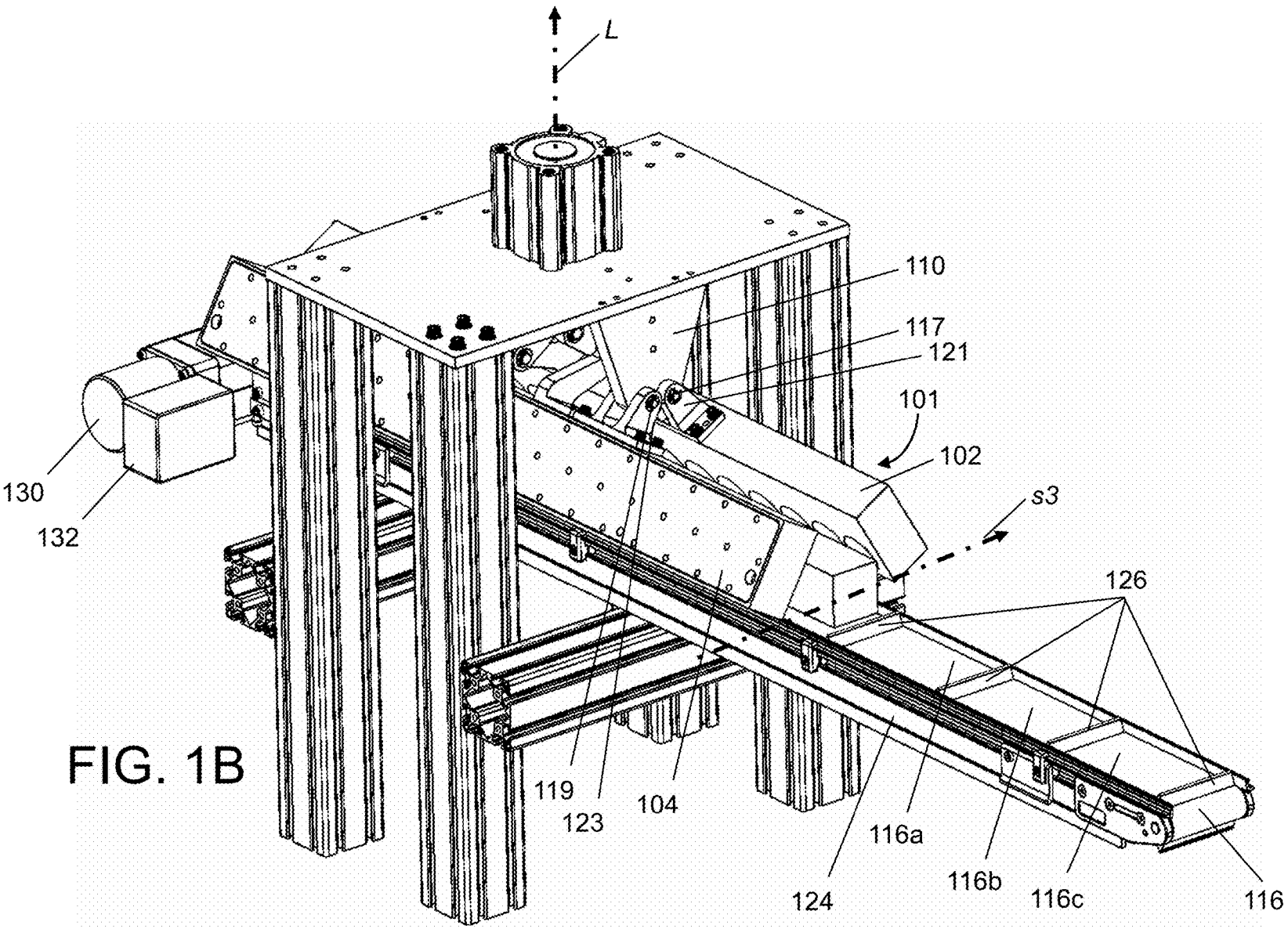

In some embodiments, the first clamshell part 102 is further movably coupled to a support structure 110 (see FIG. 1B) at a third pivot point 117 (see FIG. 1B). The support structure 110 is arranged in parallel to the support structure 108 on an opposite side of a surface 118 of the support frame 112. The support structure 110 may be coupled to the surface 118 of the support frame 112 at a first end and to the third pivot point 117 at a second end of the support frame 112. A third support arm 121 (see FIG. 1B) may be coupled to or (otherwise shaped into) a sidewall 102*s* of the first clamshell part 102. The third support arm 121 includes an aperture within a distance of an end portion of the arm 121 in which to receive (or otherwise thread onto, fit to, or mount to) the third pivot point 117.

In some embodiments, the second clamshell part 104 is further movably coupled to the support structure 110 at a fourth pivot point 119 (see FIG. 1B). The support structure 110 may be coupled to the surface 118 and to the fourth pivot point 119. A fourth support arm 123 (see FIG. 1B) may be coupled to or (otherwise shaped into) a sidewall 104*s* of the second clamshell part 104. The second support arm 123 includes an aperture within a distance of a second end of the arm 123 in which to receive (or otherwise thread onto, fit to, or mount to) the fourth pivot point 119.

The second clamshell part 104 includes a second surface s2 having a second plurality of mold cavities (e.g., cavities 104*a*, 104*b*, etc.). The second clamshell part 104 may be movably coupled to a support structure 108 at a second pivot point 114. The support structure 108 may be coupled to a portion of the support frame 112 at the first end 108*a* of the support structure 108 and to the second pivot point 114 substantially adjacent to the second end 108*b* of the support structure 108. A second support arm 115 may be coupled to or (otherwise shaped into) a sidewall 102*s* of the second clamshell part 104 at a first end portion 114*a*. The second support arm 115 includes an aperture within a distance of a second end portion 114*b* in which to receive (or otherwise thread onto, fit to, or mount to) the second pivot point 114.

The first clamshell part 102 may be arranged to move (e.g., swing/turn) about the first pivot point 109 in a first direction toward (shown at arrow 105*a*) the second surface s2 of the second clamshell part 104 to allow device 200 to shape ice ingots into harvestable ice structures. Similarly, the second clamshell part 104 may be arranged to move (e.g., swing/turn) about the second pivot point 114 in a first direction toward (shown at arrow 105*b*) the first surface s1 of the first clamshell part 102 to allow device 100 to shape ice ingots into harvestable ice structures.

As shown in FIG. 1A, the surface s1 is positioned at an angle a1 from a longitudinal plane L of the device 100. The surface s1 of the first clamshell part 102 may be automatically positioned based on a recipe for shaping ice including, but not limited to, a shaping time, a shaping temperature, a machine configuration step, an ice ingot size, and/or a position of the ice ingot or a position of the second clamshell part 104. In some embodiments, the surface s1 may be manually positioned. In some embodiments, the surface s1 may start in an initial position and move over time into additional ice shaping positions and/or ice structure ejecting positions. For example, an initial position for the first clamshell part 102 may include 30 degrees from the longitudinal plane L of the device 100 and away the second surface s2 with respect to at least one top or bottom edge of the part 102. For example, the first clamshell part 104 may pivot from the pivot point 109 to about 30 degrees (or any angle between zero and 30 degrees) during an ice shaping process such that a bottom edge of the part 102 moves away from the second surface s2.

In general, the angle a1 may represent the first clamshell part 102 arranged at about 15 degrees to about 20 degrees from the longitudinal plane L of the device 100 and away from the second surface s2; about 20 degrees to about 25 degrees; about 25 degrees to about 30 degrees; about 30 degrees to about 35 degrees; about 35 degrees to about 40 degrees; about 40 degrees to about 45 degrees; or about 45 degrees to about 50 degrees.

Similarly, the surface s2 is positioned at an angle a2 from the longitudinal plane L of the device 100. The surface s2 of the second clamshell part 104 may be automatically positioned based on a recipe for shaping ice including, but not limited to, a shaping time, a shaping temperature, a machine configuration step, an ice ingot size, and/or a position of the ice ingot or a position of a counterpart first clamshell part 102. In some embodiments, the surface s2 may be manually positioned. In some embodiments, the surface s2 may start in an initial position and move over time into additional ice shaping positions and/or ice structure ejecting positions. For example, an initial position for the second clamshell part 104 may include 30 degrees from the longitudinal plane L of the device 100 angled away from the first surface s1 on at least one top or bottom edge of the part 104. For example, the second clamshell part 104 may pivot from the pivot point 114 to about 30 degrees (or any angle between zero and 30 degrees) during an ice shaping process such that a bottom edge of the part 104 moves away from the first surface s1.

In general, the angle a2 may represent the second clamshell part 104 arranged at about 15 degrees to about 20 degrees from the longitudinal plane L of the device 100 and away from the first surface s1; about 20 degrees to about 25 degrees. about 25 degrees to about 30 degrees; about 30 degrees to about 35 degrees; about 35 degrees to about 40 degrees; about 40 degrees to about 45 degrees; or about 45 degrees to about 50 degrees.

The device 100 further includes a positioning means 120 configured to dispose the first surface s1 of the first clamshell part 102 against a first side surface 106*a* (FIG. 3A) of the elongate ice ingot 106 and a second surface s2 of the second clamshell part 104 against a second side surface 106*b* (FIG. 3A) of the elongate ice ingot 106. The first side surface 106*a* of the elongate ice ingot 106 is opposite the second side surface 106*b*.

The positioning means 120 may function to cause movement of the first and second clamshell portions 102, 104 about pivot points 109, 114, 117, 119. The positioning means 120 may maintain a constant force on the elongate ice ingot 106 to ensure that melting and ice shaping continues until completion of an ice shaping process, as described elsewhere herein.

The positioning means 120 may be coupled to support structure 108 through an aperture in the support surface 118. The positioning means 120 is depicted here as an air cylinder, pin, and tie rod system. However, one skilled in the art would contemplate other systems for the positioning means 120 including, but not limited to one or more pneumatic, hydraulic or linear motor/actuators, and/or bearings/rail systems that may function to move (e.g., angle, hinge, swing, etc.) the first clamshell part 102 and/or the second clamshell part 104 toward and/or away from the longitudinal plane L of the device 100 to, for example, compress ice ingot 106 and/or release ice structures from the first or second plurality of mold cavities (e.g., 104*a*, 104*b*, 104*c*, etc.). For example, the first clamshell part 102 may be moved (e.g., angled) toward the second clamshell part 104 while the second clamshell part 104 is moved (e.g., angled) toward the first clamshell part 102 to compress the ice ingot 106 by causing the support arms 111, 115 to turn about the respective pivot points 109, 114, 117, 119. The movements may function to surround the elongate ice ingot 106 on a first side and a second side, opposite the first side, while moving the moving parts 102, 104 to a position of surface s1 being substantially adjacent to a position of surface s2. The movements may continue intermittently or continually as the ingot 106 is formed into the mold cavities of mold 101 (i.e., cavities of the first clamshell part 102 and cavities of the second clamshell part 104) until substantially reaching physical contact between the two parts 102, 104 to eventually mold (e.g., shape) ice ingot 106 into a plurality of ice structures in the shape of the mold cavities (not shown) defined by mold 101.

In some embodiments, the positioning means 120 may cause the first clamshell part 102 to turn about the pivot points 109, 117 in a first direction (e.g., as shown by arrow 105*a*) toward the second surface s2 and cause the second clamshell part 104 to turn about the pivot points 114, 119 in a second direction (e.g., as shown by arrow 105*b*) toward the first surface s1 to at least partially encapsulate the elongate ice ingot 106 until the first surface s1 of the first clamshell part 102 contacts the second surface s2 of the second clamshell part 104.

In operation of device 100 and to begin shaping the ice ingot 106, the first clamshell part 102 and the second clamshell part 104 may be caused to turn about the pivot points 109, 114, 117, 119 (by receiving instructions provided to a processor of the device 100) to grip the ice ingot 106 and begin applying force against the ice ingot 106 on at least two sides of the ingot 106. The force may be applied while the parts 102, 104 are heated, as described elsewhere herein. The force may be applied until portions of the ice ingot 106 are melted and other portions of the ice ingot form ice structures within the mold cavities created by joining the first clamshell part 102 to the second clamshell part 104. For example, the positioning means may function to cause the first clamshell part 102 and the second clamshell part 104 to compress the elongate ice ingot 106 during a first and a second flow of the fluid (e.g., water) through one or more channels leading to the plurality of cavities of part 102 and part 104 such that the elongate ice ingot 106 selectively melts to form a plurality of sufficiently distinct ice structures as defined by the plurality of mold cavities of part 102 and part 104.

Upon completion of shaping ice structures in the mold cavities, the first clamshell part 102 and the second clamshell part 104 may unclamp or disengage coupling by turning about respective pivot points 109, 114, 117, 119 in the opposite directions of respective arrows 105*a*, 105*b* to release formed/shaped ice structures from cavities that may be formed when surface s1 is substantially placed in physical contact with surface s2.

While two mold housings (e.g., first clamshell part 102, second clamshell part 104) are shown for mold 101, any number of mold housings may be fitted for use with device 100. For example, the first clamshell part 102 may include a single housing or multiple housings coupled together. Each housing may have one or more ice cavity portions. Additionally, although all components are shown in a vertical orientation (using lateral and/or angled movement between them), one of skill in the art will appreciate that the devices and systems described herein may be configured horizontally or other angle between vertical and horizontal, for example, such that the mold portions move vertically or angled towards one another to process the input elongate ice ingot.

FIG. 1B illustrates a top down rear perspective view of the example device 100 for shaping an ingot of ice. The conveyor system 116 shown here includes a conveyance portion 124 that moves a conveyor belt (116*a*, 116*b*, 116*c*, etc.) along a track and a plurality of offset supports 126 that may balance ice ingot 106, for example, as the belt is conveyed. Conveyer system 116 includes a plurality of portions that are divided into ice collecting bins on the conveyor belt shown here as bins 116*a*, 116*b*, 116*c*, etc., where each bin is defined between at least two offset supports 126.

The conveyor system 116 may be arranged substantially parallel to the mold 101 and beneath a bottom surface s3 of the mold 101. The conveyor system 116 may receive and convey ice ingot 106 upon two or more of the offset supports 126 and may advance the conveyance portion 124 to move the elongate ice ingot 106 to a predefined position substantially along a bottom surface of the mold 101. Once the ingot 106 is in place to be shaped, the device 100 may clamp the ingot 106 using part 102 and part 104 to hinge or otherwise compress into the sides 106*a*, 106*b* of ingot 106 to form a plurality of sufficiently distinct ice structures from the mold cavities of mold 101. Upon completion of an ice shaping cycle, the conveyer system 116 may transport of the plurality of sufficiently distinct ice structures by holding such structures within bins 116*a*, 116*b*, 116*c*, etc. when released from the plurality of mold cavities.

Figure 4A:
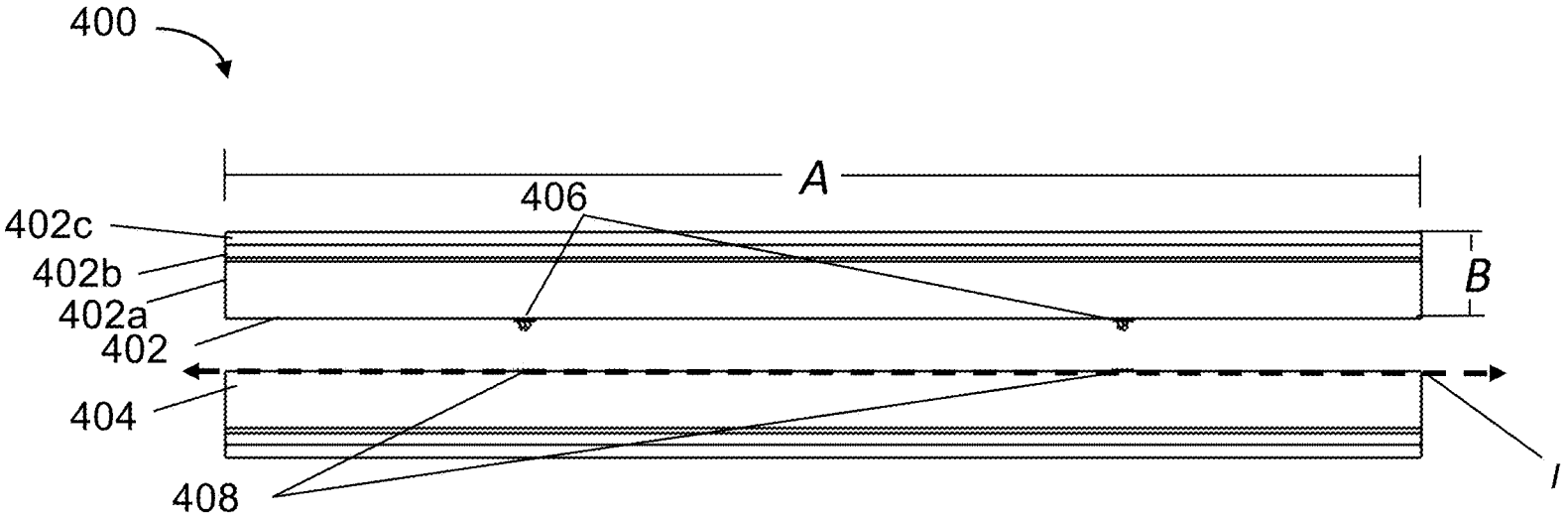
FIG. 4A-4H illustrate various views of mold assemblies for use with the example devices described herein.
Figure 4B:
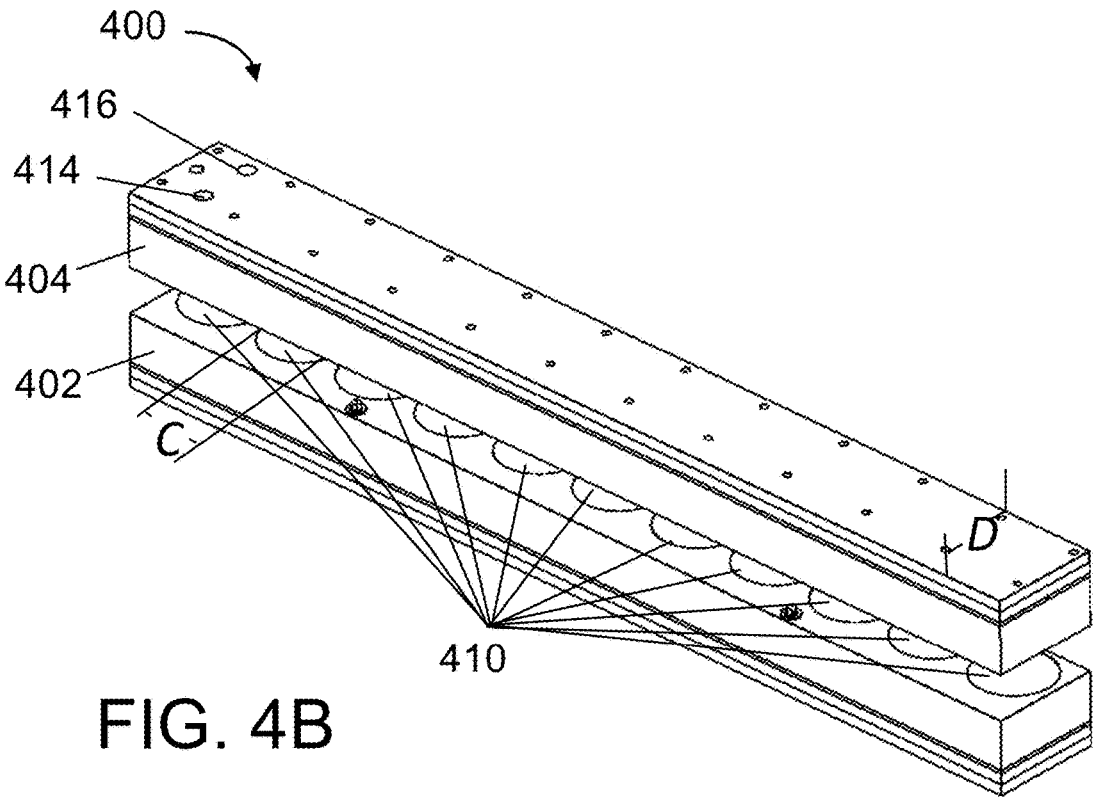
Figure 4C:
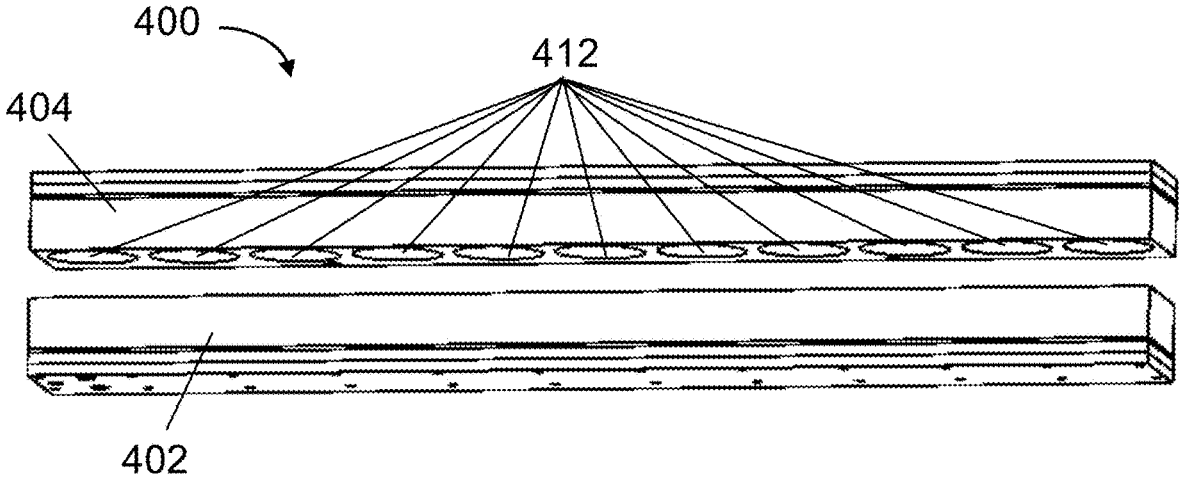
Figure 4D:
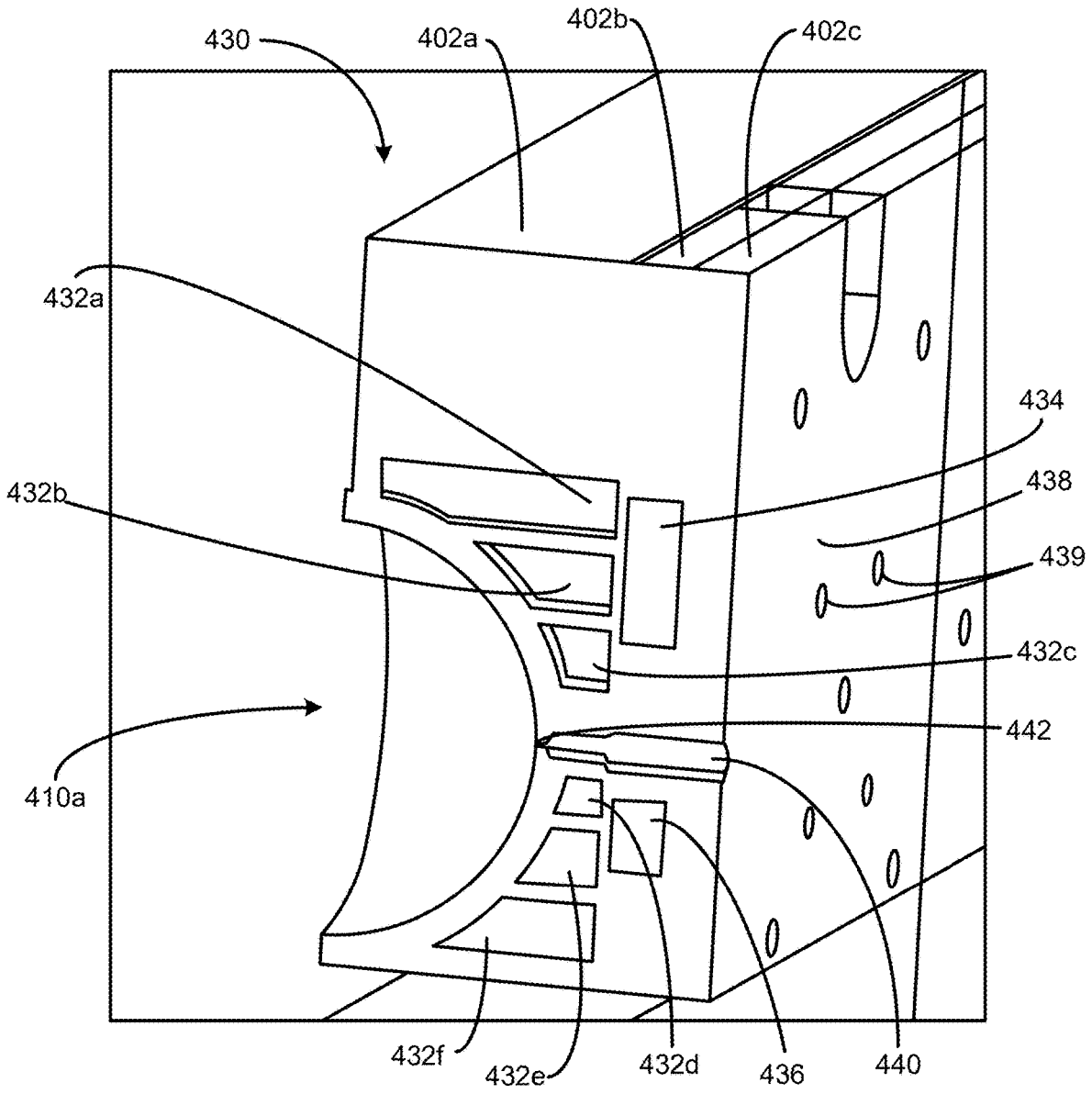
Figure 4E:
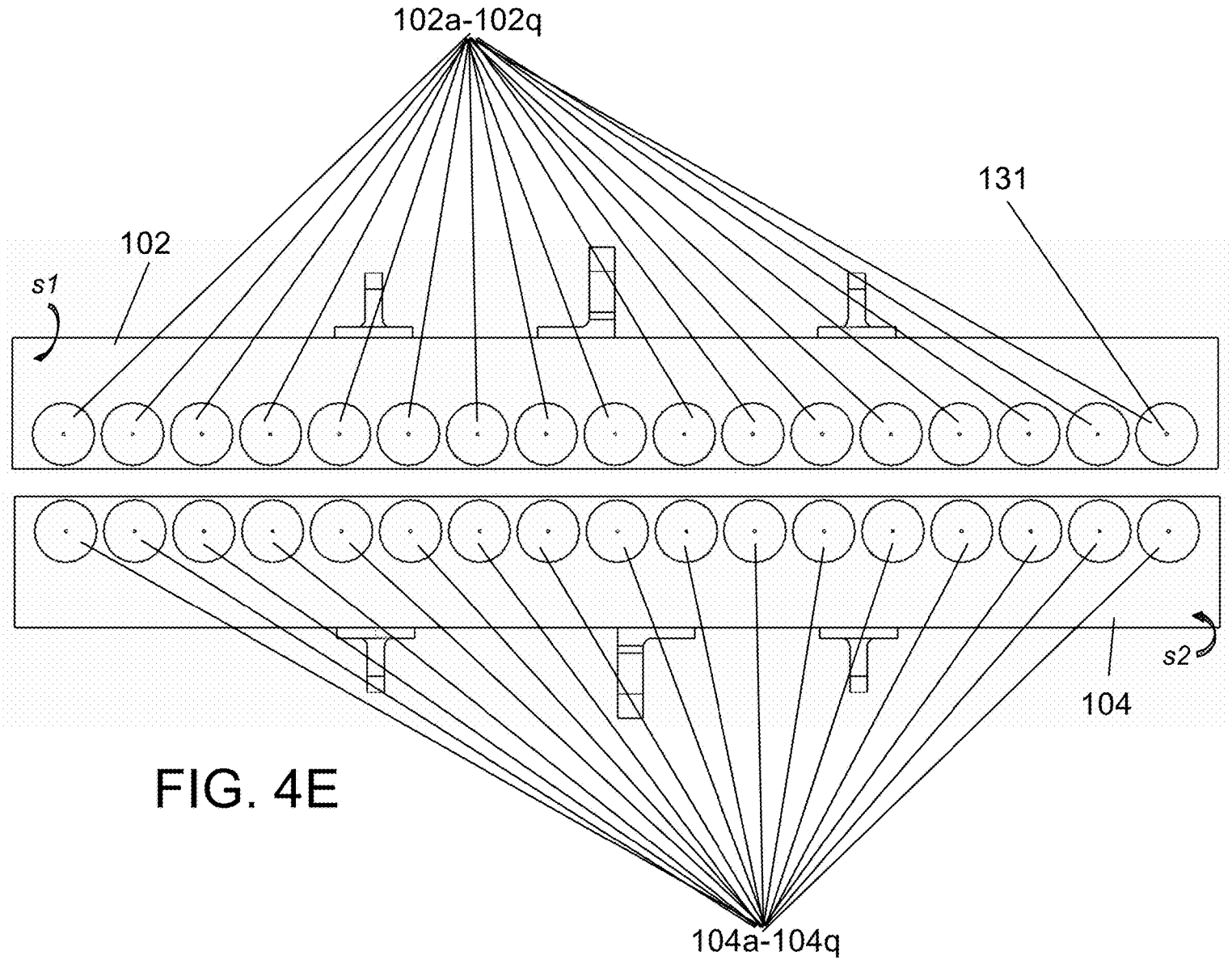

In some embodiments, the plurality of sufficiently distinct ice structures include a plurality ice spheres shaped according to a first plurality of mold cavities (e.g., cavities 102*a*, 102*b*, 102*c*, 102*d*, 102*e*, 102*f*, 102*g*, 102*h*, 102*i*, 102*j*, 102*k*, 1021, 102*m*, 102*n*, 102*o*, 102*p*, 102*q* of FIG. 4E) and a second plurality of mold cavities (e.g., 104*a*, 104*b*, 104*c*, 104*d*, 104*e*, 104*f*, 104*g*, 104*h*, 104*i*, 104*j*, 104*k*, 104*l*, 104*m*, 104*n*, 104*o*, 104*p*, 104*q* of FIG. 4E) and formed by compressing the elongate ice ingot 106 until joining the first surface s1 to the second surface s2 over a predefined time period. For example, the predefined time period may represent an ice shaping process that occurs for about 30 seconds to about 180 seconds; about 30 seconds to about 45 seconds; about 45 seconds to about 60 seconds; about 60 seconds to about 75 seconds; about 75 seconds to about 90 seconds; about 90 seconds to about 105 seconds; about 105 seconds to about 120 seconds; about 120 seconds to about 135 seconds; about 135 seconds to about 150 seconds; about 150 seconds to about 165 seconds; or about 165 seconds to about 180 seconds.

Other mold cavities and mold portions having different ice shapes are possible including, but not limited to mold cavities arranged to form a shape such as a cuboid shape, a polyhedron shape, a heart shape, a diamond shape, a clover shape, a polygon shape, and a hemispherical shape.

The conveyer system 116 may include one or more motors 130 and controllers 132 to move the conveyor belt and thereby move shaped ice structures to another location after shaping. The one or more motors 130 may represent one or more pneumatic, hydraulic or linear motor/actuators, or other positioning means capable of actuating the conveyor system 116. The motors 130 may be triggered to move based on controllers 132 including one or more processors that use signals and/or programming received from one or more processors and/or microcontrollers, PLCs, or the like, as described throughout this disclosure.

The device 100 further includes memory and one or more processors. The memory and one or more processors may be standalone or integrated into one or more computing devices. Instructions may be stored on the one or more processors and/or the one or more computing devices. When executed, the instruction may cause the one or more processors (and/or one or more computing devices) to generate and trigger display of at least one user interface configured to receive user input corresponding to at least one of: a mold clamping metric, a recipe for shaping the elongate ice ingot, or a mold size. The mold clamping metrics, recipes, and/or mold sizes may be used by device 100 to arrange ice ingot shaping.

Figure 1C:
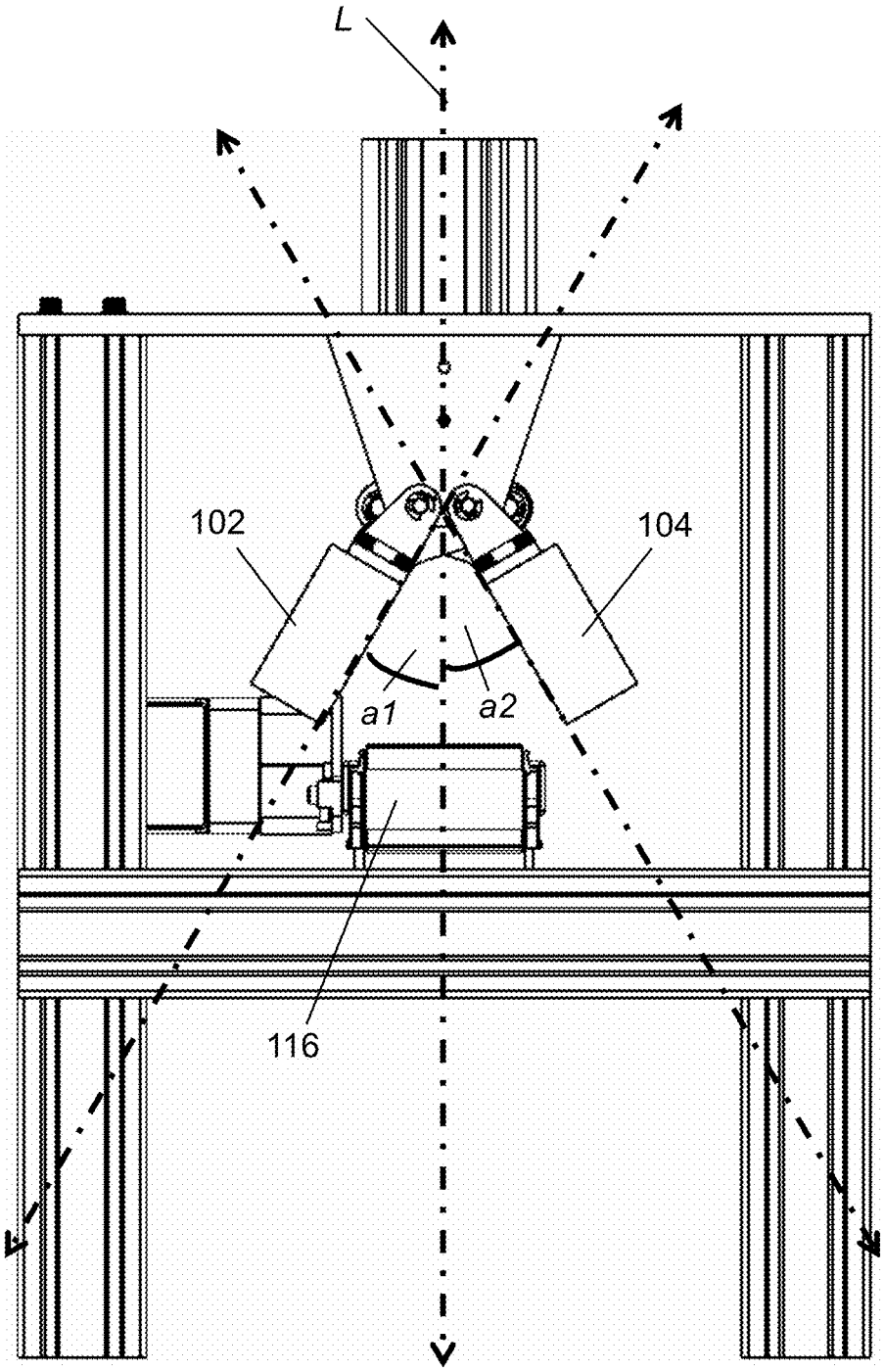

FIG. 1C illustrates a front view of the example device 100 for shaping an ingot of ice. As shown, the first clamshell part 102 is arranged at an angle a1 while the second clamshell part 104 is arranged at an equal and opposite angle a2. The depicted arrangement may represent an initial shaping position before an ingot of ice is introduced to the device 100 on the conveyor system 116. For example, an initial position of the first clamshell part 102 may include the part 102 being angled from about zero degrees to about 30 degrees from the longitudinal plane L of the device 100. The parts 102, 104 may be held in position and/or moved according to the positioning means 120, as described elsewhere herein.

Figure 1D:
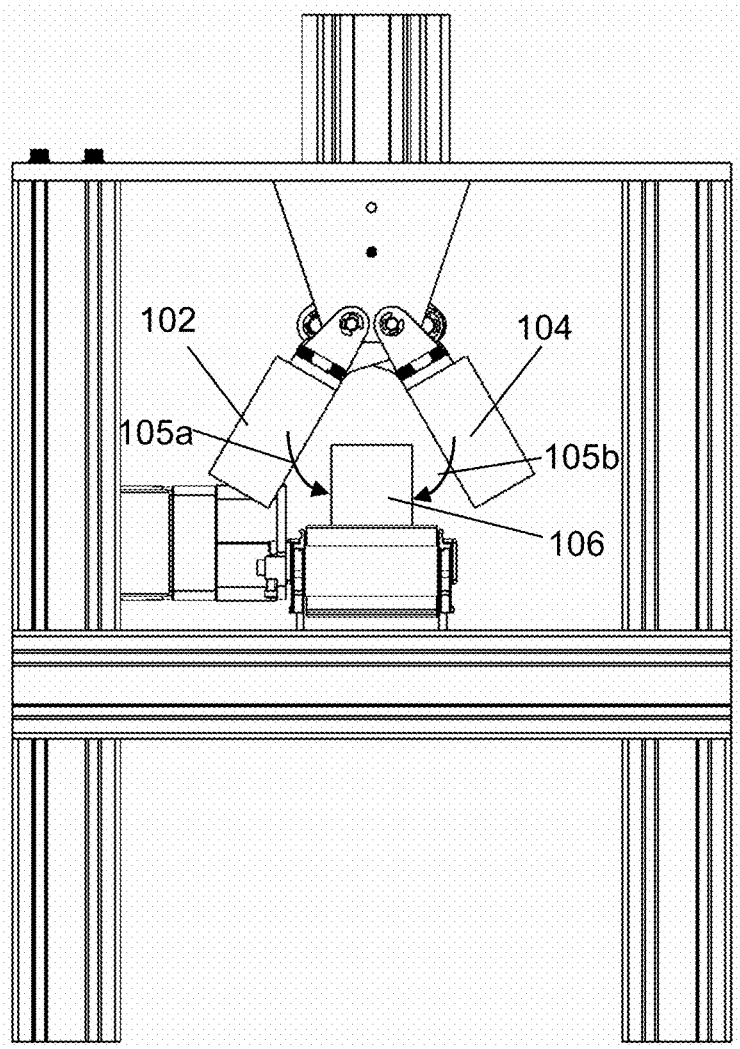

FIG. 1D illustrates a front view of the example device 100 with an elongate ice ingot 106 placed between the first clamshell part 102 and the second clamshell part 104. While the first clamshell part 102 and the second clamshell part 104 are arranged in the initial position, instructions may be received by one or more processors associated with device 100 to move parts 102, 104 to any number of shaping positions that surround and encompass ice ingot 106. During compression, fluid may flow (e.g., from hoses 140, 142 into ports/inlets (not shown) of parts 102, 104 to melt portions of the ice ingot 106 while shaping other portion of the ice ingot 106 into shaped ice structures.

For example, the parts 102, 104 may respectively pivot on pivot points 109, 114, 117, 119 to compress the ingot of ice 106 until melting portions of the ice ingot and forming shapes from other portions of the ice ingot. For example, parts 102, 104 may move in the direction of respective arrows 105*a*, 105*b*, as shown in FIG. 1E.

Figure 1E:
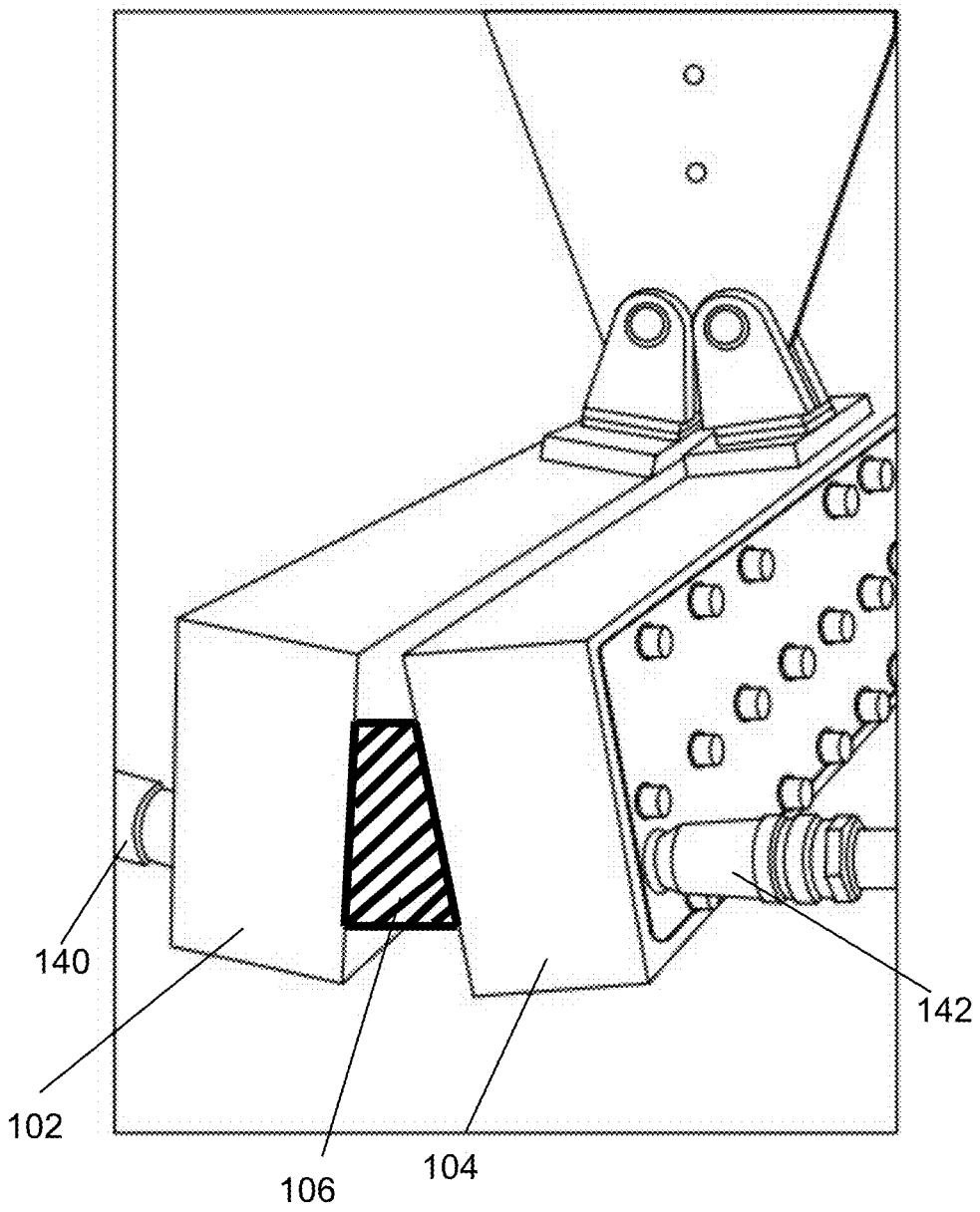

FIG. 1E depicts ice ingot 106 partially melted and under compression while beginning to shape ice structures in a shape formed by cavities of part 102 meeting cavities of part 104. While the position of parts 102, 104 represent a position between initial and completion of ice shaping, the ice shaping process may continue including continuing to compress ice ingot 106 until ice structures are formed within cavities of parts 102, 104, and the remaining ice ingot portions are melted. An example completion position (not shown) may be about 5 degrees to about zero degrees from the longitudinal plane L of the device 100 for both of the first clamshell part 102 and the second clamshell part 104.

Figure 1F:
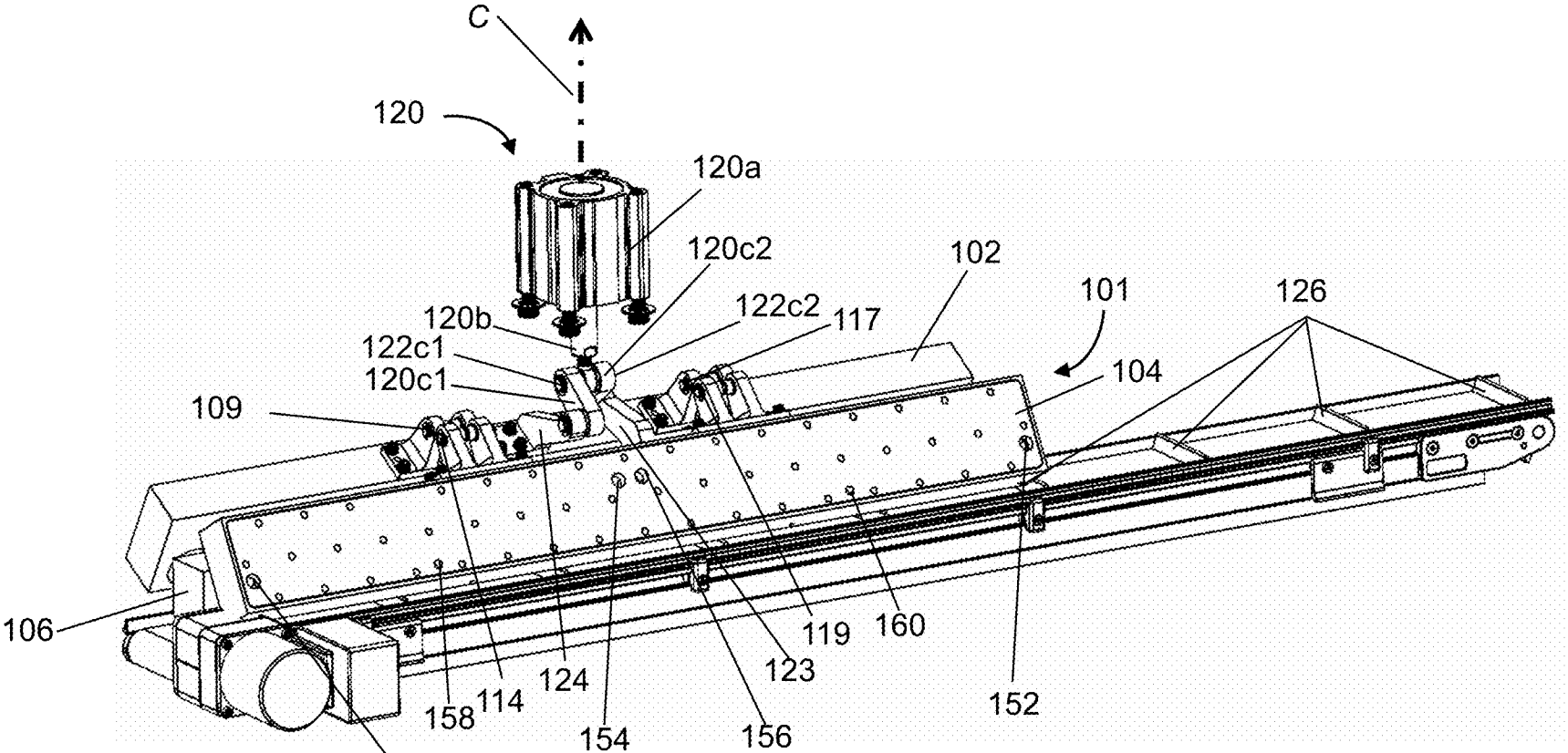

FIG. 1F illustrates a partial perspective view of the device 100 for shaping ice. Here, the support surface 118, the support structure 108, and the support frame 112 have been removed for clarity in viewing portions of the positioning means 120 and mechanisms coupled to the positioning means 120. The positioning means 120 shown here includes an air cylinder 120*a*. The air cylinder 120*a* is coupled to a pin or bolt 120*b*. The bolt 120*b* is coupled to a tie bar 120*c*1 on a first side and to tie bar 120*c*2 on a second side, opposite the first side. The tie bar 120*c*1 is coupled at a pivot point 122*c*1 to a support arm 123 that is coupled to (or molded as part of) the second clamshell part 104. The tie bar 120*c*2 is coupled at a pivot point 122*c*2 to a support arm 123 that is coupled to (or molded as part of) the first clamshell part 102. In operation, the air cylinder 120*a* may be caused to move to engage the tie bars 120*c*1, 120*c*2 to move about the respective pivot points 122*c*1, 122*c*2, which may move the pivot points 122*c*1, 122*c*2 away from the centerline C while causing part 102 and part 104 to move about the pivot points 109, 114, 117, 119. For example, the parts 102, 104 may hinge/move to surround and compress the ice ingot 106 when the air cylinder 120*a* provides a signal to raise the bolt 120*b*. Similarly, the parts 102, 104 may hinge/move away from the ice ingot 106 at angles described herein when the air cylinder 120*a* provides a signal to lower the bolt 120*b*.

The positioning means 211 is depicted here as an air cylinder, pin, and tie rod system. However, one skilled in the art would contemplate other systems for the positioning means 211 including, but not limited to one or more pneumatic, hydraulic or linear motor/actuators and/or bearings/rail systems that may function to shuttle the carriage 210 (coupled to the first mold housing 202) toward and/or away from the second mold housing 204. Referring again to FIG. 1F, the first clamshell part 102 and the second clamshell part 104 each include at least one fluid inlet and at least one fluid outlet.

A number of fluid inlets and outlets (with or without valving) will be described with respect to the second clamshell part 104, however, each clamshell part 102, 104 described herein includes a similar or substantially the same set of fluid inlets and outlets (and/or valving). For example, the device 100 includes at least one fluid inlet valve (e.g., inlet valve 150 and/or inlet valve 152) for each of the first clamshell part 102 and the second clamshell part 104. In some embodiments, the inlet valve 150 is not a valve, but instead is a direct inlet. In some embodiments, the inlet valve 152 is not a valve, but instead is a direct inlet. The device 100 also includes at least one outlet or outlet valve (e.g., outlet valve 154, outlet valve 156) to allow water circulating from inlet valves 150, 152 through parts 102, 104 to drain. In some embodiments, the inlet valves 150, 152 may receive heated fluid (e.g., water) into one or more layers of parts 102, 104, as described elsewhere herein. In some embodiments, the outlet valves 154, 156 may receive fluid (e.g., water) that has been cooled within or near one or more channels of parts 102, 104 during an ice shaping process. In some embodiments, additional mold cavity pressure relief outlets (e.g., relief outlets 158, 160) may be included in each of parts 102, 104 to provide pressure relief from built up water and/or air within the channels of parts 102, 104.

Figure 2A:
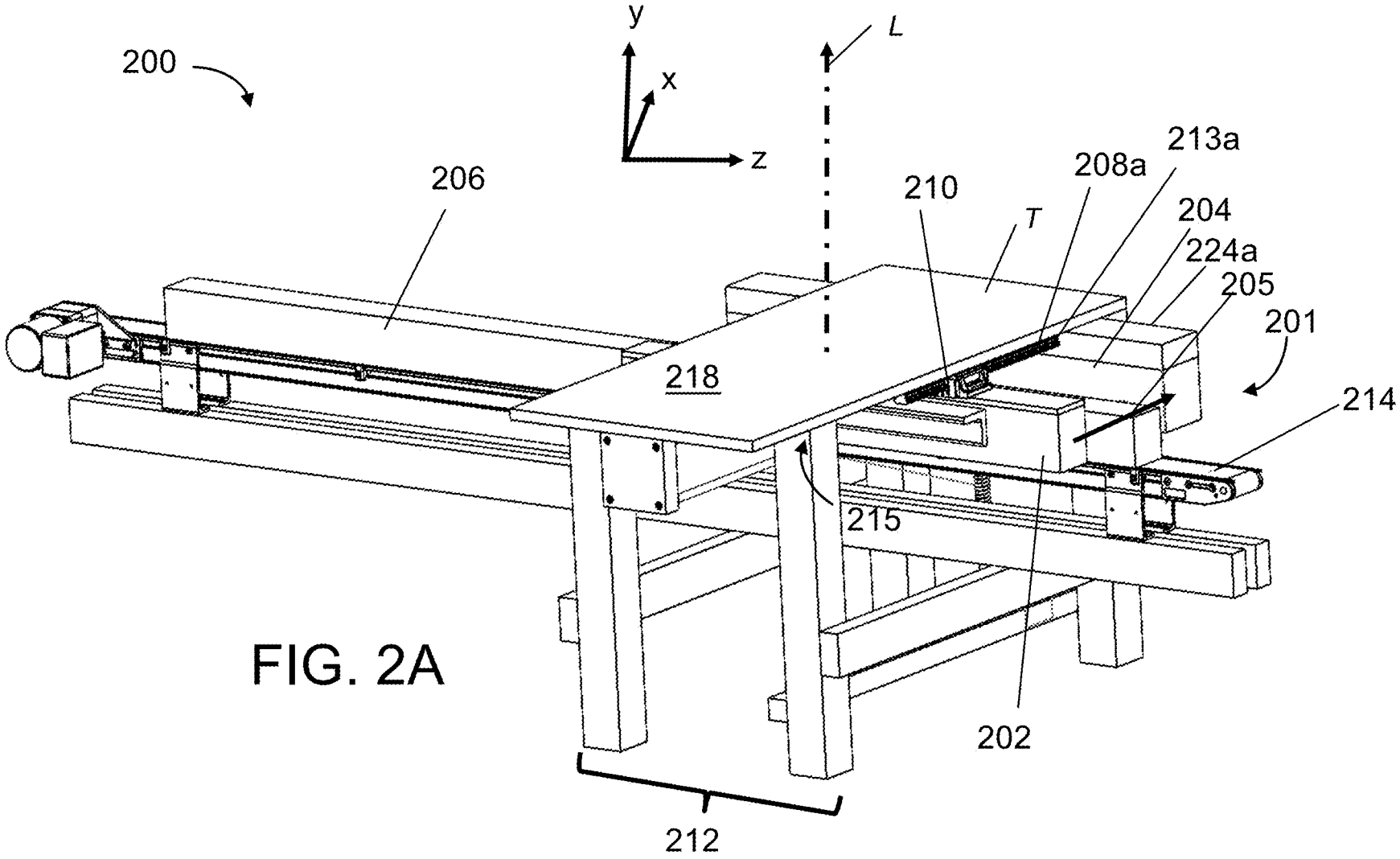
FIGS. 2A-2C illustrate an example device for shaping ice ingots.
Figure 2B:
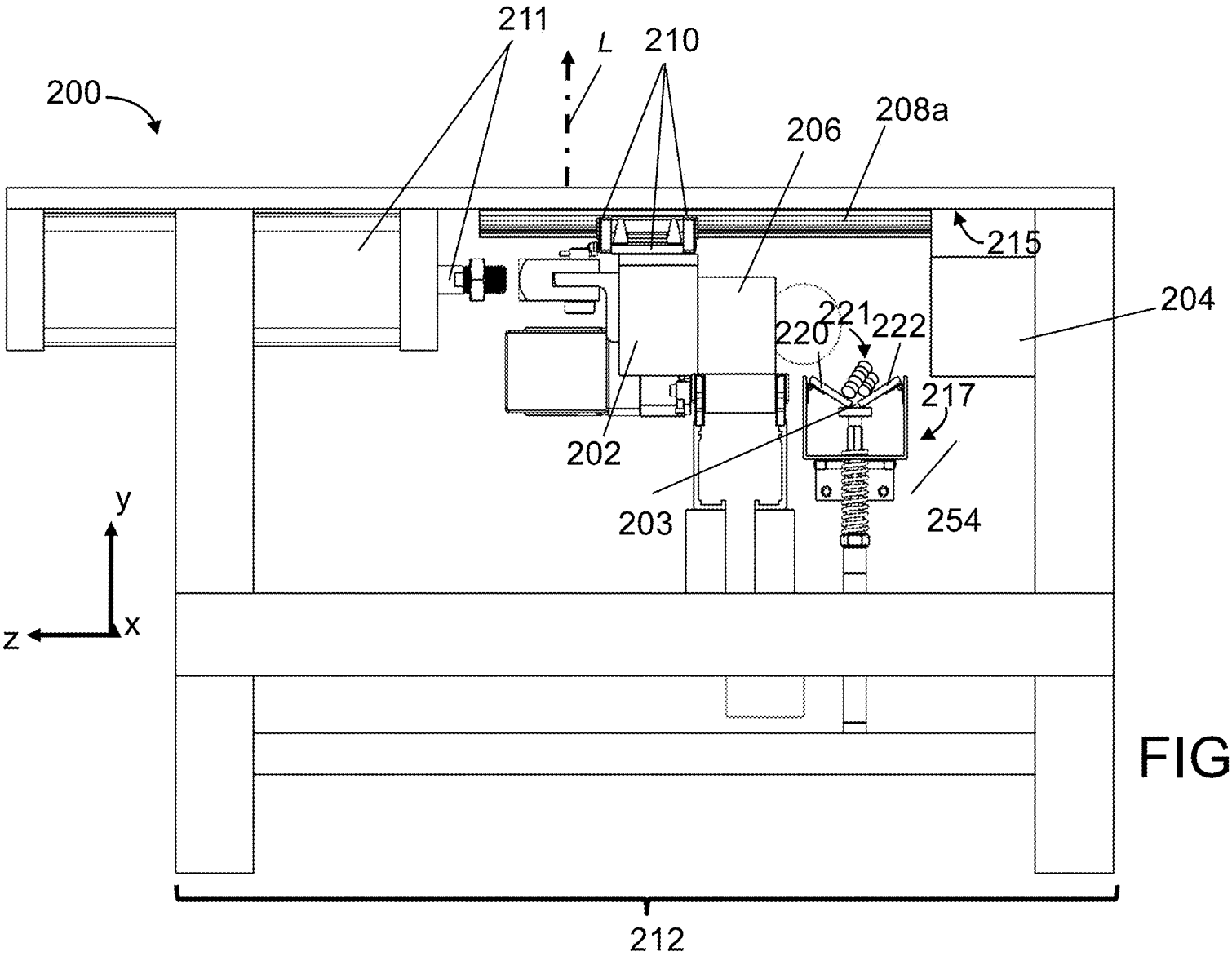
Figure 2C:
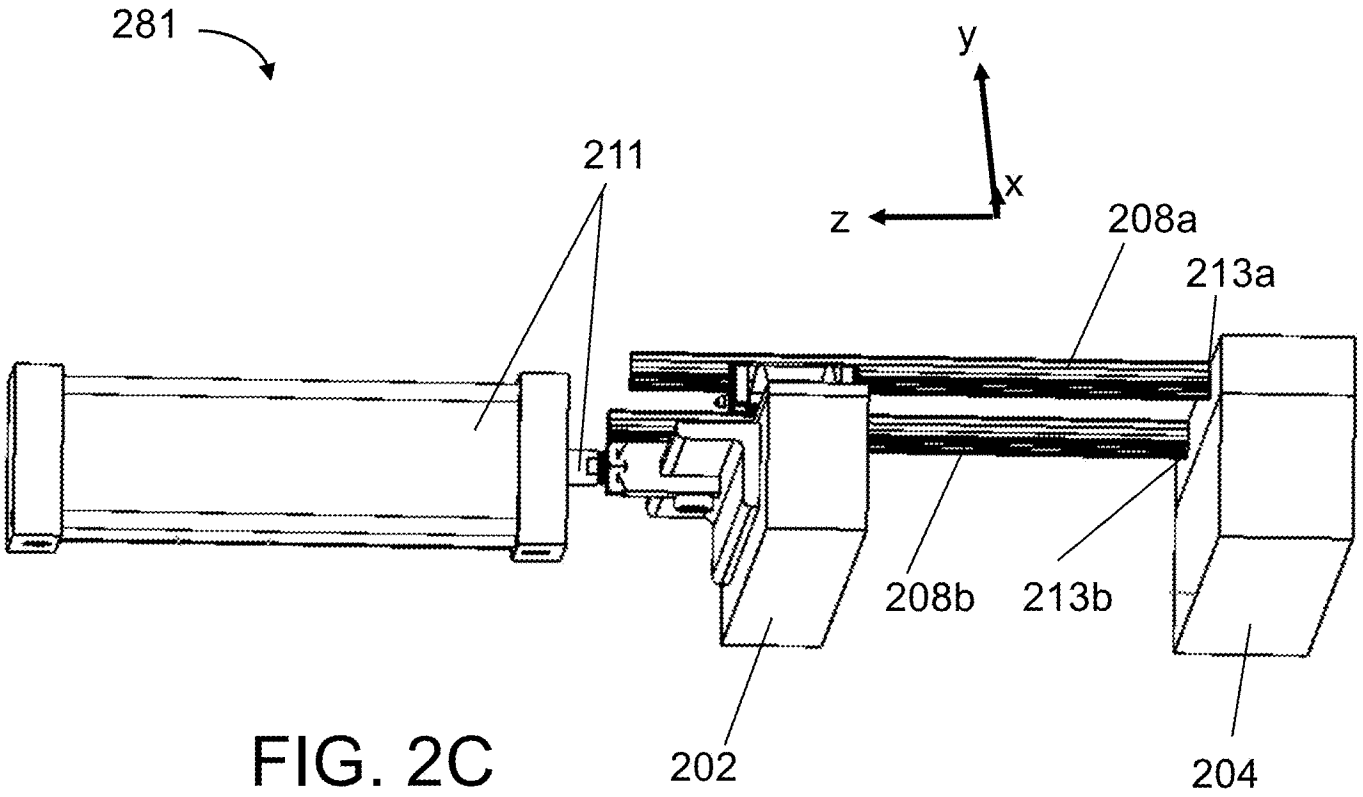

FIGS. 2A-2C illustrate an example device 200 for shaping an ingot of ice. The device 200 represents an ice shaping apparatus that may receive an elongate ice ingot and perform heating and/or cooling steps to shape the received elongate ice ingot into many distinct and separate ice shapes (e.g., structures). The shape may be dependent on a selected and/or installable mold 201 that includes one or more, or a number of cavities, each of a particular shape. In general, the device 200 may employ subtractive manufacturing techniques to shape ice products. In particular, the device 200 may use one or more mold housings to generate one or more (or multiple) ice shapes at a time by heating portions of the mold housings to eventually exchange heat from the portions of the mold housings to the shaped mold cavities which may transfer the heat to an ice ingot to melt away unwanted ice portions and subsequently shape and mold ice structures within the cavities.

At a high level, the device 200 includes a support frame 212, a first ice mold housing 202, a second ice mold housing 204, and a processing conveyor 214 to provide an ice ingot 206 to the ice mold housings 202, 204. In some embodiments, a computing station (not shown) is also communicatively connected to device 200 to, for example, receive commands to operate the device 200.

As shown in FIG. 2A, the device 200 includes a mold 201 for shaping ice ingots. The mold 201 may be formed by a first mold housing 202 and a second mold housing 204. The first mold housing 202 may be movably coupled to at least one guide rail 208*a* (e.g., linear rail) and/or guide rail 208*b* (FIG. 2C). For example, the first mold housing 202 may be moved (e.g., via sliding motion) along the guide rail 208*a* and/or guide rail 208*b* toward (e.g., arrow 205) the second mold housing 204 and away from the second mold housing 204 to allow device 200 to generate and harvest ice structures. The first mold housing 202 and the second mold housing 204 are substantially perpendicular to a longitudinal plane L of the device 200. The longitudinal plane L is a plane in the y-axis, as shown in FIG. 2A.

The second mold housing 204 may be fixedly coupled to the support frame 212 on a sidewall 204*s* of the housing 204. The housing 204 may also be fixedly coupled to an end portion 213*a* of a guide rail 208*a*. In addition, if a second guide rail 208*b* (FIG. 2C) is utilized, the housing 204 may also be fixedly coupled to the second guide rail 208*b* at an end portion 213*b* of the second guide rail 208*b*. In some embodiments, the second mold housing 204 may instead be movably coupled to the at least one guide rail 208*a*. In such examples, the second mold housing 204 may move along the guide rail toward the first mold housing 202 to, for example, provide a tension force on a first side of the ice ingot 206 while the first mold housing 202 provides an equal and opposite tension force from a second and opposite side of the ice ingot 206. The second mold housing 204 may also move away from the first mold housing 202 to release formed/shaped ice structures from cavities formed when housings 202 is placed in contact with housing 204.

The mold 201 may be installed on portions of a support structure (e.g., support frame 212). For example, the ice mold housing 204 may be fixedly coupled to a portion of surface 215 of a support table 218. The ice mold housing 204 may be coupled to a slideable carriage 210 functioning with a positioning means 211 (see, e.g., FIG. 2B, FIG. 2C) to slide the housing 204 on the guide rail 208*a* and/or guide rail 208*b*. In some embodiments, the carriage 210 may allow the ice mold housing 202 to horizontally traverse along the guide rail 208*a* and/or guide rail 208*b*.

The guide rails 208*a*, 208*b* may be installed in a transverse plane T that is substantially perpendicular to the longitudinal plane L. In particular, the guide rails 208*a*, 208*b* may be fixedly attached to the surface 215 of the support table 218 of the support frame 212. The guide rails 208*a*, 208*b* may be coupled to the positioning means 211. The positioning means 211 may be configured to enable a horizontal/lateral movement (e.g., shown by arrow 205) of the first mold housing 202 until the surface 106*b* of the first mold housing 202 contacts the surface of sidewall 104*a* of the second mold housing 204 (see FIG. 3A for surfaces). The surfaces 106*a* and 106*b* are substantially perpendicular to a bottom surface 106*d* of ice ingot 206.

The positioning means 211 is depicted here as an air cylinder, pin, and tie rod system. However, one skilled in the art would contemplate other systems for the positioning means 211 including, but not limited to one or more pneumatic, hydraulic or linear motor/actuators and/or bearings/rail systems that may function to shuttle the carriage 210 (coupled to the first mold housing 202) toward and/or away from the second mold housing 204.

For example, the first mold housing 202 may be placed adjacent to the second mold housing 204 when the carriage 210 is moved along guide rails 208*a*, 208*b* (e.g., horizontally along arrow 205). The movement may function to surround the elongate ice ingot 206 on a first side and a second side, opposite the first side, while moving the carriage 210 (and thus moving the mold housing 202) toward the mold housing 204. The movement may continue intermittently or continually as the ingot 206 is formed into the mold cavities of mold 201 (i.e., cavities of the first mold housing 202 and the second mold housing 204) until reaching physical contact between the two mold housings 202, 204 to eventually mold (e.g., shape) ice ingot 206 into a plurality of ice structures in the shape of the mold cavities (not shown) defined by mold 201.

While two mold housings are shown for mold 201, any number of mold housings may be fitted for use with device 200. For example, the mold housing 202 may include a single housing or multiple housings coupled together. Each housing may have one or more ice cavity portions. Additionally, although all components are shown in a vertical orientation (using lateral movement between them), one of skill in the art will appreciate that the devices and systems described herein may be configured horizontally, for example such that the mold portions move vertically towards one another to process the input elongate ice ingot.

Each mold housing 202 and mold housing 204 includes a plurality of fluid inlets (e.g., fluid inlets 439, etc.) that may be fluidly connected to a source inlet 414 (see FIG. 4B and/or FIG. 4D). Each fluid inlet 439, etc. may allow the flow of fluid (e.g., water) through at least one channel associated with the first mold housing 202 or associated with the second mold housing 204. In some embodiments, each fluid inlet 439 connects at least one channel (e.g., channels 432*a*, 432*b*, etc.) within a mold housing may have an inlet that provides flow of fluid from the source inlet 414 to the respective fluid inlet 439 and through to the respective fluidly connected channel. The fluid flowing through the channels of the mold housings 202, 204 may be water heated and maintained at a temperature from about 37 degrees Celsius to about 98 (e.g., about 100 degrees Fahrenheit to about 210 degrees Fahrenheit); about 37 degrees Celsius to about 47 degrees Celsius; about 45 degrees Celsius to about 55 degrees Celsius; about 50 degrees Celsius to about 60 degrees Celsius; about 57 degrees Celsius to about 70 degrees Celsius; about 65 degrees Celsius to about 80 degrees Celsius; about 75 degrees Celsius to about 90 degrees Celsius; about 80 degrees Celsius to about 98 degrees Celsius.

In some embodiments, device 200 is coupled to one or more fluid pumps to circulate fluid throughout channels (e.g., cavities, pathways, or the like) associated with mold housing 202, 204, for example. In particular, embodiments where device 200 includes mold housings that enclose a plurality of internal cooling channels, various numbers, arrangements, placements, and fluid connectivities of internal cooling cavities, valves, fluid intakes, and/or fluid outtakes, may be used with (or installed within) device 200 without deviating from the scope of this disclosure. One of skill in the art will appreciate that the heat transfer fluid circulation system can include any number of pumps, compressors, evaporators, etc. to provide a sufficient circulation of water, coolant, or other fluid to shape ice structures from ice ingot 206.

FIG. 2B illustrates a side view of the device 200 for shaping the elongated ingot of ice 206 and receiving ice structures generated by the mold 201 during a shaping/molding process. Here, the device 200 additionally includes a trap door assembly 217. The trap door assembly 217 includes a first plate 220 and a second plate 222. The first plate 220 is hingedly coupled to a first or left side of a cradle assembly 254. Similarly, the second plate 222 is hingedly coupled to a second or right side of the cradle assembly 254. The position of the trap door assembly 217 may change before, during, and/or after ice shaping to assist in harvesting of ice structures. For example, when ice structures (not shown) have been formed, mold 201 may be opened to reveal and drop formed ice structures 221 onto and/or through an opening 203 at least partially defined by the trap door assembly 217. While the depicted trap door assembly 217 uses two plates 220, 222, any number of trap doors may be contemplated. For example, alternative trap door designs may include a single plate that may be tilted to provide a ramped exit for ice structures 221 received from the mold 201. In another example, three, four, five, or six plates may be included as a trap door assembly 217. The three, four, five or six plates may be moved to provide off ramping of ice structures 221. In some embodiments, the three, four, five, or six plates may be angled toward a central location to form an aperture for the ice structures to collect and/or drop through.

FIG. 2C illustrates a bottom perspective view of an example guide rail system 281 installable in device 200. The guide rail system 281 includes at least a guide rail 208*a*, a guide rail 208*b*, positioning means 211, the mold housing 202, and the mold housing 204. As shown, the guide rail 208*a* and guide rail 208*b* may each be moveably coupled to the mold housing 202 to allow for substantially lateral movement to slide along the guide rails 208*a*, 208*b* and contact mold housing 202 to mold housing 204. The positioning means 211 may cause such movements based at least in part on signals and/or programming received from one or more processors and/or microcontrollers, PLCs, or the like, as described throughout this disclosure.

Figure 3A:
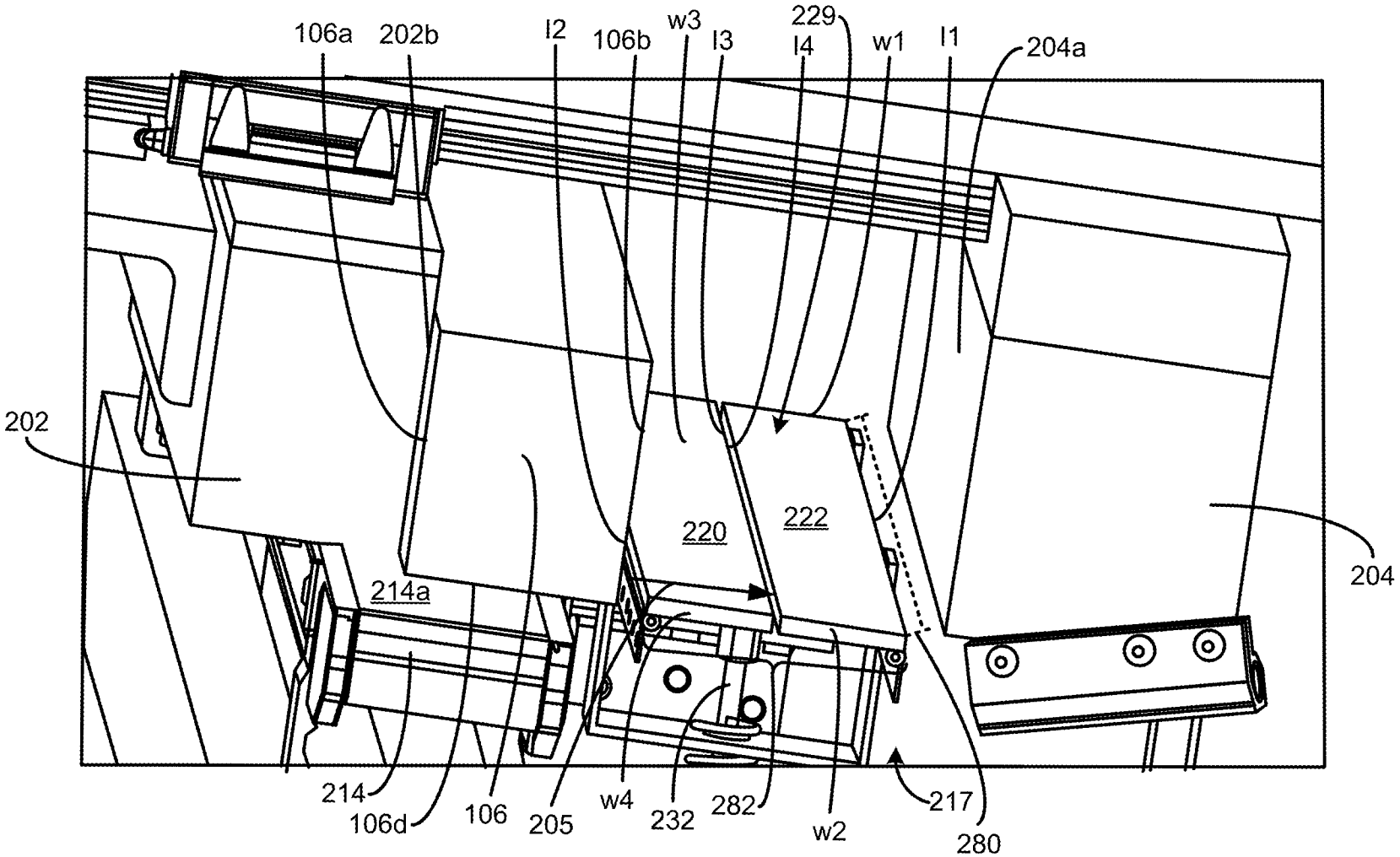
FIG. 3A illustrates a front view of an example device assembly for shaping an elongated ingot of ice.

FIG. 3A illustrates a front view of a portion of the example device 200 (i.e., device assembly) for shaping an elongated ingot of ice. A trap door assembly 217 is depicted in a preliminary configuration before the device 200 begins to generate shaped ice structures from the ingot 206. That is, the preliminary configuration may include ice ingot 206 and mold housing 202, 204 locations before the process of shaped ice formation begins and before the device 200 begins to form the cavities of mold 201 by pressing the ice ingot 206 between the first mold housing 202 and the second mold housing 204. For example, the positioning means is configured to enable a horizontal movement of the first mold housing until the first side surface of the elongate ice ingot is in contact with the first mold portion and the second side surface of the elongate ice ingot is in contact with the second mold portion. The positioning means (e.g., positioning means 211) may maintain a constant force on the elongate ice ingot 206 to ensure that melting and ice shaping continues until completion of the ice shaping process.

In the preliminary configuration shown in FIG. 3A, the trap door assembly 217 includes a first plate 220 and a second plate 222. Each plate is substantially rectangular, (however any shape is envisioned) and includes widthwise sides (e.g., widthwise sides/edges w1, w2, w3, w4) and lengthwise sides (e.g., lengthwise side l1, l2, l3, l4). The first plate 220 is hingedly coupled to the cradle assembly 254 on a lengthwise side l2. Similarly, the second plate 222 is hingedly coupled to the cradle assembly 254 on a lengthwise side l1. Proximal to the widthwise edge w2 of the trap door assembly 217, the plates 220, 222 are coupled to a linear actuator 232. The position of the trap door assembly 217 may change before, during, and/or after ice shaping to assist in harvesting (e.g., removal) of ice structures from the device 200, as will be described throughout this disclosure. For example, the trap door assembly 217 may be triggered by the linear actuator 232 to cause the first hingedly coupled plate 220 and the second hingedly coupled plate 222 to hinge from an initial configuration (e.g., shown in FIG. 3A) into a harvesting configuration (shown in FIG. 3C) during or upon completion of an ice shaping process of device 200. The initial configuration may include having the first hingedly coupled plate 220 and the second hingedly coupled plate 222 aligned substantially normal to the longitudinal plane L of the device 200. The harvesting configuration may include having the first hingedly coupled plate 220 and the second hingedly coupled plate 222 positioned in an acute angle to the longitudinal plane L of the device 200 to form a slot 243 (or trough) between the first hingedly coupled plate 220 and the second hingedly coupled plate 222. In some embodiments, the acute angle of the first hingedly coupled plate 220 may be from about 1 degree to about 45 degrees and the lengthwise side l2 remains hinged while the lengthwise side l3 drops about negative 1 degree to about negative 45 degrees. Similarly, the lengthwise side l1 remains hinged while the lengthwise side l4 drops about negative 1 degree to about negative 45 degrees.

In some embodiments, the angle of the first hingedly coupled plate 220 may be from about 1 degree to about 90 degrees and the lengthwise side l2 remains hinged while the lengthwise side l3 drops about negative 1 degree to about negative 90 degrees. Similarly, the lengthwise side l1 remains hinged while the lengthwise side l4 drops about negative 1 degree to about negative 90 degrees. In such examples, the trap door 217 may form an opening to allow ice structures to be released from mold housings 202, 204 and through the opening formed by the angled plates 220, 222.

In some embodiments, a length 280 of the trap door assembly 217 may substantially match a length of the ice ingot 206. In some embodiments, the length 280 of the trap door assembly 217 may be about 0.5 meters to 1.5 meters; about 0.75 meters to about 1.25 meters; about 0.875 meters to about 1.225 meters; etc. A width 282 of the trap door assembly may be about 2 centimeters to about 16 centimeters; about 4 centimeters to about 14 centimeters; about 6 centimeters to about 12 centimeters; about 8 centimeters to about 10 centimeters.

In operation of device 200, the processing conveyor 214 may position the ice ingot 206 into an ice shaping configuration between the first mold housing 202 and the second mold housing 204 to begin pressing the ice ingot 206. For example, when a first surface 202*b* of the first mold housing 202 is placed into contact with a first surface 106*a* of the ice ingot 106 and a second surface of the ice ingot 106*b* is placed into contact with a second surface of sidewall 204*a* of the second mold housing 204, the device 200 may be in the ice shaping configuration and may begin shaping ice by pressing the first mold housing 202 toward the second mold housing 204, as shown by arrow 205 in FIG. 2A.

In some embodiments, the positioning means (positioning means 211 in FIG. 2C) may perform such pressing and substantially lateral or left to right (or right to left) movements (along x-axis shown in FIG. 2A) and may be configured to dispose the first surface 202*a* of the first mold housing 202 against a first side surface 106*a* of the elongate ice ingot 106 and a second surface of sidewall 204*a* of the second mold housing 204 against a second side surface 106*b* of the elongate ice ingot 106. The first side surface 106*a* of the elongate ice ingot 106 is opposite the second side surface 106*b* of the elongate ice ingot 106.

Referring again to FIG. 3A, a top surface 214*a* of the processing conveyor 214, of which the ice ingot 106 is actuated upon, may be approximately flush with a top surface 229 of the trap door assembly 217, when the plates 220, 222 are held up by the linear actuator 232. Configured in this way, the trap door assembly 217 may function as a surface for the ice ingot 106 to be held and/or moved across when the first mold housing 202 is moved (as shown by arrow 205 in FIG. 2A and as shown by the location of ice ingot 206 in FIG. 3B).

Figure 3B:
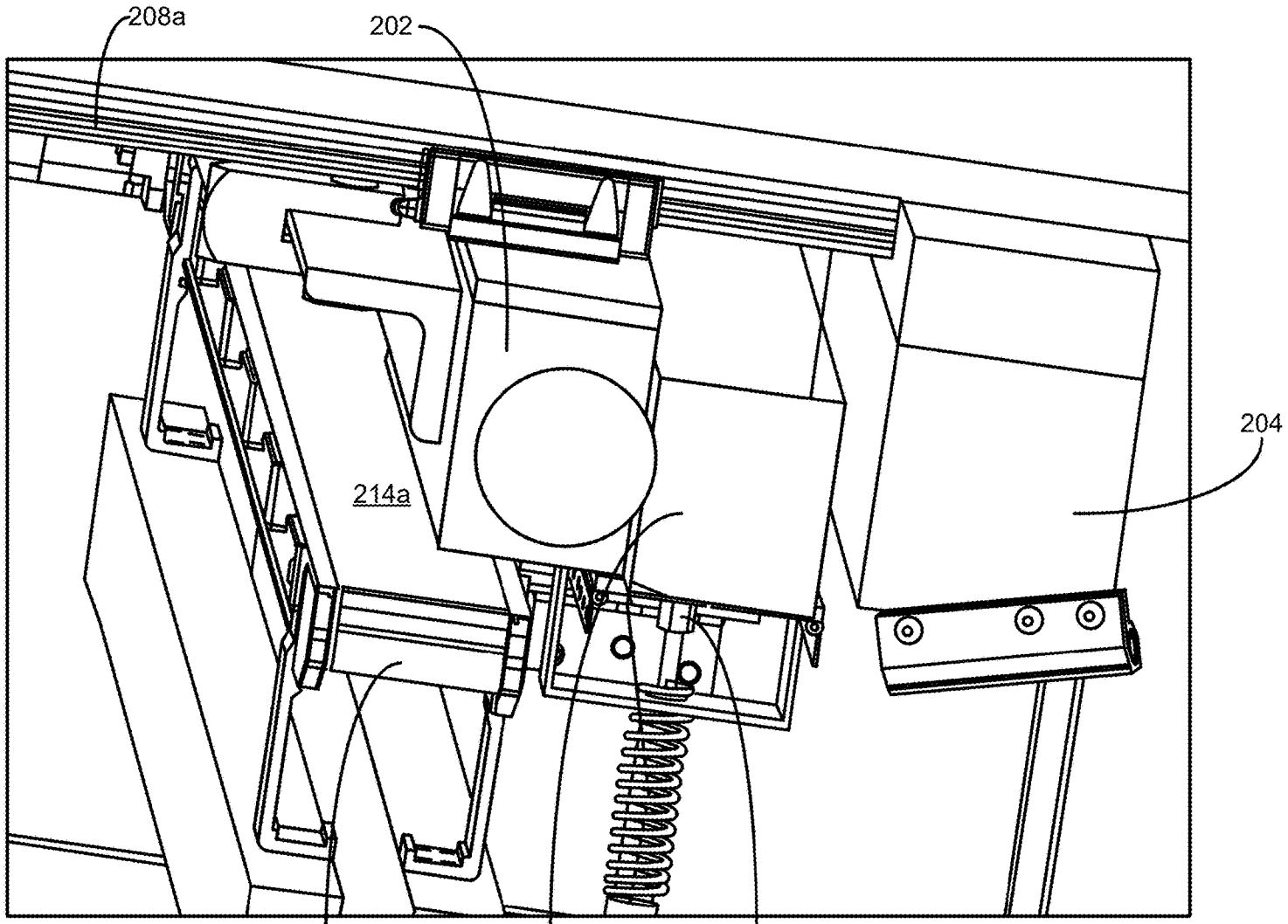
FIG. 3B illustrates a perspective view of an example device assembly with an elongated ingot of ice being pressed toward a second mold housing.

FIG. 3B illustrates a perspective view of an example device assembly with the elongated ingot of ice 106 being pressed toward (e.g., see arrow 205 in FIG. 3A) the second mold housing 204. In this example, the first mold housing 202 is actuated along guide rail 208*a* and/or guide rail 208*b* (FIG. 2C) to engage elongate ice ingot 106 and begin to push the ice ingot into the second mold housing 202 to begin ice formation. Upon completion of forming the ice structures, the trap door assembly 217 may function to capture, handle, and/or convey the formed ice structures from the mold cavities of mold housings 202, 204 and to another location including, but not limited to, one or more conveyors, bins, boxes, tables, cavities, or the like. For example, the formed/produced ice structures may drop from the first mold housing 202 and second mold housing 204 due to gravity or may roll from the trap door assembly 217 onto a conveyor or table or into a bin, box, cavity and the like. The trap door assembly 217 may be configured to catch the produced ice structures.

Figure 3C:
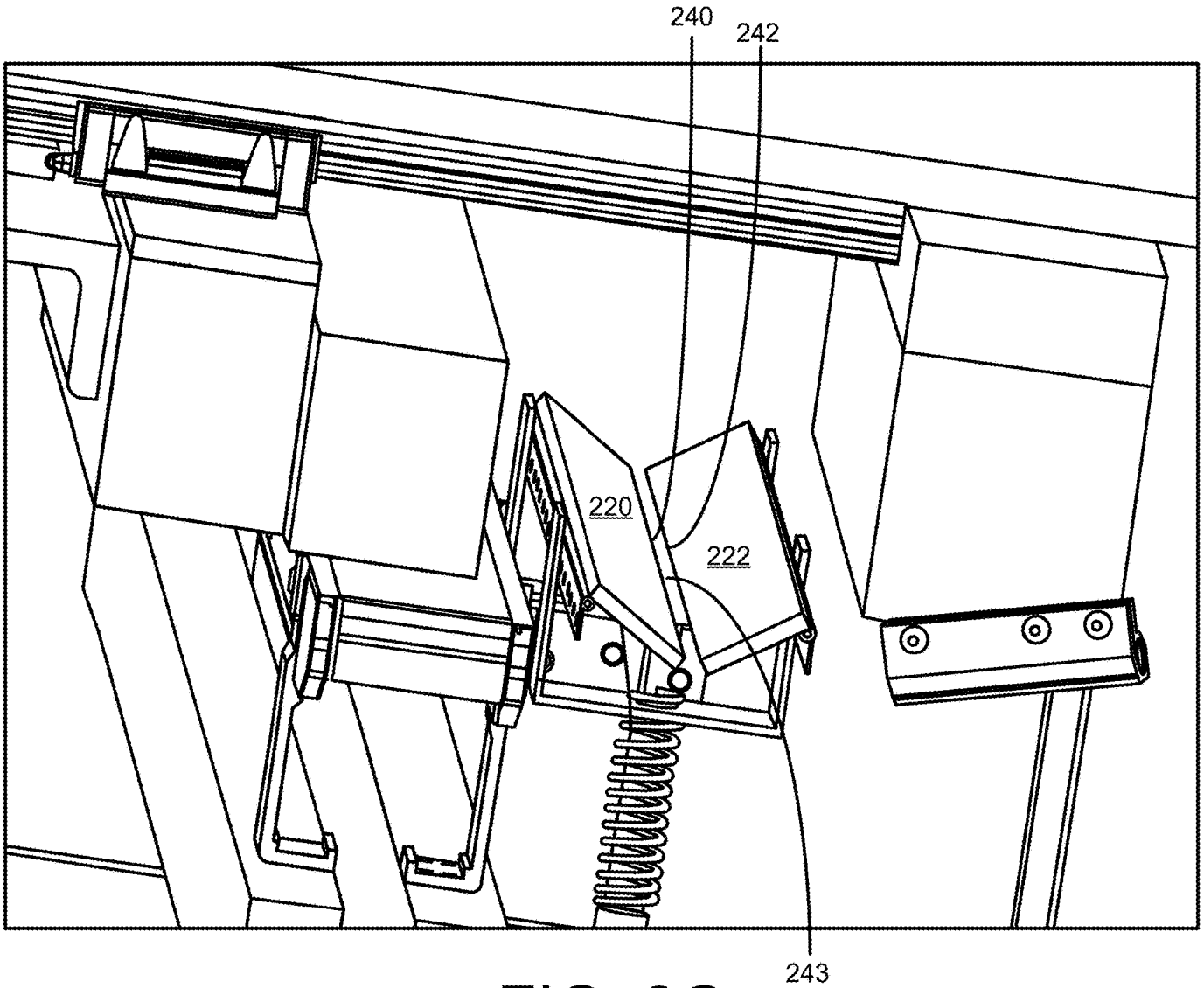
FIG. 3C illustrates atop perspective view of an example device assembly for capturing produced ice structures.

FIG. 3C illustrates a top perspective view of the example device 200 for capturing produced ice structures. In this example, the linear actuator 232 may contract and lower an inner lengthwise edge 240 of plate 220 and an inner lengthwise edge 242 of plate 222. Lowering the inner lengthwise edges 240, 242 of the plates 220, 222 may form a trough/slot 243 defined by the trap door assembly 217 (i.e., from plate 220 and plate 222). The trap door assembly 217 may catch the ice structures within the trough/slot 243 as the formed ice structures exit the first mold housing 202 and/or the second mold housing 204. In other words, the V-shape or angled shape made by the plates 220, 222 restricts the ice structures within them to avoid spillage or loss of ice structures outside of the trap door assembly 217. Once the ice structures are held in the trap door assembly 217, the linear actuator 232 may then continue to contract or compress as described in detail in FIGS. 3D and 3E.

Figure 3D:
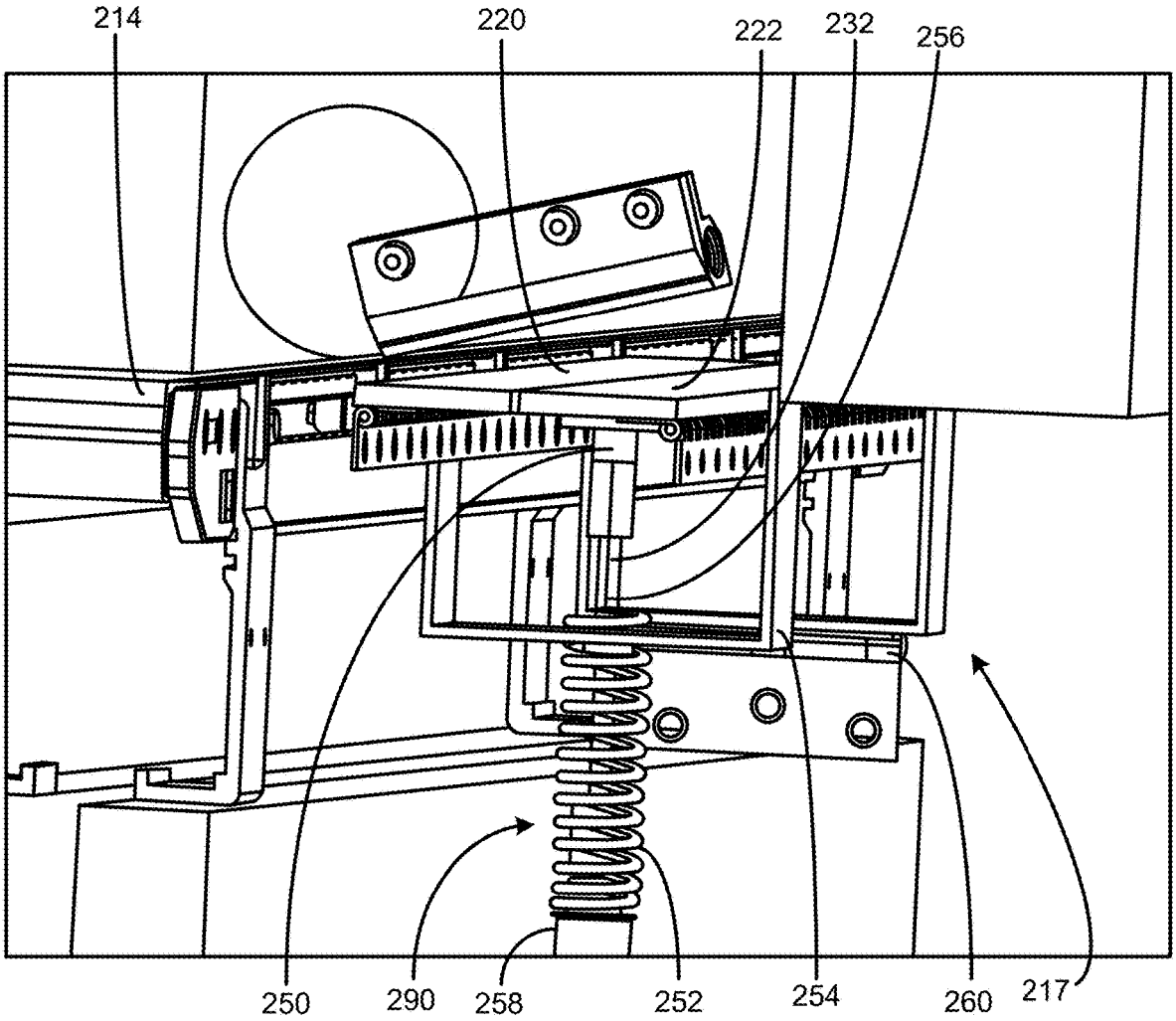
FIG. 3D illustrates a perspective view of an extended linear actuator assembly of an example device assembly.

FIG. 3D illustrates a perspective view of an extended linear actuator assembly 290 of an example device assembly. The linear actuator assembly 290 may include a linear actuator 232. The linear actuator 232 may include a static portion 258 coupled to the support frame 212, a piston 256, and an upper portion 250 in contact with the plates 220, 222. In addition, the linear actuator assembly 290 may include a compression spring 252 positioned between the static portion 258 of the linear actuator 232 and the cradle assembly 254. FIG. 3D depicts the linear actuator 232 in an extended or fully-extended configuration holding the plate 220 substantially adjacent and substantially parallel to the plate 222 and approximately flush with the top surface 214*a* of the conveyor 214. As illustrated, an upper portion 250 of the linear actuator 232 is larger in diameter than the piston 256. As such, the piston 256 may pass through an aperture defined by the cradle assembly 254 during contraction, while the upper portion 250 cannot pass through the cradle assembly 254 during contraction of the linear actuator 232. The cradle assembly 254 is coupled to the static portion 258 of the linear actuator 232 by a compression spring 252. The compression spring 252 may have an appropriate spring rate and pre-compression as to hold the trap door assembly 217 in a static position at the point at which the plates 220, 222 are flush with the top surface 214*a* of the conveyor 214. This may allow the ice ingot 106 to slide across the plates 220, 222 unencumbered. When the linear actuator 232 retracts to lower the plates 220, 222 into the V-shape or angled shape to form the trough/slot 243, as previously described, the cradle assembly 254, supported by the compression spring 252, retains the position of the trap door assembly 217. The spring rate and pre-compression of the compression spring 252 may be sufficient as to hold the trap door assembly 217 in place even while holding the produced ice structures on the trap door assembly 217. In some embodiments, it may be beneficial to roll the produced ice structures from the trap door assembly 217. Rolling the ice structures from the trap door assembly 217 may be accomplished by continued contraction of the linear actuator 232. Such continued contraction may cause the trap door to tilt to raise the widthwise edge w1, which may lower the widthwise edge w2 because widthwise edge w1 is opposite widthwise edge w2. The trap door assembly 217 (e.g., plates 220, 222) may be formed from and/or coated with one or more thermally insulating materials or materials with low thermal conductivity, such as high-density polyethylene (HDPE), expanded polystyrene (EPS), Ultra High Molecular Weight (UHMW) Polyethylene, Syneffex™, or the like.

Figure 3E:
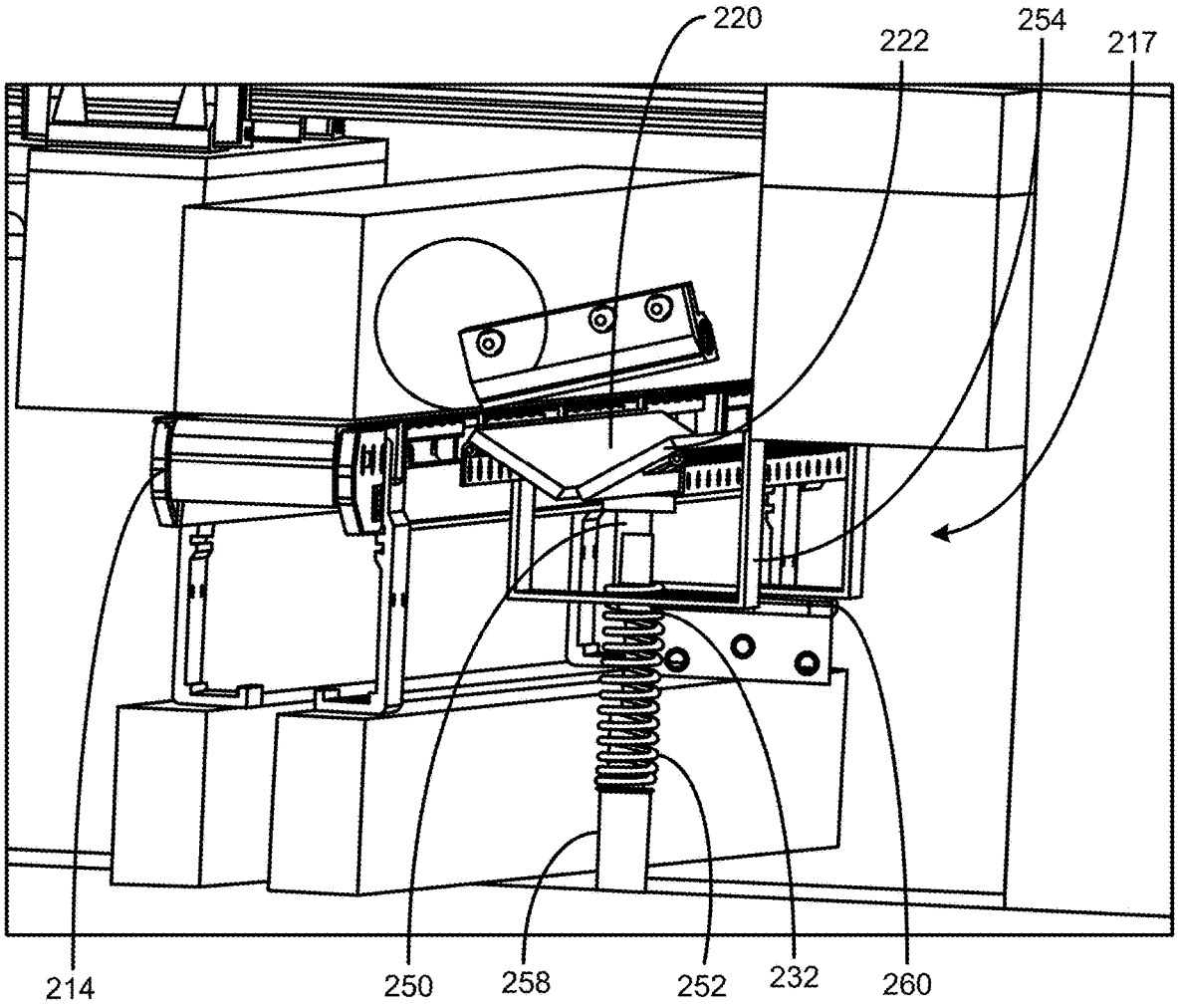
FIG. 3E illustrates a perspective view of a contracted linear actuator assembly of an example device assembly.

FIG. 3E illustrates a perspective view of a contracted linear actuator 232 of the example device assembly 200. As shown, once the upper portion 250 of the linear actuator 232 contacts the cradle assembly 254, compression of the compression spring 252 occurs. Compression of the compression spring 252 allows the linear actuator 232 to continue to contract but instead of continuing to lower the inner lengthwise edges 240, 242 (shown in FIG. 2C) of the plates 220, 222, the cradle assembly 254 begins to lower towards the static portion 258 of the linear actuator 232. With another point of the trap door assembly 217 hingedly coupled to the support frame 212, shown in FIG. 3E at hinge 260, lowering the cradle assembly 254 may cause the trap door assembly 217 to raise the widthwise side w1 which may lower the widthwise edge w2 of the trap door assembly 217. Due to gravity effects, tilting the trap door assembly 217 in this way may cause the ice structures to roll off the trap door assembly 217 toward widthwise side 282.

At the point that ice structures roll off the trap door assembly 217, auxiliary machinery or elements may be introduced for further conveyance of the produced ice structures. For example, the ice structures may land on a track that continues to transfer the ice structures due to gravitational effects. Alternatively, or additionally, the ice structures may land on another conveyor belt that transfers them to a further destination. Alternatively, or additionally, the ice structures may land in a bin, a carton, a box, or other packaging, or a combination of the forementioned may occur.

Figure 3F:
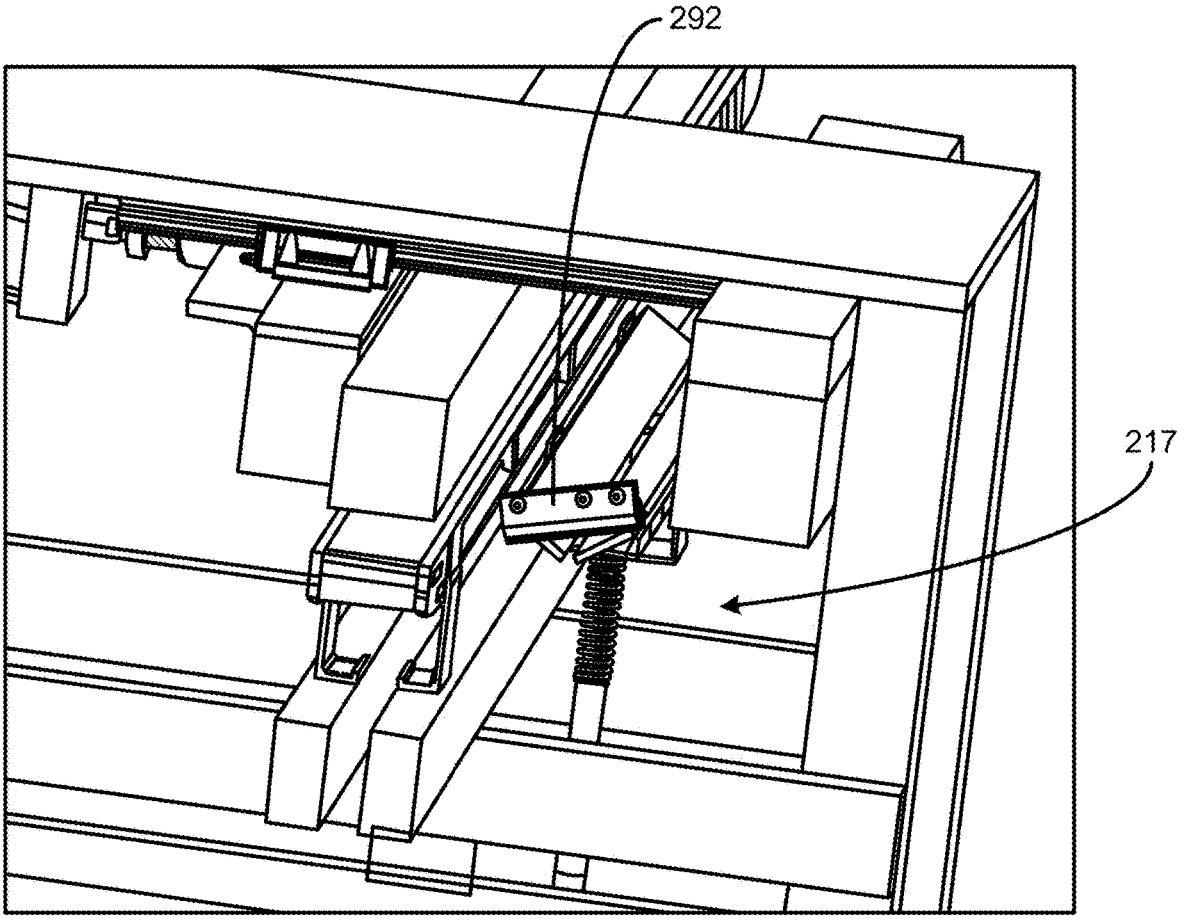
FIG. 3F illustrates a top perspective view of an air knife installed in an example device assembly.

FIG. 3F illustrates a top perspective view of an air knife 292 installed in an example device assembly. In general, the device 200 may include one or more air knives, such as air knife 292 to remove residual water from formed ice structures (e.g., cube shaped ice structures, polyhedron shaped ice structures, sphere shaped ice structures, heart shaped ice structures, diamond shaped ice structures, clover shaped ice structures, or the like). For example, when the ice structures exit the trap door assembly 217, one or more air knives 292 may be triggered to blow air across (e.g., over one or more surfaces of) the ice structures to remove residual water from the one or more surfaces of the ice structures.

One or more air knives may be positioned proximal to a location in which the formed ice structures exit the first and second mold housings 202, 204 and/or trap door assembly 217. For example, the air knife 292 is positioned to provide air to the first mold housing 202 and the second mold housing 204 during release of the ice structures from the cavities of the housings 202, 204. When supplied with compressed air, the air knife 292 may generate a high-velocity air curtain that the rolling ice structures pass through while entering, passing through, and/or exiting the trap door assembly 217. When the ice structures roll/pass through the air curtain generated by the air knife 292, residual water may be blown from one or more surfaces of the ice structures thereby removing the fluid from the ice surface(s) and, in some instances, eliminating the chance of freezing the fluid water back onto the ice structures. Freezing the residual fluid water (e.g., from the melting process) to the ice structures may reduce the quality of the produced ice structure shape and, therefore, may be undesirable. The example placement of the air knife 292 is shown directly above the exiting ice structures, but one or more air knives may, alternatively or additionally, be placed adjacent to or at an angle such that directed air from the one or more air knives may be directed at or across at least one surface of the exiting (e.g., rolling, sliding, dropping, expelling) ice structures. In some embodiments, two or more air knives may be used to remove fluid water from the ice surfaces of the ice structures. In some embodiments, compressed (and dry) air may also or alternatively be applied to or through one or more apertures of a rear surface (e.g., surface 460 in FIG. 5C) of each mold housing 402, 404 to assist in removal of ice structures from the mold cavities.

FIG. 4A illustrates a side view of an example two-part ice mold assembly 400 (e.g., mold 101, 201). The mold assembly 400 includes a first mold housing 402 (e.g., such as clamshell part 102 or mold housing 202) and a second mold housing 404 (e.g., such as clamshell part 104 or mold housing 204). The mold housings 402, 404 have a length A, which may be about 0.5 meters to 1.5 meters. The mold housings 402, 404 have a height B, which may be about 2.54 centimeters to about 10 centimeters. In some embodiments, the mold housings 402, 404 may be of the same height or may be of a different height. For example, if the mold cavity structures formed by placing mold housing 402 in contact with mold housing 404 are of vertically symmetrical shape, then both housings 402 and 404 may be of the same height and cavity structures within such housings 402, 404 may have substantially the same depth. However, if the shape formed by the merged mold cavity structures are not of a vertically symmetrical shape (or if there is no symmetry to the shape), the mold housings may be of a different height. Mold symmetry may be an indicator of mold dimensions; however, suitable mold dimensions may be selected based on a variety of parameters including ingot dimensions, shape of the cavity defined by the molds, support frame structure, etc.

The mold housing 402 includes at least two alignment pins 406 that may engage with respective apertures 408 on mold housing 404. The alignment pins 406 and the apertures 408 may ensure that the housing 402 aligns with housing 404 when brought together to form ice structures during a molding process. Such alignment mechanisms may ensure that the ice structures generated using molds housings 402, 404 do not have mold lines, cracks, or other defects at an intersection plane I of the mold housings 402, 404. Intersection plane I represents a plane that exists when mold housing 402 is interlocked with mold housing 402 via pins 406 sliding into apertures 408.

In some embodiments, the mold housings 402, 404 may include a number of hemispherical cavities (cavity structures 410, 412, etc.) and a multiplate manifold to feed water through an outer surface of the mold cavity structures. The multiplate manifold may include any number of layers to flow water through and/or around mold cavity structures. In the depicted example, the mold housing 402 includes a first layer 402*a* that includes a plurality of hemispherical mold cavity structures 410, 412 and routed channels (not shown) leading to the mold cavity structures; a second layer 402*b* that includes one or more chambers (not shown) for fluid (e.g., water) to flow over and/or around each outer mold cavity surface, and a third layer 402*c*, that operates as a sealing plate to seal in the fluid flowing through layer 402*b* and to enable fluid temperature to be maintained within the channels (not shown). Although three layers are shown, any number and/or depth of layers may be contemplated including at least two, three, four, five, or six layers.

The mold cavity structures 410, 412 may form a predefined shaped cavity when the first mold housing 402 is placed adjacent to and in contact with the second mold housing 404. The predefined shaped cavity forms a sphere in this example when mold cavity structures 410 are placed directly across and opposite mold cavity structures 412. Portions of an ice ingot placed between mold housing 402 and mold housing 404 may be melted to form the sphere-shaped ice structures within the cavities of combined mold cavity structures 410, 412. FIG. 4B illustrates a top down perspective view of mold assembly 400. The mold housings 402, 404 have a depth D that may be about 1.25 centimeters to about 8 centimeters. Other depths are of course possible and the housing 402 may be of a differing depth than the housing 404. In some embodiments, the mold housing 402 matches the length, width, and depth of the second mold housing 404. The mold housings 402, 404 may match in both width and length such that cavity structures 410 of the housing 402 match up with cavity structures 412 (FIG. 4C) of housing 404 when placed adjacent to form a combined mold cavity approximating one of the shapes described herein. Placing mold housing 402 adjacent to mold housing 404 may include pressing housing 402 toward housing 404 to align mold cavity structures 410, etc. with mold cavity structures 412, etc. with an ice ingot (not shown) between the housings 402, 404. Each cavity structure 410, etc., may be of width C. Width C may be about 2.54 centimeters to about 15.3 centimeters.

Each mold housing 402, 404 includes at least one source inlet 414 for receiving fluid (e.g., water) that may be cycled throughout one or more channels within the respective mold housing. Each mold housing 402, 404 includes at least one outlet 416 for discarding fluid (e.g., water) that has cycled throughout one or more channels within the respective mold housing.

For example, the first mold housing 402 may include a first set of outlets for draining the flow of fluid away from the first mold housing 402. Similarly, the second mold housing 404 may include a second set of outlets for draining the flow of fluid away from the second mold housing 402. Each mold housing 402, 404 includes a number of mold cavities and each mold cavity may include (or be associated with) one of the set of outlets.

In some embodiments, each mold cavity structure 410 may have an inlet and an outlet and each inlet and outlet may connect to source fluid inlet valve 414 and outlet 416 to allow a single source of fluid to the housing 402, for example, and a single fluid outlet for draining fluid away from housing 402. For example, the source inlet valve 414 may connect internally to an inlet at each mold cavity structure 410. Similarly, the outlet 416 may connect internally to an outlet at each mold cavity structure 410, as will be described in further detail below.

FIG. 4C illustrates a bottom up perspective view of mold assembly 400. The mold housing 404 includes a number of cavity structures 412. In general, the cavity structures 410, 412 may be configured to each house a portion of a shaped ice structure. For example, if the mold assembly 400 is for a spherically shaped ice structure, the number of cavities in the mold assembly 400 dictates the number of spherically shaped ice structures that may be formed/shaped per cycle of the mold assembly 400.

Each cavity structure 410, 412, etc., may be of width C. Width C may be about 2.54 centimeters to about 15.3 centimeters. Additional cavity structures are shown in line, but are not labeled for convenience. Although eleven cavity structures 410 and eleven cavity structures 412 are depicted in mold assembly 400, any number of cavities may be contemplated to be formed between cavity structures including, but not limited to about 2 cavities to about 40 cavities. Sphere shapes are depicted in cavities 410, 412, but other cavity shapes are of course contemplated, as described throughout this disclosure.

During an ice shaping process, the housing 402 continues to press toward housing 404 until the cavity structures 410 from housing 402 align with respective cavity structures 412 of housing 404. In such a process, the housings 402, 404 may come together to form the shapes indicated by cavities 410, 412 to form ice structures within the cavities as an elongate ice ingot is melted between housings 402, 404. FIG. 4D illustrates a perspective cross-sectional view of an example multiplate manifold 430 of mold housing 402 and/or mold housing 404. The example multiplate manifold 430 may function as a heat exchanger portion of the mold housings 402, 404 while a mold cavity structure 410*a* (and at least one mold cavity structure 412 shown in FIG. 4C) function as an ice shaping portion of the mold assembly 400. The heat exchanger portion of the mold housings 402, 404 may include the manifold 430 and any of the layers, plates, channels, inlets, outlets, and fluid in contact with any portion of the manifold 430. Heat transfer fluid (e.g., water, coolant, a mix of coolant and water, or other heat transferring fluid) may flow through the manifold 430 to heat the channels and plates/layers behind the mold cavity structures 410, 412. Heat may be thermally transferred from the manifold 430 to the mold cavity structures 410, 412 (e.g., the aperture shown by mold cavity structure 410*a*).

In general, the manifold 430 may include one or more channels 432*a*, 432*b*, 432*c*, 432*d*, 432*e*, and 432*f* that may be in thermal communication with the mold cavities 410, 412, but may not be in fluid communication with the mold cavities 410, 412. Accordingly, the fluid may heat surrounding and/or shared rear surface walls of the mold cavities 410, 412, but may not flow within or otherwise contaminate the mold cavities 410, 412 nor the ice ingot used as a basis in which to form the ice within the mold cavities 410, 412.

The example multiplate manifold 430 includes a first layer 402*a*, a second layer 402*b*, and a third layer 402*c*. The layers 402*a*-402*c* may function together to flow and feed water in and/or around one or more portions of a mold cavity, such as mold cavity structure 410*a* shown here as part of layer 402*a*.

The first layer 402*a* includes the mold cavity structure 410*a* and a number of fluid channels 432*a*, 432*b*, 432*c*, 432*d*, 432*e*, and 432*f* (e.g., channels) to flow heated fluid (e.g., water) throughout the manifold. Such flow of heated fluid may function to heat the mold housings 402, 404 and eventually melt unwanted sections of the elongate ice ingot into the ice cavities to form ice structures (e.g., ice structures 221 in FIG. 2B). Each channel 432*a*-432*f* may flow heated fluid to a plurality of outer surface portions of the mold cavity structure 410*a*. Heating the outer surface portions can transform an ice ingot that is pressed between two mold housings 402, 404 to melt and form the ice structures in the shape of the mold cavities formed by joining housings 402, 404. For example, pressing the ice ingot between the mold housing 402 and the mold housing 404 may include moving the mold housing 402 to meet the ice ingot and press the opposing side of the ice ingot against the mold housing 404. Such pressing can be performed by a linear actuator and/or motor for moving mold housing 402 along guide rails 208*a*, 208*b* to maintain tension against the ice ingot that is placed between the first mold housing 402 and the second mold housing 404. The tension may be maintained during heating (e.g., fluidly heating channels) of the first mold housing 402 and the second mold housing 402 and removed upon detecting that the first mold housing 402 and the second mold housing 404 are located a predefined distance apart. For example, as the ice ingot melts around the molds to form ice structures within cavities of the mold assembly 400, the mold housing 402 may be brought nearer to mold housing 404 during ice melt until at least a portion of housing 402 makes contact with at least a portion of housing 404.

Upon detecting that ice structures are shaped, the positioning means (e.g., pneumatics, linear actuator, motor, etc.), may cause the first mold housing 402 to move in a substantially horizontal direction away from the second mold housing 404 resulting in an increase in a distance from the second mold housing 404. Further, the positioning means may trigger a tilting of the first mold housing 402 and the second mold housing 404 to cause removal of ice structures from the cavities made between the first mold housing 402 and the second mold housing 404. The ice structures may be released/removed onto the first hingedly coupled plate 220 and/or the second hingedly coupled plate 222 of the trap door assembly 217. The linear actuator 232 may then cause movement of the first hingedly coupled plate 220 and the second hingedly coupled plate 222 to an acute angle to the longitudinal plane L of the device 200 to form a slot between the first hingedly coupled plate 220 and the second hingedly coupled plate 222.

The second layer 402*b* includes an input chamber 434 and an output chamber 436. The input chamber 434 may be fluidly connected to source inlet valve 414 and as such, may receive a continuous flow of the heat transfer fluid (e.g., water) while shaping ice ingot 206, for example. The output chamber 436 may receive the fluid flowing through any and all channels 432*a*-432*f* and discard or recirculate the fluid via a pump associated with device 200, for example. The input chamber 434 may be in fluid communication with the channels 432*a*, 432*b*, and 432*c* to provide heated fluid to the outer surface of the mold structure 410, for example. Such fluid may be removed at the output chamber 436 because the output chamber 436 may be in fluid communication with the channels 432*d*, 432*e*, and 432*f* after flowing around the outer surface of mold structure 410*a* to heat the mold structure 410*a* during an ice shaping process.

The third layer 402*c* includes a sealing plate that encloses the input chamber 434 and the output chamber 436 on a top surface 438. The sealing plate of layer 402*c* may further include any number of inlets and outlets including inlet 414 and outlet 416 as well as additional inlets and outlets for each cavity structure of a mold housing, such as cavity structure 410*a* of mold housing 402. The sealing plate of layer 402*c* may enable fluid temperature to be maintained within the input chamber 434, the output chamber 436, and the channels 432*a*-432*f*.

A drain channel 440 is provided at a fixed point of the cavity structure 410, shown here as a hemisphere with a center fixed point 442. The fixed point 442 is an aperture that allows melted water from the elongate ice to flow from the ice cavity/cavity structure through layers 402*b* and 402*c* and out of the mold housing 402. Draining ice meltwater in this way can ensure that the ice shaping process removes water from the ice cavity to ensure that a smooth surface is retained on the forming ice structure during an ice shaping process. Although three layers are shown in FIG. 4D, any number and/or depth of mold housing layers may be contemplated including at least two, three, four, five, or six layers.

FIG. 4E illustrates a cavity view of the example mold 101 configured for device 100. The cavity view depicts the surface s1 of the first clamshell part 102 and the surface s2 of the second clamshell part 104. The first clamshell part 102 includes a first plurality of cavities 102*a*, 102*b*, 102*c*, 102*d*, 102*e*, 102*f*, 102*g*, 102*h*, 102*i*, 102*j*, 102*k*, 1021, 102*m*, 102*n*, 102*o*, 102*p*, and 102*q*. The second clamshell part 104 includes a second plurality of mold cavities 104*a*, 104*b*, 104*c*, 104*d*, 104*e*, 104*f*, 104*g*, 104*h*, 104*i*, 104*j*, 104*k*, 104*l*, 104*m*, 104*n*, 104*o*, 104*p*, and 104*q*. The cavities 102*a*-102*q* may be joined to respective cavities 104*a*-104*q* to form a plurality of shaped ice structures. A plurality of shaped cavities is defined when the first surface s1 of the first clamshell part 102 is placed substantially adjacent to the second surface s2 of the second clamshell part 104. For example, a plurality of spherically shaped ice structures may be formed by compressing the elongate ice ingot 106 between part 102 and part 104 until joining the first surface s1 to the second surface s2 for a predefined time period defined by an ice shaping process defined herein elsewhere. The lengths, widths, number of cavities, and depths of parts 102, 104 may be substantially the same as described with respect to FIGS. 4A-4C.

In some embodiments, the clamshell parts 102, 104 may include a number of hemispherical cavities (cavity structures 102*a*, 102*b*, 104*a*, 104*b*, etc.) and a multiplate manifold to feed fluid (e.g., water) through an outer surface of the parts 102, 104. The multiplate manifold may include any number of layers to flow fluid through and/or around cavity structures.

Each cavity 102*a*-102*q* and 104*a*-104*q* of the mold 101 includes an aperture (e.g., aperture 131) that may drain fluid flowing through channels in clamshell part 102 and/or clamshell part 104. For example, heated fluid may be continually provided to circulate within channels 164 (FIG. 4G) and overflow may drain through apertures such as aperture 131 during the ice shaping process.

The heated fluid may be continually provided to circulate within the u-shaped channel 604 and may drain through aperture 612 (e.g., similar to or identical to aperture 452) and out through a drain channel (e.g., similar to drain channel 440).

Figure 4F:
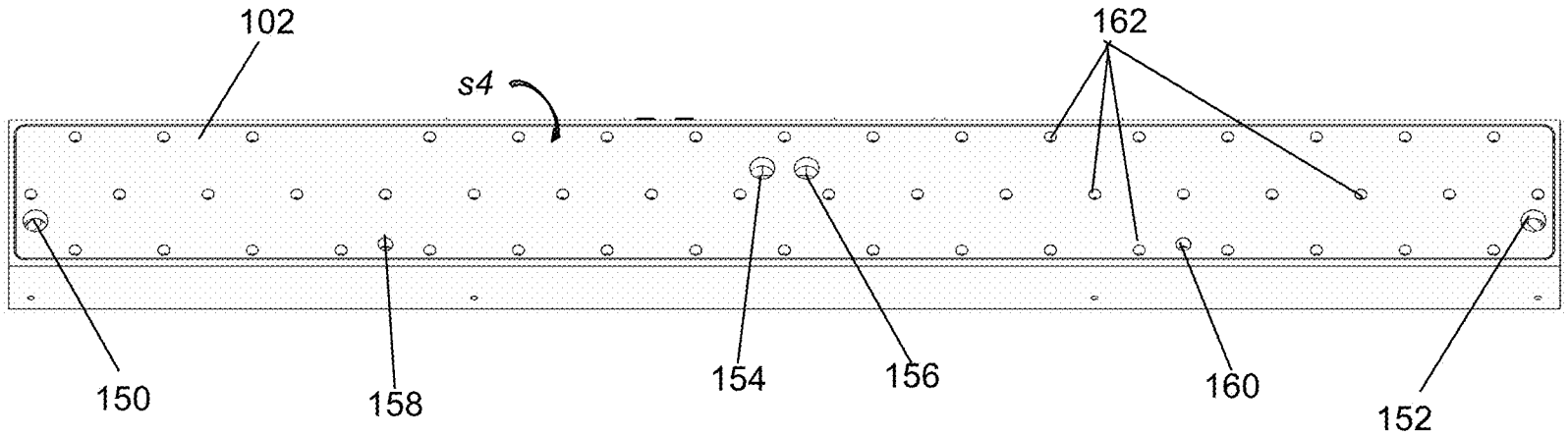

FIG. 4F illustrates a top down perspective view of an outer surface/layer of the clamshell part 102. Although part 102 is depicted, the inlets and outlets are substantially the same on an outer surface/layer of part 104. The first clamshell part 102 may include a first plurality of mold cavities 102*a*-102*q* on a first surface s1. The surface s4 shown in FIG. 4F is a surface opposite surface s1.

The surface s4 may include an inlet valve 150 and/or an inlet valve 152. The surface s4 may further include an outlet/outlet valve 154 and/or an outlet valve 156 to allow fluid (e.g., water) circulating from inlet valve 150 and/or inlet valve 152 to drain from channels within part 102. In some embodiments, the inlet valves 150, 152 may receive heated fluid (e.g., water) into one or more layers of parts 102, 104, as described elsewhere herein. In some embodiments, the outlet valves 154, 156 may receive fluid (e.g., water) that has been cooled within or near one or more channels of parts 102, 104 during an ice shaping process. In some embodiments, additional mold cavity pressure relief outlets (e.g., relief outlets 158, 160) may be included in each of parts 102, 104 to provide pressure relief from built up water and/or air within the channels of parts 102, 104. A number of bolts 162 may be used to secure layers of part 102 together.

Figure 4G:
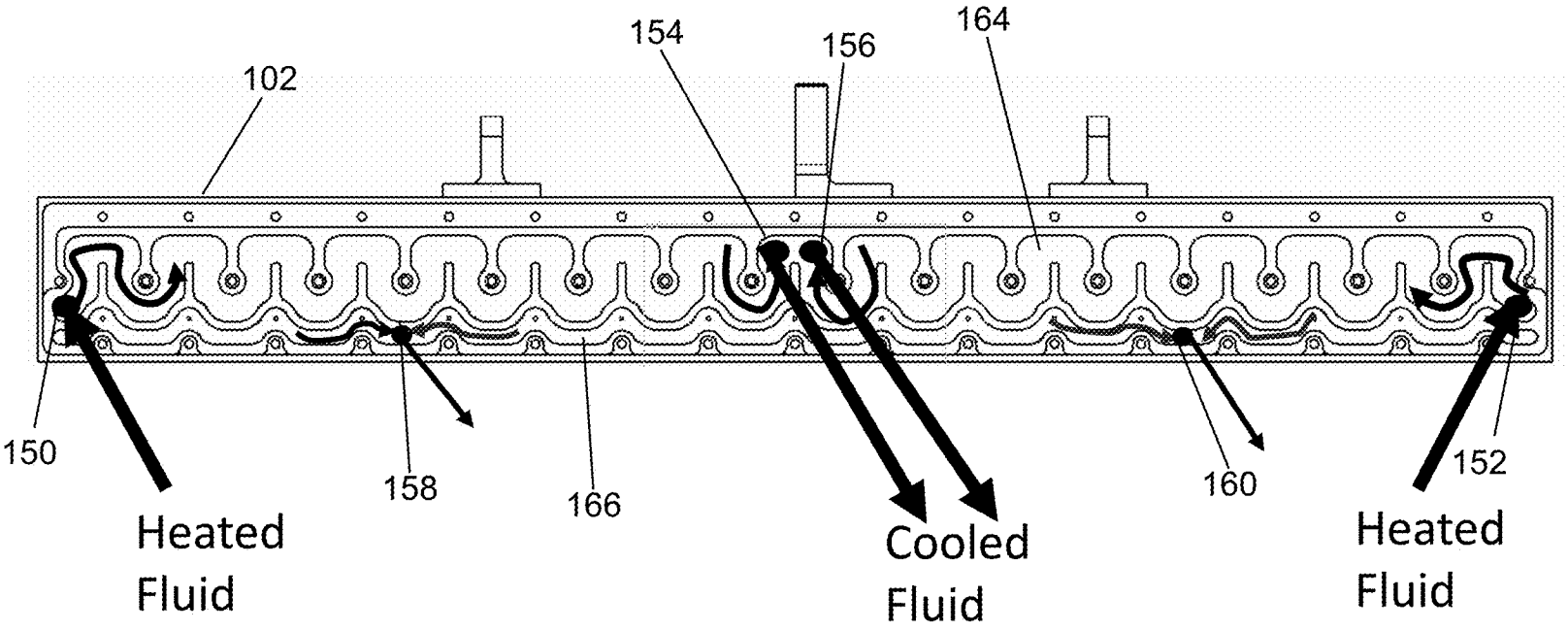

FIG. 4G illustrates another layer of clamshell part 102. In this example, a channel 164

The first clamshell part 102 may include a first plurality of mold cavities (e.g., cavities 102*a*-102*q*) on a first surface s1 and a first channel (e.g., channel 164) embedded behind the first surface s1 and configured to receive a first flow of fluid (e.g., water) through inlet valve 150 and/or inlet valve 152. The mold 101 may further include a second clamshell part 104 coupled to a second pivot point 114 installed on the support 108 and substantially adjacent to the first pivot point 109. The second clamshell 104 may have a second plurality of mold cavities (e.g., cavities 104*a*-104*q*) on a second surface s2 and a second channel (not shown, but similar to channel 164) embedded behind the second surface s2 and configured to receive a second flow of fluid (e.g., water) through similar inlets to 150, 152. The first surface s1 substantially faces the second surface s2 at a predefined angle from a longitudinal plane L of the mold 101.

The channel 164 may allow for heated fluid (e.g., water) to flow from inlet valve 150 and/or inlet valve 152 through to outlet 154 and/or outlet 156. In some embodiments, additional fluid and/or air may flow through cavities connecting relief outlets 158, 160 during an ice shaping process.

In operation of device 100 using mold 101, at least one fluid inlet valve for each of part 102 and part 104 (e.g., inlet valve 150 and/or inlet valve 152, etc.) may be provided heated fluid to the inlet valves 150, 152, etc., which may be configured to control the first flow of fluid through the first channel 164 associated with the first clamshell part 102, and the second flow of fluid through the second channel (not shown, but similar to channel 164) associated with the second clamshell part 104. Although three layers are shown in FIGS. 4E-4H, any number and/or depth of layers may be contemplated including at least two, three, four, five, or six layers.

Figure 4H:
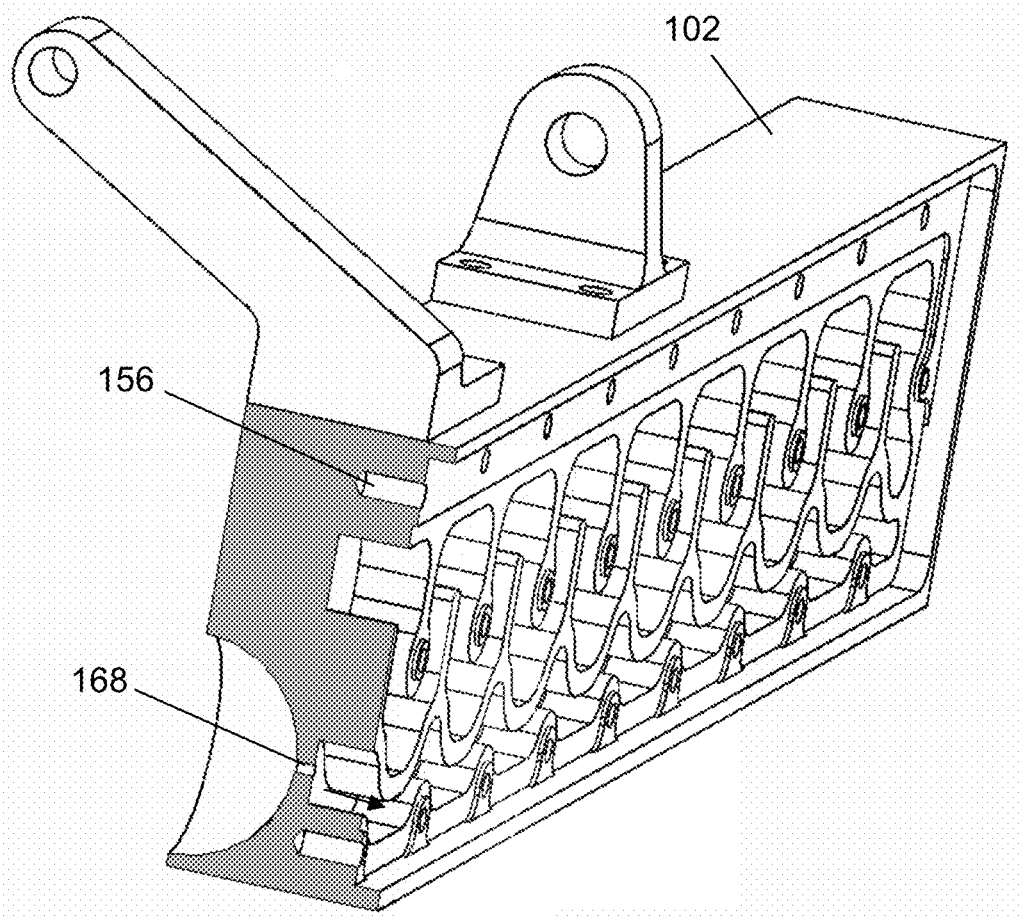

FIG. 4H illustrates a cross sectional view of the clamshell part 102. The inlet 156 may enable heated fluid to circulate in channel 164 to allow melting of ingot 106 into the shapes formed by cavities 102*a*-102*q* and 104*a*-104*q* when the first clamshell part 102 and the second clamshell part 104 are hinged to compress the ingot 106 between the parts 102, 104. Each part 102, 104 may include at least one pressure relief pin hole 168 to relieve air and/or water pressure from channels and/or apertures in parts 102, 104. The pressure relief pin hole 168 may function as a drain channel to or through portions of one or more layers of parts 102, 104. Such relief pin holes 168 may ensure an enhanced level of quality to the resulting shaped ice by allowing hot water (generated from melting the ingot 106 in the parts 102, 104) a place to drain. Relief pin holes 168 may provide an advantage of releasing pressure between the ice being shaped and the mold parts to avoid water build up and melt rivers that may degrade or otherwise mar the surface of the ice being shaped. For example, pressure relief pin holes 168 may avoid formation of bumps or trails on the shaped ice by avoiding excess water to flow around the surface of the ice being shaped by the mold cavities 102*a*-102*q*, 104*a*-104*q*.

In some embodiments, each mold cavity 102*a*-102*q*, 104*a*-104*q* may include a pressure relief pin hole 168 to relieve air and/or water pressure as the ice ingot 106 is shaped, for example. In some embodiments, each pressure relief pin hole 168 is substantially centered on each mold cavity portion, for example, on a rear wall of the respective cavity that drains toward other layers (e.g., layers shown in FIGS. 4A-6B) of the mold parts 102, 104. In some embodiments, each pressure relief pin hole 168 is integrated into every other mold cavity, rather than each mold cavity. In some embodiments, each pressure relief pin hole 168 is integrated into every two or every three mold cavities, rather than each mold cavity. In some embodiments, two or more pressure relief pin holes 168 are provided for each mold cavity.

The relief pin hole 168 may have a cross section with a circular shape, a square shape, a rectangular shape or a triangular shape. The cross section may be equal through the pin hole 168 or tapered from one or both ends toward a center cross section. In some embodiments, the diameter of the pressure relief pin hole 168 may be about 0.31 centimeters; about 0.025 centimeters to about 0.1 centimeters; about 0.1 to about 0.2 centimeters; about 0.2 centimeters to about 0.3 centimeters, or about 0.3 to about 0.31 centimeters.

Similar to mold housings 202, 204, each clamshell part 102, 104 include at least one fluid inlet that may be fluidly connected to a source inlet. Each fluid inlet may allow the flow of fluid (e.g., water) through at least one channel associated with the first clamshell part 102 or associated with the second clamshell part 104. In some embodiments, each fluid inlet connects at least one channel within a part 102, 104 and each part 102, 104 may have an inlet that provides flow of fluid from the source inlet to the respective fluid inlet and through to the respective fluidly connected channel and/or outlet. The fluid flowing through the channels of the parts 102, 104 may be water heated and maintained at a temperature from about 37 degrees Celsius to about 98 (e.g., about 100 degrees Fahrenheit to about 210 degrees Fahrenheit); about 37 degrees Celsius to about 47 degrees Celsius; about 45 degrees Celsius to about 55 degrees Celsius; about 50 degrees Celsius to about 60 degrees Celsius; about 57 degrees Celsius to about 70 degrees Celsius; about 65 degrees Celsius to about 80 degrees Celsius; about 75 degrees Celsius to about 90 degrees Celsius; about 80 degrees Celsius to about 98 degrees Celsius.

In some embodiments, device 100 is coupled to one or more fluid pumps to circulate fluid throughout channels (e.g., cavities, pathways, or the like) associated with parts 102, 104. In particular, embodiments where device 100 includes mold portions that enclose a plurality of internal cooling channels, various numbers, arrangements, placements, and fluid connectivities of internal cooling cavities, valves, fluid intakes, and/or fluid outtakes, may be used with (or installed within) device 100 without deviating from the scope of this disclosure. One of skill in the art will appreciate that the heat transfer fluid circulation system can include any number of pumps, compressors, evaporators, etc. to provide a sufficient circulation of water, coolant, or other fluid to shape ice structures from ice ingot 106.

Figure 5A:
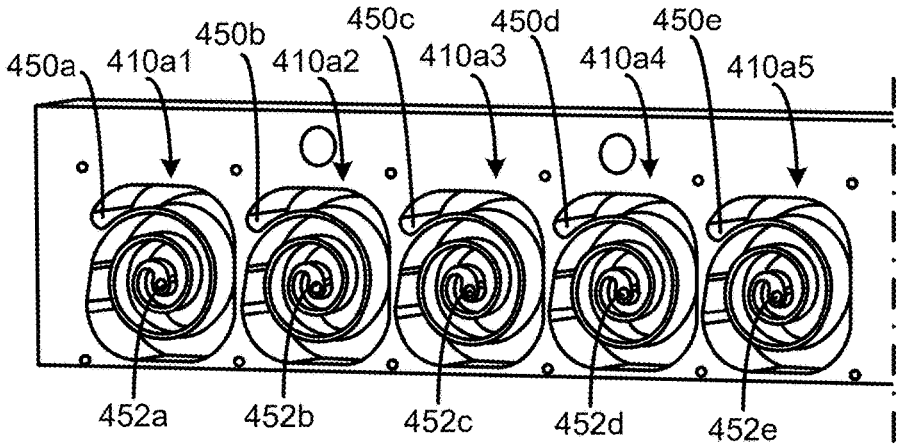
FIG. 5A-5C illustrate various views of example layers of the mold assemblies described herein.

FIG. 5A illustrates an example top down perspective view of layer 402*a*. The layer 402*a* shown here represents a right hand side of the layer 402*a* when viewing the layer 402*a* in FIG. 4D. The opposite and left hand side (not shown in FIG. 5A) may include the mold structure 410*a* (i.e., a hemisphere in this example). For example, the layer 402*a* includes a number of mold structures on the right hand side and a number of channels for receiving heated fluid (e.g., water) at the outer surfaces of the mold surfaces, which are shown here as spiral shaped channels located within layer 402*a* (and on the left hand side of layer 402*a* as depicted in FIG. 4D). In this example, the layer 402*a* includes five mold structures 410*a*1, 410*a*2, 410*a*3, 410*a*4, and 410*a*5, but any number of mold structures may be contemplated. Each rear surface of mold structures 410*a*1-410*a*5 is in fluid communication with a respective spiral shaped channel to allow fluid (e.g., water) to be received from input chamber 434 of layer 402*b* into an aperture 450*a*, 450*b*, 450*c*, 450*d*, or 450*e*. Each aperture 450*a*-450*e* may be fluidly connected to the input chamber 434, shown in FIG. 5B as fluid input aperture 434*a*, 434*b*, 434, 434*d*, 434*e*. In some embodiments, the input chamber 434 may be a single chamber connected to a fluid source inlet valve 414 and individually connected to each fluid input aperture 434*a*-434*e* (i.e., for each mold structure in a particular mold housing).

In operation of device 100 or 200 during an ice shaping process, heated fluid (e.g., heated water) may flow from a water source (e.g., a heat pump, a heated water source, etc.) to the source inlet valve 414 (or inlet valve 150 and/or valve 152), which continually provides the heated fluid to the input chambers 434*a*-434*e* (coupled to input chamber 434). The input chambers 434*a*-434*e* may be milled or machined into layer 402*b* at a location adjacent to each mold structure 410*a*1-410*a*5 to function as a fluid inlet for each structure 410*a*1-410*a*5. The water may flow from the respective input chambers 434*a*-434*e* into the apertures 450*a*-450*e* to warm the rear/outer surfaces (e.g., outer surface 610 in FIG. 6B) of the mold structures 410*a*1-410*a*5. In the depicted example, the water may flow around the provided spiral shape of each mold structure 410*a*1-410*a*5. In some embodiments, the channel shape behind the mold structures of a particular mold housing may not be spiral, but may instead be a single u-shaped channel (e.g., as shown in FIG. 6A), one or more square shaped or square shaped spiral channels, one or more serpentine channels, or the like.

Figure 5B:
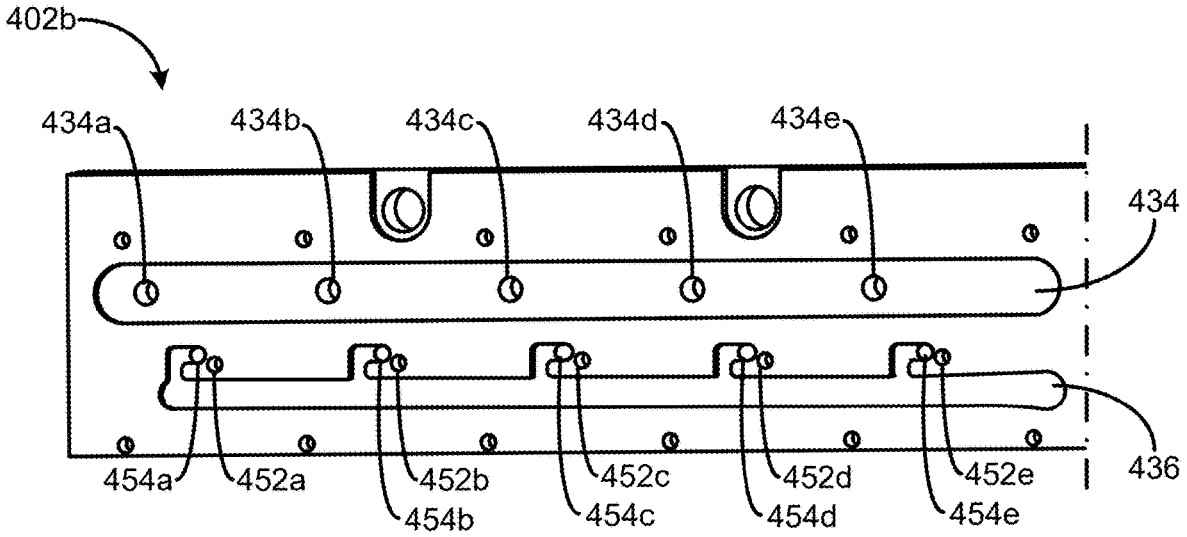

FIG. 5B illustrates a top down perspective view of layer 402*b*. Layer 402*b* may be placed on top of layer 402*a* to manage fluid to and from layer 402*a* channels and components. Each mold structure 410*a*1-410*a*5 also includes an aperture 452 (e.g., aperture 452*a*, 452*b*, 452*c*, 452*d*, and 452*e*), shown in FIG. 5A in layer 402*a* and in FIG. 5B within layer 402*b*. Each aperture 452*a*-452*e* may function to drain fluid from each channel of mold structures 410*a*1-410*a*5 through respective apertures 454*a*, 454*b*, 454*c*, 454*d*, and 454*e*. Each aperture 452*a*-452*e* may be fluidly connected to the output chamber 436 through respective apertures 454*a*-454*e*, which may receive drained fluid from apertures 452*a*-452*e* and further drain or recirculate the received drained fluid.

Figure 5C:
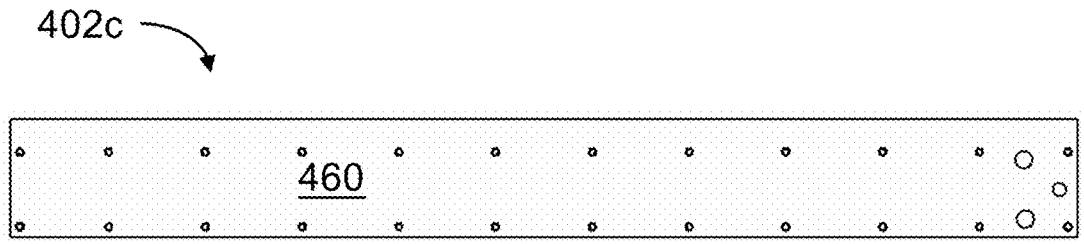

FIG. 5C illustrates a top down perspective view of layer 402*c*. Layer 402*c* may be a metal enclosure plate that is placed on top of layer 402*b* to maintain a temperature of fluid flowing through mold housing 402. While the layers 402*a*-402*c* are described with respect to mold housing 402, one skilled in the art would understand that similar or exact features may be attributed to mold housing 404 to utilize both housings 402, 404 together to shape ice in device 200. The layer 402*c* includes a surface 460. The surface 460 may include one or more apertures for receiving compressed air to assist in removal of ice structures from ice mold housing 402, for example.

Figure 6A:
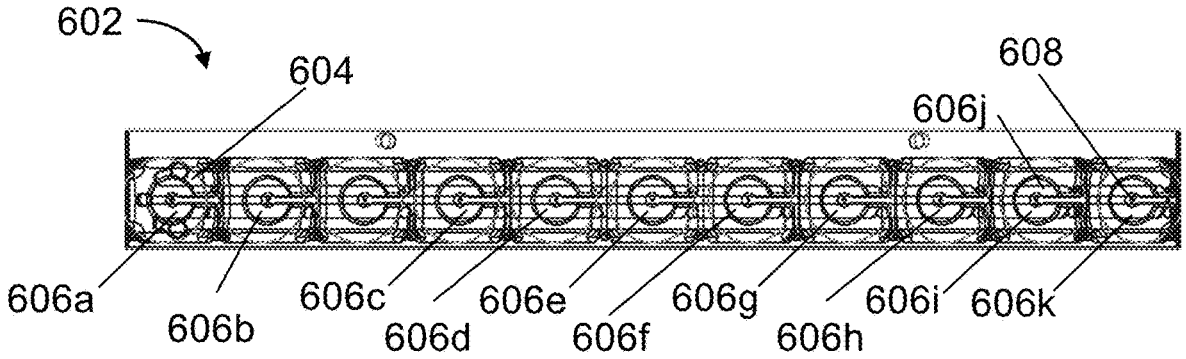
FIGS. 6A-6B illustrate another example mold assembly for use with the example devices described herein.

FIG. 6A illustrates a top down view of a layer 602 of an example mold assembly. The layer 602 shown in FIG. 6A may be similar to layer 402*a* shown in FIG. 5A. In this example, the layer 602 includes u-shaped channels 604 for each mold structure 606*a*, 606*b*, 606*c*, 606*d*, 606*e*, 606*f*, 606*g*, 606*h*, 606*i*, 606*j*, and 606*k*. The u-shaped channels may be three dimensional channels that surround and cover a portion of the outside surface of each mold cavity. Each mold structure 606*a*-606*k* includes an aperture (e.g., aperture 608) that may function to drain water away from the channels 604 for each mold structure 606*a*-606*k*. While a single mold assembly is shown in FIG. 6A, one skilled in the art will appreciate that a corresponding second mold assembly with a layer (e.g., similar or identical to layer 602) may be utilized in combination with layer 602 to shape ice during an ice shaping process of device 200.

Figure 6B:
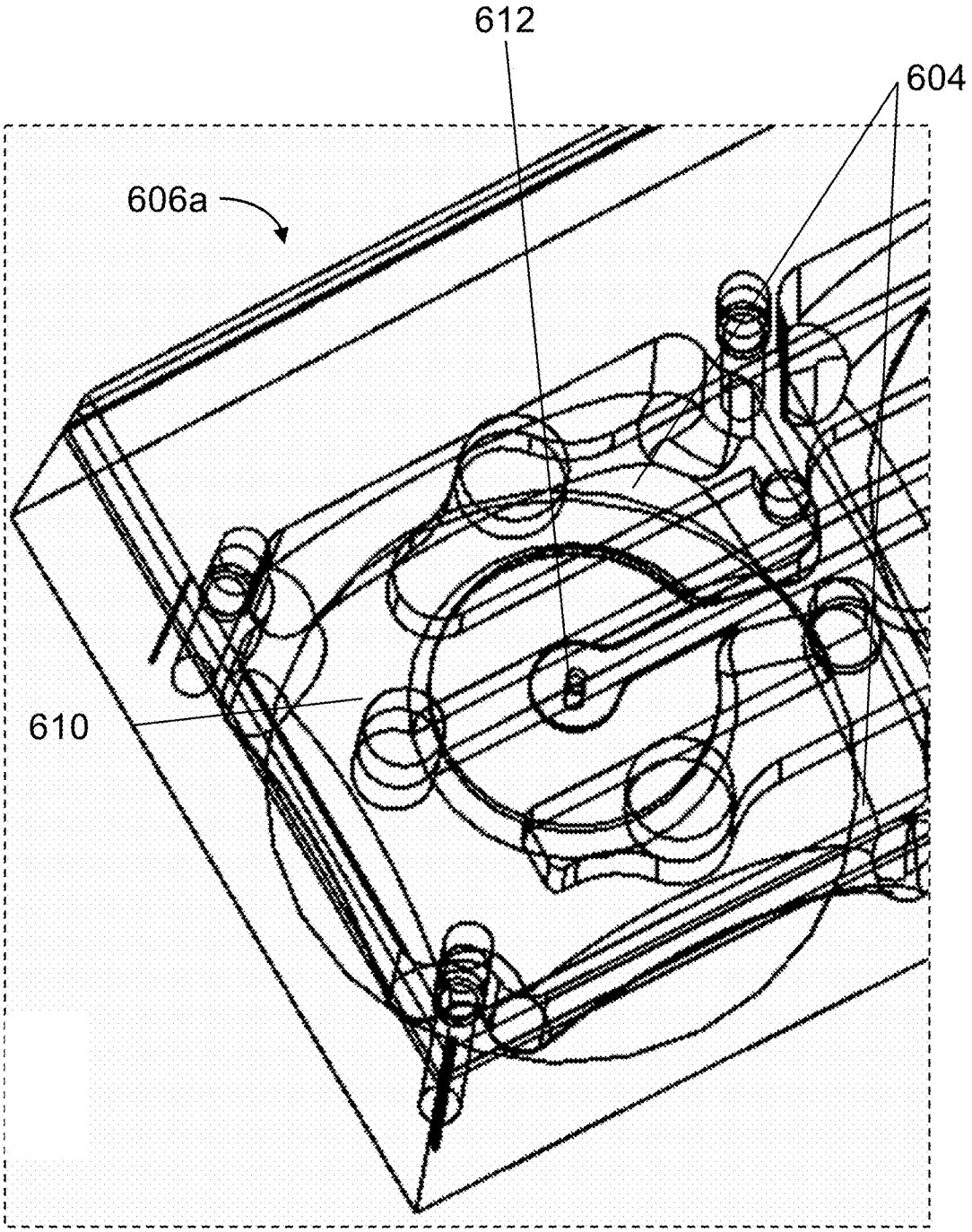

FIG. 6B illustrates a zoomed in perspective view of the mold structure 606*a*. The mold structure 606*a* is shown here with a layer removed (e.g., a layer 402*c* is removed for illustration purposes) to depict the u-shaped channels 604 and mold structure outer surfaces 610. In operation, heated fluid (e.g., water) may be received from a source inlet (e.g., source fluid inlet valve 414) through an aperture providing access to u-shaped channel 604. The heated fluid may be continually provided to circulate within the u-shaped channel 604 and may drain through aperture 612 (e.g., similar to or identical to aperture 452) and out through a drain channel (e.g., similar to drain channel 440).

Figure 7:
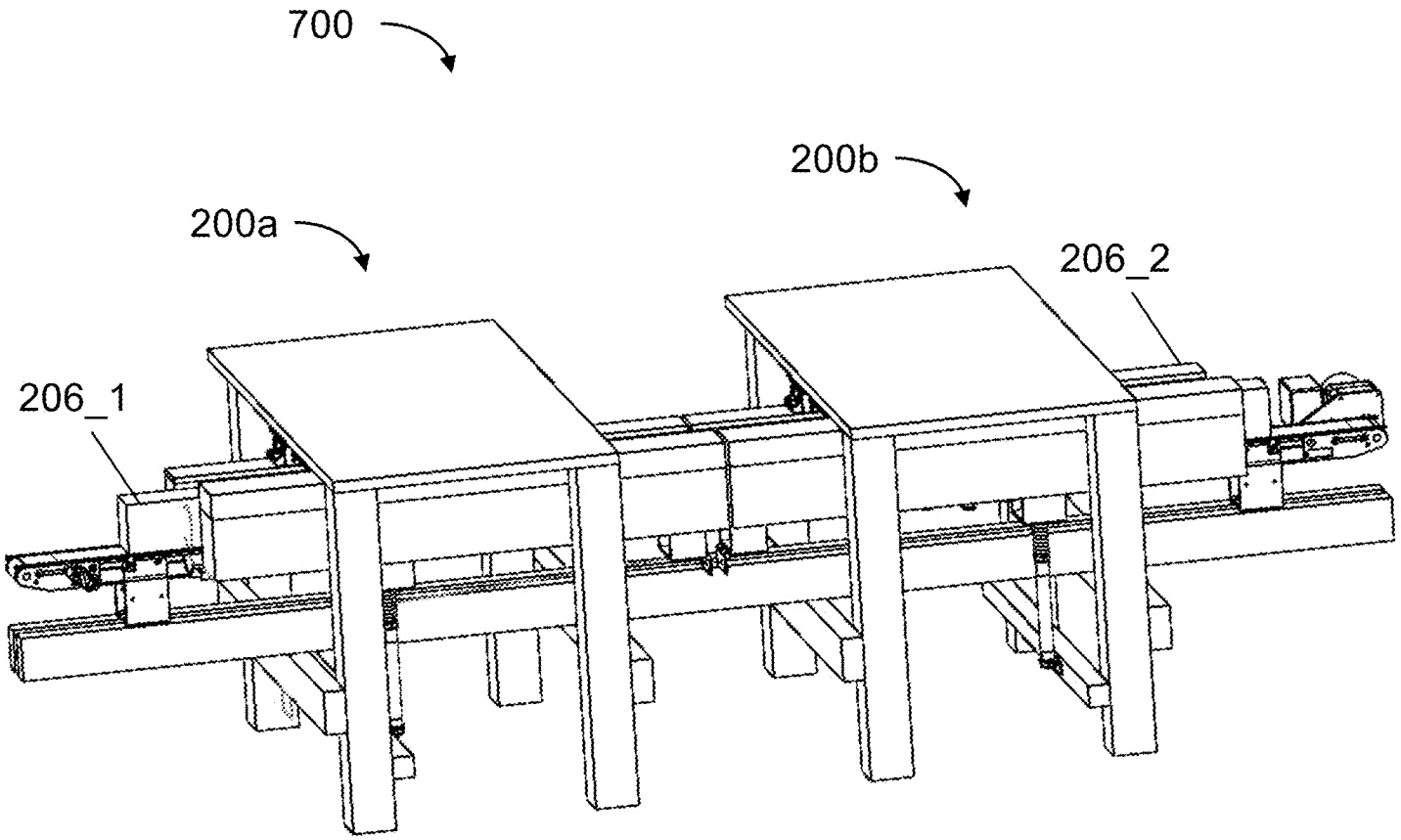
FIG. 7 illustrates a perspective view of a device assembly for shaping two or more elongate ingots of ice.

FIG. 7 illustrates a perspective view of a device assembly 700 for shaping two or more elongate ingots of ice. The device assembly 700 may include two or more devices 200 (e.g., device 200*a*, device 200*b*) for shaping ice. Each device 200*a*, 200*b* may shape a separate ice ingot (e.g., ingot 206_1, ingot 206_2). Each set of shaped ice structures may be dropped into a trap door associated with each respective device 200*a*, 200*b*, as described in detail above. The trap door systems described herein may bring the formed ice together and may transport the structures along portions of the trap door assemblies. In some embodiments, the trap door systems described herein may separate each structure of ice into a container or cavity within the container to allow separation and transport of individual ice structures. Additional conveyor systems may be installed to move ice ingots 206_1, 206_2 and to transport shaped ice structures. Similar to the assembly 700, any two or more portions of device 100 may be coupled in an assembly to increase the throughput of generating shaped ice.

Figure 8:
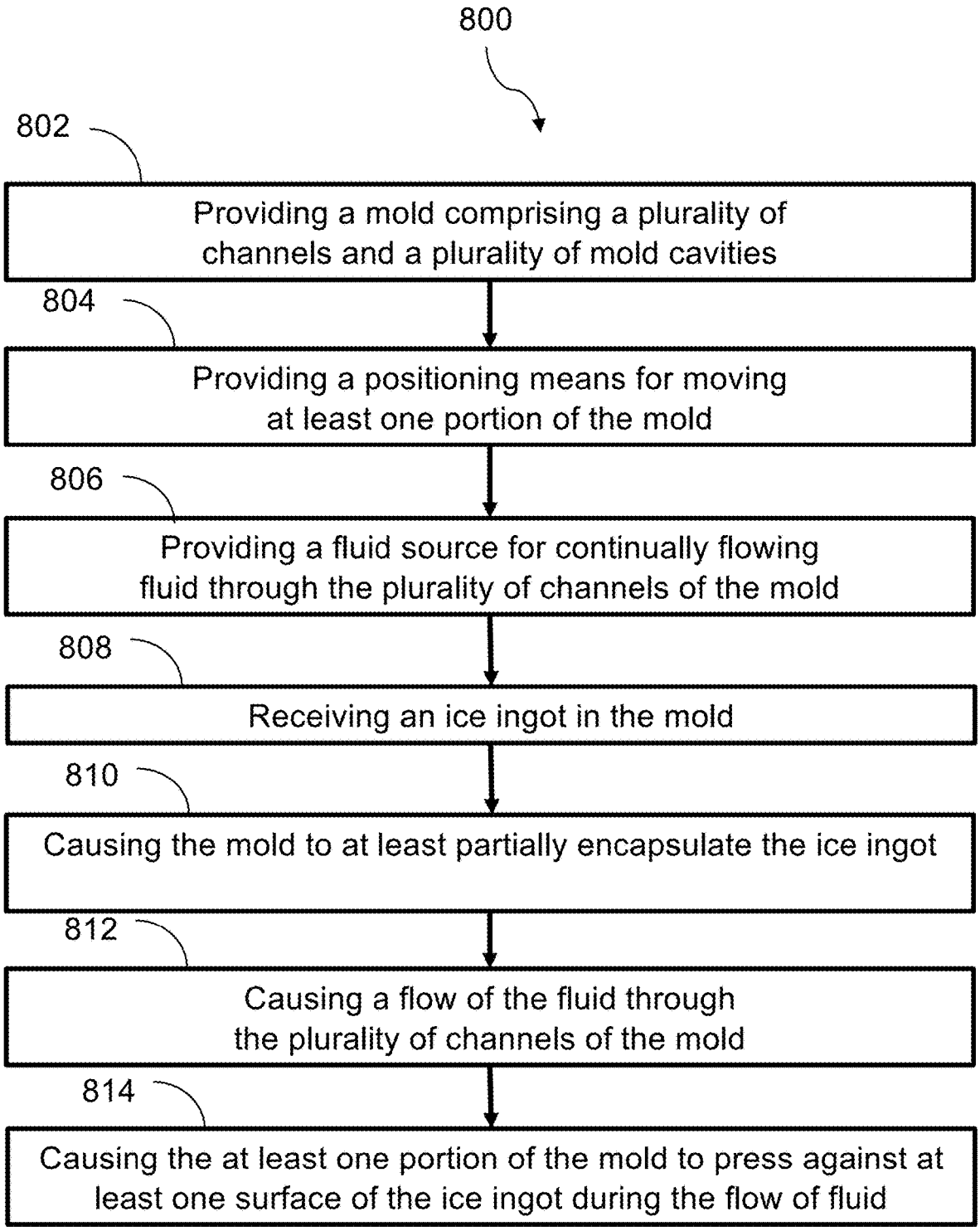
FIG. 8 illustrates a flow diagram of an example process for shaping ice.

FIG. 8 is a flow diagram of an example process 800 for shaping ice. At a high level, the process 800 includes providing a mold comprising a plurality of channels and a plurality of mold cavities at block 802, providing a positioning means for moving at least one portion of the mold at block 804, providing a fluid source for continually flowing fluid through the plurality of channels of the mold at block 806, receiving an ice ingot in the mold at block 808, causing the mold to at least partially encapsulate the ice ingot at block 810, causing a flow of the fluid through the plurality of channels of the mold, wherein the fluid is thermally heated to a predefined temperature or predefined temperature range before flowing through the plurality of channels of the mold at block 812, and causing the at least one portion of the mold to press against at least one surface of the ice ingot during the flow of fluid such that the ice ingot selectively melts to form a plurality of sufficiently distinct ice shapes (e.g., ice structures 221) as defined by the plurality of mold cavities, at block 814.

At block 802, the process 800 includes providing a mold comprising a plurality of channels (e.g., channels 432*a*-432*f*, one or more channels 440, and/or one or more channels or chambers 434, 436) and a plurality of mold cavities (e.g., mold cavities 410, 412). In particular, the process 800 may be carried out on device 200, which includes the mold 201 with at least a first mold housing 202 and a second mold housing 204. The mold 201 (e.g., mold housings 202, 204) may be arranged to receive an elongate ice ingot 206 therebetween. In such an arrangement, device 200 may begin to shape the ice into ice structures shaped by cavities (410, 412) associated with the mold 201.

At block 804, the process 800 includes providing a positioning means for moving at least one portion of the mold. For example, device 200 includes the positioning means 211 to cause mold housing 202 to move laterally toward or laterally away from mold housing 204 along guide rails 208*a*, 208*b*.

At block 806, the process 800 includes providing a fluid source for continually flowing fluid through the plurality of channels of the mold. For example, a water source (e.g., water supply 910) may continually flow water through the channels (e.g., channels 432*a*-432*f*, one or more channels 440, and/or one or more channels or chambers 434, 436) to heat rear surfaces of the mold cavities 410, 412.

In general, the process 800 to shape the ice ingot 206 may be triggered by one or more processors programmed to cause movement and operation of equipment, assemblies, and/or parts of device 200. For example, the device 200 for making clear ice may include or be communicatively coupled to at least one processor and memory storing instructions that, when executed by the at least one processor, cause the device to execute some or all of the instructions of blocks 802-814.

At block 808, the process 800 includes receiving an ice ingot in the mold. For example, a conveyor system may deliver an ice ingot 206 to be positioned at device 200 within and/or between portions of the mold 201. The ice ingot 206 may be pressed between the first mold housing 402 and the second mold housing 402 when device 200 is triggered to press (e.g., laterally move) mold housing 402 toward a first surface of the ice ingot and move a second surface (opposite the first surface) laterally into mold housing 404. Such movement may cause the mold to at least partially encapsulate the ice ingot, as shown in block 810.

At block 812, the process 800 includes causing a flow of the fluid (e.g., water) through the plurality of channels (e.g., (e.g., channels 432*a*-432*f*, one or more channels 440, and/or one or more channels or chambers 434, 436) of the mold. The fluid (e.g., water) may be thermally heated to a predefined temperature before flowing through the plurality of channels of the mold, as described throughout this disclosure. For example, the device 200 may provide heated water to a number of fluid channels 432*a*, 432*b*, 432*c*, 432*d*, 432*e*, and 432*f*. Such flow of heated water may function to heat up the mold housings 402, 404 and eventually melt the elongate ice ingot 206 into the ice cavities to form ice structures (e.g., ice structures 221 in FIG. 2B). In particular, each channel 432*a*-432*f* may flow heated water to outer surface portions of the mold cavity structure 410*a*. Heating the outer surface portions can transform an ice ingot that is pressed between two mold housings 402, 404 to melt and form the ice structures in the shape of the mold cavities formed by joining housings 402, 404.

At block 814, the process 800 includes causing the at least one portion of the mold (e.g., mold housing 202 or mold housing 402) to press against at least one surface of the ice ingot 206 during the flow of fluid (e.g., water) such that the ice ingot 206 selectively melts to form a plurality of sufficiently distinct ice shapes (e.g., ice structures 221) as defined by the plurality of mold cavities 410, 412.

In an example of process 800, pressing an ice ingot, such as ingot 206, between the mold housing 402 and the mold housing 404 may include moving the mold housing 402 to meet the ice ingot 206 and pressing the opposing side of the ice ingot 206 against the mold housing 404. Such pressing can be performed by a linear actuator and/or motor moving mold housing 402 along guide rails 208*a*, 208*b* to maintain tension against the ice ingot 206 that is placed between the first mold housing 402 and the second mold housing 404. The tension may be maintained during heating (e.g., fluidly heating channels) of the first mold housing 402 and the second mold housing 402 and may be removed upon detecting that the first mold housing 402 and the second mold housing 404 are located at a predefined distance apart. For example, as the ice ingot melts around the molds to form ice structures within cavities of the mold assembly 400, the mold housing 402 may be brought nearer to mold housing 404 during ice melt until at least a portion of housing 402 makes contact with at least a portion of housing 404.

In some embodiments, the process 800 further includes providing a trap door assembly 217 that is located substantially parallel to the mold 201 and beneath a bottom surface 106*d* (FIG. 3A) of the mold. The process 800 may further include causing the trap door assembly 217 to catch (e.g., dropped from the mold 201, 400) and transport (e.g., roll) the plurality of sufficiently distinct ice structures 221 when released from the plurality of mold cavities 410, 412 and in response to detecting completion of an ice shaping process. For example, a processor (e.g., processor 903) may detect a completion of an ice shaping process being executed on device 200 and may trigger release of ice structures 221 and movement of trap door assembly 217 to catch the ice structures 221, as described in FIGS. 3A-2E.

In some embodiments, the mold further includes a drain system that drains fluid from the plurality of mold cavities 410, 412. The drain system may include one or more of outlets 416, drain channels 440, and/or output chamber 436. For example, each mold housing 402, 404 includes at least one outlet 416 for discarding fluid (e.g., water) that has cycled throughout one or more channels of housing 402. Each mold housing 402, 404 may include a number of mold cavities 410, 412 and each mold cavity may include (or be associated with) one or more sets of outlets (e.g., apertures leading away from the mold cavities).

In addition, each mold housing (e.g., mold housing 402, 404) may include a drain channel 440 provided at a fixed point of the cavity structure 410*a* (of FIG. 4D) shown as a hemisphere with a center fixed point 442. The fixed point 442 is an aperture that allows melted ice water to flow from the ice cavity/cavity structure through layers 402*b* and 402*c* and out of the mold housing 402. Draining ice melt water in this way can ensure that the ice shaping process removes water from the ice cavity to ensure that a smooth surface is retained on the forming ice structure during an ice shaping process.

In some embodiments, the plurality of mold cavities 410, 412 are a predefined shape selected from the group consisting of: a cuboid shape, a polyhedron shape, a sphere shape, a heart shape, a diamond shape, a clover shape, a polygon shape, and a hemispherical shape.

Upon completion of an ice shaping process or upon determining that the ice structures are formed according to desired specifications, the positioning means (e.g., pneumatics, linear actuator, motor, etc.), may cause the first mold housing 402 to move in a substantially horizontal direction away from the second mold housing 404 resulting in an increase in a distance from the second mold housing 404. Further the positioning means may trigger a tilting of the first mold housing 402 and the second mold housing 404 to cause removal of ice structures from the cavities made between the first mold housing 402 and the second mold housing 404. The ice structures 221 may be released/removed onto the first hingedly coupled plate 220 and/or the second hingedly coupled plate 222. The linear actuator 232 may then cause movement of the first hingedly coupled plate 220 and the second hingedly coupled plate 222 to an acute angle to the longitudinal plane L of the device 200 to form a slot between the first hingedly coupled plate 220 and the second hingedly coupled plate 222 of the trap door assembly 217.

In some embodiments, the device 200 includes or is communicatively coupled to at least one computing device including at least one processor and memory storing instructions that when executed by the processor cause the at least one processor to generate and trigger display of at least one user interface. The user interface may receive user input corresponding to a mold clamping metric, a recipe for shaping the elongate ice ingot including, but not limited to, clamping forces, clamping timing, shaping timing, a mold shape, and/or a mold size, an air knife blowing rate, or an air temperature. The computing device may also include one or more controls and/or outputs to provide feedback to a user to indicate timing and completion status of a recipe being processed on device 200.

The device 200 may include or be coupled to a computer program product can be tangibly embodied in an information carrier. The computer program product may also contain instructions that, when executed, perform one or more methods and/or computer-implemented methods described herein. The information carrier may be a computer- or machine-readable medium, such as memory, or other storage associated with the ice-making devices described herein.

Figure 9:
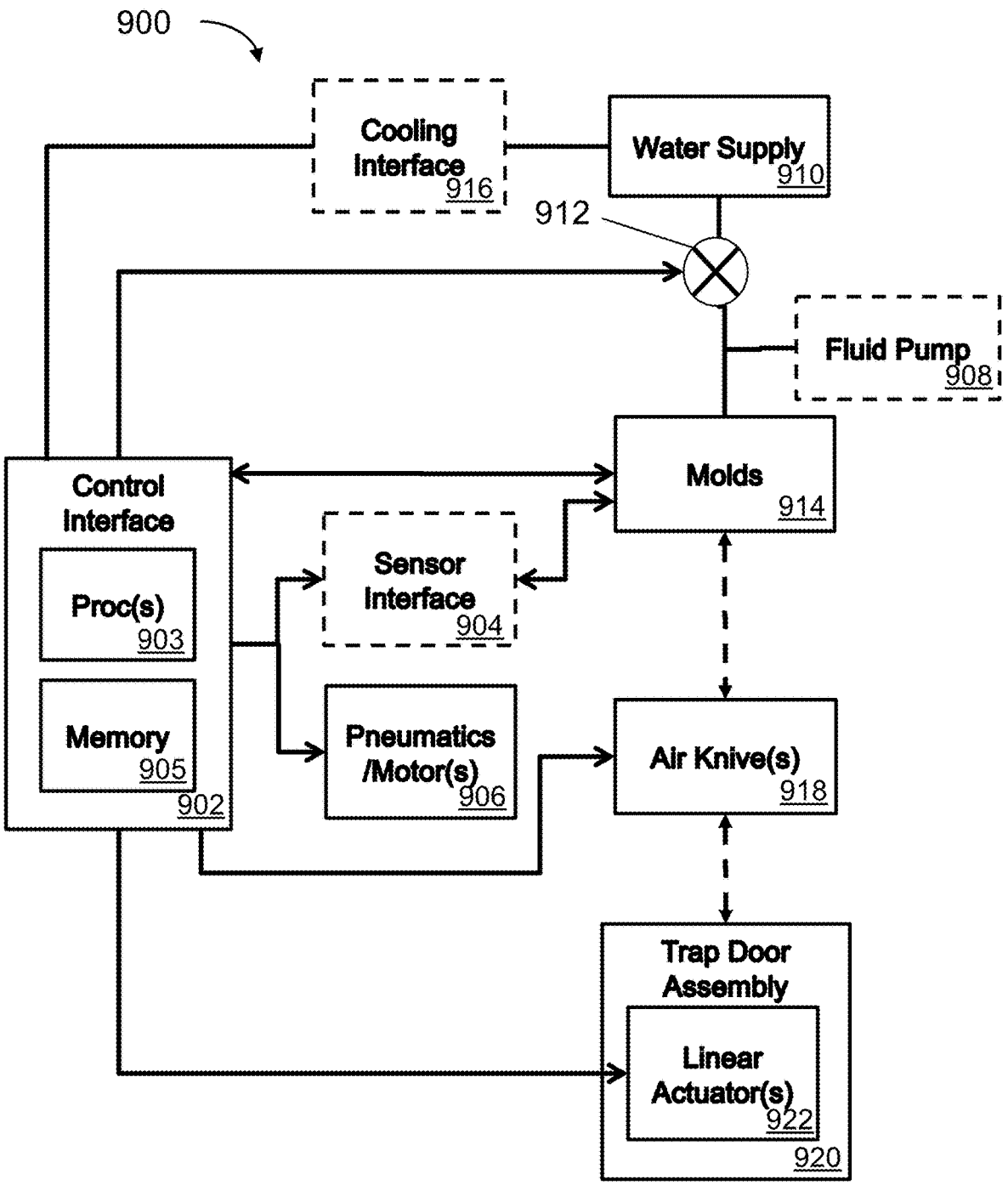
FIG. 9 illustrates a block diagram of an example system for shaping ice.

FIG. 9 illustrates a block diagram of an example system 900 for shaping ice. The device 200 may be installed within device 200. The system 900 includes at least a control interface 902, an optional sensor interface 904, pneumatics/motors 906, and a fluid pump 908. The control interface 902 includes one or more processors 903 and memory 905. The one or more processors 903 may receive sensor signals from optional sensor interface 904 to begin or end use of any of the components of system 900. The one or more processors 903 and/or memory may be programmed to control the dispensing of water through valve 912.

The system 900 may be used to control the operation of the ice shaping device 200. The control interface 902 may be operably coupled to an electrically operated valve 912. The valve 912 may be optionally coupled to a fluid pump 908 to pump fluid/water from a water supply 910 into molds 914 (e.g., such as mold 201, mold assembly 400, and/or components thereof). In some embodiments, the control interface 902 may be optionally coupled to a cooling interface 916 through the water supply 910 to cool the water before providing water to the molds 914. The cooling interface 916 may be a thermoelectric device such as a Peltier-type cooler or the like.

The valve 912 may be actuated by the control interface 902 to add a predetermined amount of water to the molds 914. In some embodiments, the valve 912 functions to continually provide a flow of water to the molds 914 for a duration of an ice shaping process. Example durations of the ice shaping process may include about 15 seconds to about 60 seconds; about 15 seconds to about 20 seconds; about 20 seconds to about 25 seconds; about 25 seconds to about 30 seconds; about 35 seconds to about 40 seconds; about 40 seconds to about 45 seconds; about 45 seconds to about 50 seconds; about 50 seconds to about 55 seconds; about 55 seconds to about 60 seconds. This can be accomplished by controlling either a period of time that the valve 912 is opened to a predetermined flow rate or by providing a flow meter to measure an amount of water dispensed through valve 912.

The control interface 902 may be operably coupled to an electrically operated sensor interface 904 to detect mold positions, ice formation, fluid (e.g., water, heat exchanger fluid) flow rates, and/or fluid (e.g., water, heat exchanger fluid) temperatures throughout any and all shaping processes. The control interface 902 may also be operably coupled to electrically operated pneumatics/motors 906 to move mold housings 202, 402, etc., as described herein.

The control interface 902 may also be operably coupled to one or more air knives 918, a trap door assembly 920, and/or linear actuators 922 to control the trap door assembly 920 and/or to control one or more air knives 918 (e.g., one or more air knife 292). Each air knife 918 may be coupled to a pneumatic slide (not shown) to move the air knife into position. When in position, the air knife may direct a column of air across a surface associated with the ice structures being ejected from one or more molds 914 to remove excess fluid (e.g., water) from the ice structures and/or molds 914. For example, the air knife 918 may be positioned and oriented to blow air toward a region proximal to either or both sides w3 and w1 of the trap door assembly 920 (e.g., trap door assembly 217).

The trap door assembly 920 may be moved via linear actuator 922 (e.g., linear actuator 232). The trap door assembly 920 may include the first hingedly coupled plate 220 and the second hingedly coupled plate 222 (see FIGS. 2A, 2B). The first hingedly coupled plate 220 may include a first lengthwise side l2 opposite a second lengthwise side l3 and a first widthwise side w3 opposite a second widthwise side w4. The second hingedly coupled plate 222 includes a third lengthwise side l4 opposite a fourth lengthwise side l1 and a third widthwise side w1 opposite a second widthwise side w2.

The linear actuator 922 may be configured to cause the first hingedly coupled plate 220 and the second hingedly coupled plate 222 to hinge from an initial configuration (e.g., shown in FIG. 3A) into an ice harvesting configuration (shown in FIG. 2C) upon completion of an ice shaping process of the device 200, as described in FIGS. 3A-2E. The initial configuration includes the first hingedly coupled plate 220 and the second hingedly coupled plate 220 being aligned substantially normal to the longitudinal axis L of the device 200. The ice harvesting configuration includes the first hingedly coupled plate 220 and the second hingedly coupled plate 220 being positioned in an acute angle to the longitudinal axis (L) of the device 200 to form a slot (e.g., trough/slot 243) between lengthwise edge l3 the first hingedly coupled plate 220 and lengthwise edge l4 of the second hingedly coupled plate 222. The acute angle of the first hingedly coupled plate 220 and the acute angle of the second hingedly coupled plate 220 may match such that lengthwise edge l3 is lowered from parallel from about 1 degree to about 45 degrees while the lengthwise edge l4 is lowered from parallel by the same amount.

Figure 10:
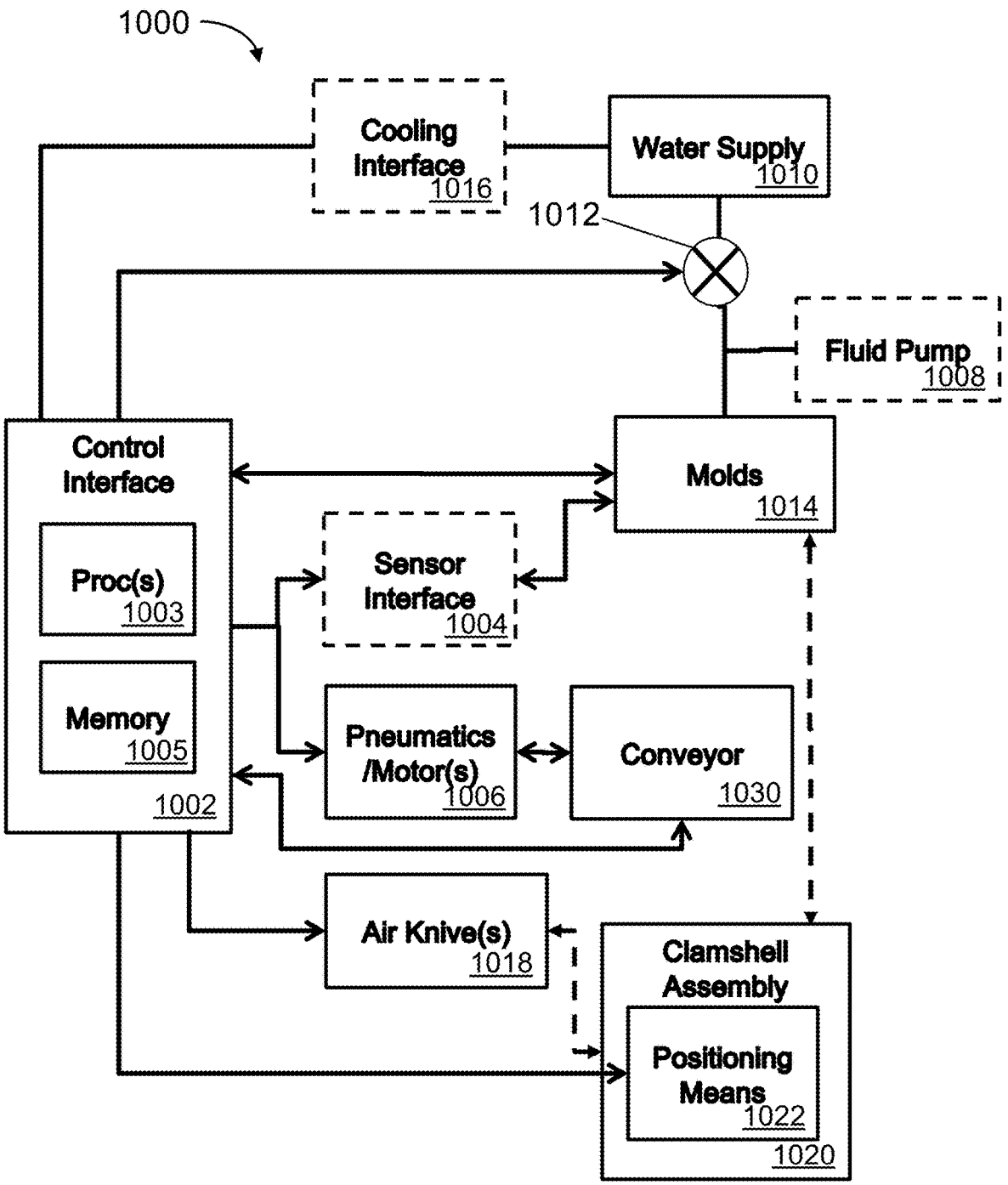
FIG. 10 illustrates another block diagram of an example system for shaping ice.

FIG. 10 illustrates another block diagram of an example device 1000 for shaping ice. The device 1000 may be installed within device 100 or 200. The device 1000 includes at least a control interface 1002, an optional sensor interface 1004, pneumatics/motors 1006, and a fluid pump 1008.

The control interface 902 includes one or more processors 1003 and memory 1005. The one or more processors 1003 may receive sensor signals from optional sensor interface 1004 to begin or end use of any of the components of device 1000. The one or more processors 1003 and/or memory 1005 may be programmed to control the dispensing of fluid (e.g., water) through one or more valves 1012.

The device 1000 may be used to control the operation of the ice shaping device 100 or 200. The control interface 1002 may be operably coupled to an electrically operated valve 1012. The valve 1012 may be optionally coupled to a fluid pump 1008 to pump fluid/water from a water supply 1010 into molds 1014 (e.g., such as mold 101, mold 201, mold assembly 400, and/or components thereof). In some embodiments, the control interface 1002 may be optionally coupled to a cooling interface 1016 through the water supply 1010 to cool the water before providing water to the molds 1014. The cooling interface 1016 may be a thermoelectric device such as a Peltier-type cooler or the like.

The valve 1012 may include any number of valves to mold 1014, for example, that may be actuated by the control interface 1002 to add a predetermined amount of water to the molds 1014. In some embodiments, the valve 1012 functions to continually provide a flow of water to the molds 1014 for a duration of an ice shaping process. Example durations of the ice shaping process may include about 30 seconds to about 180 seconds; about 30 seconds to about 45 seconds; about 45 seconds to about 60 seconds; about 60 seconds to about 75 seconds; about 75 seconds to about 90 seconds; about 90 seconds to about 105 seconds; about 105 seconds to about 120 seconds; about 120 seconds to about 135 seconds; about 135 seconds to about 150 seconds; about 150 seconds to about 165 seconds; or about 165 seconds to about 180 seconds.

This can be accomplished by controlling either a period of time that the valve 1012 is opened to a predetermined flow rate or by providing a flow meter to measure an amount of water dispensed through one or more valves 1012.

The control interface 1002 may be operably coupled to an electrically operated sensor interface 1004 to detect mold positions, ice formation, fluid (e.g., water, heat exchanger fluid) flow rates, and/or fluid (e.g., water, heat exchanger fluid) temperatures throughout any and all shaping processes. The control interface 1002 may also be operably coupled to electrically operated pneumatics/motors 1006 to move mold housings 102, 202, 402, etc., as described elsewhere herein.

The control interface 1002 may also be operably coupled to one or more air knives 1018, clamshell assemblies 1020 and/or positioning means 1022 to control the clamshell parts 102, 104 of assembly 1020 and/or to control one or more air knives 1018 (e.g., one or more air knife 292). Each air knife 1018 may be coupled to a pneumatic slide (not shown) to move the air knife into position. When in position, the air knife may direct a column of air across a surface associated with the ice structures being ejected from one or more molds 1014 to remove excess fluid (e.g., water), ice chips, or the like from the ice structures and/or molds 1014. For example, the air knife 1018 may be positioned and oriented to blow air toward a region proximal to either or both sides of parts 102, 104.

The positioning means 1022 may be configured to cause the clamshell assembly 1020 (i.e., the first clamshell part 102 and the second clamshell part 104) to hinge to compress an ice ingot and hinge open to release shaped ice structures formed from the ice ingot. For example, the positioning means 1022 may cause the clamshell assembly 1020 to hinge between an initial configuration (e.g., shown in FIG. 1C) into an ice shaping configuration (e.g., shown in FIG. 1E) and in an ice harvesting configuration to drop ice structures onto conveyor 1030 (e.g., conveyor system 116) upon completion of an ice shaping process of the device 100.

Figure 11:
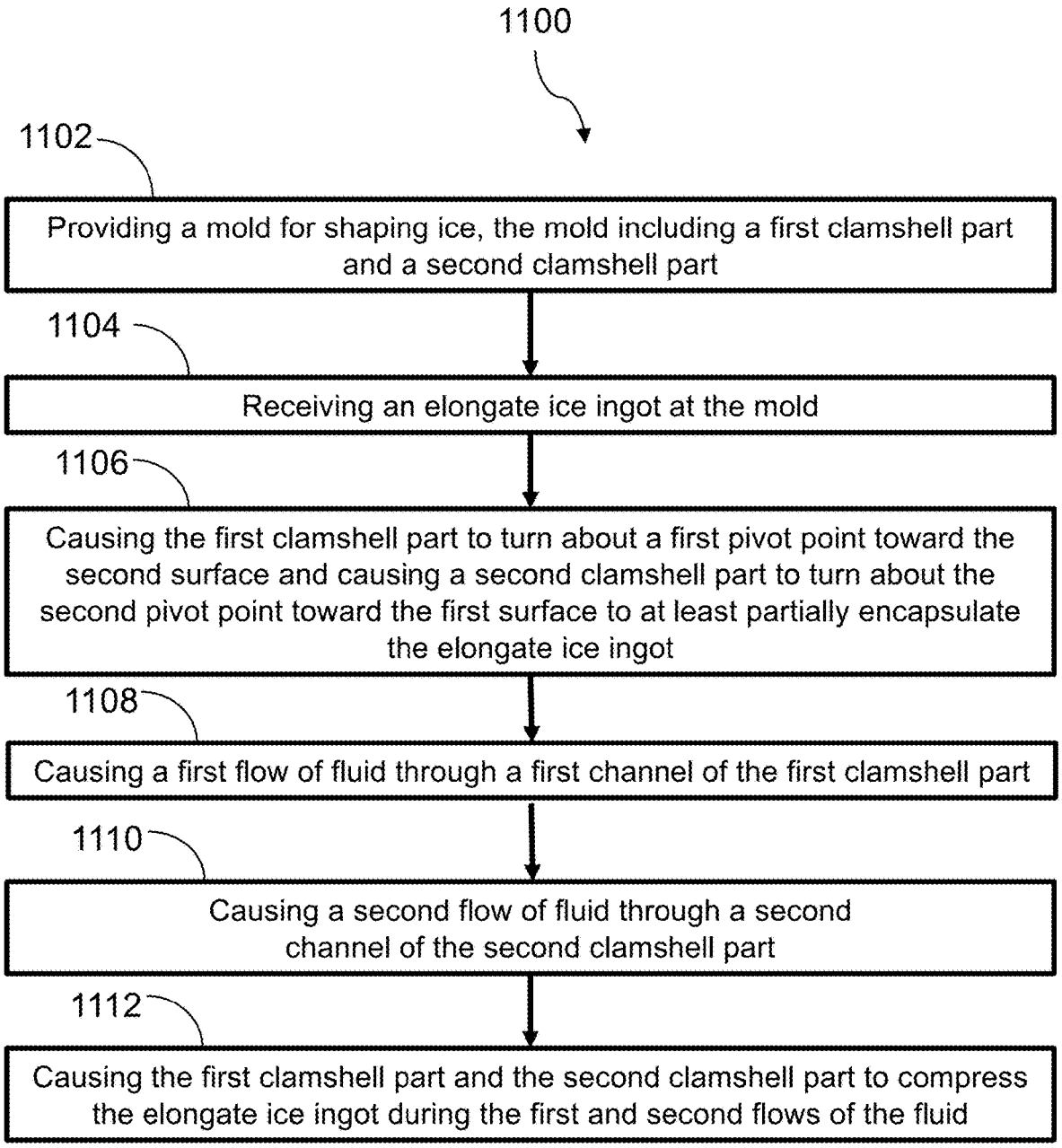
FIG. 11 is a flowchart of an example process for manufacturing a plurality of ice structures.

FIG. 11 is a flowchart of an example process 1100 for manufacturing a plurality of ice structures. The process 1100 may be carried out on device 100, 200, including any or all components of system 900 and/or device 1000.

At block 1102, the process 800 includes providing a mold (e.g., mold 101 within device 100) for shaping ice. The mold 101 may include a first clamshell part 102 coupled to a first pivot point 109 installed on a support 108. The first clamshell part 102 may include a first plurality of mold cavities (e.g., cavities 102*a*-102*q*) on a first surface s1 and a first channel (e.g., channel 164) embedded behind the first surface s1. The mold 101 may further include a second clamshell part 104 coupled to a second pivot point 114 installed on the support 108 and substantially adjacent to the first pivot point 109. The second clamshell 104 may have a second plurality of mold cavities (e.g., cavities 104*a*-104*q*) on a second surface s2 and a second channel (not shown, but similar to channel 164) embedded behind the second surface s2. The first surface s1 substantially faces the second surface s2 at a predefined angle from a longitudinal plane L of the mold 101.

In general, the process 1100 to shape the ice ingot 106 may be triggered by one or more processors (e.g., processor 903 or processor 1003) programmed to cause movement and operation of equipment, assemblies, and/or parts of device 100. For example, the device 100 may include or be communicatively coupled to at least one processor 1003 and memory 1005 storing instructions that, when executed by the at least one processor 1003, cause the device 100 to execute some or all of the instructions of blocks 1102-1112. In particular, the process 1100 may be carried out on device 100, which includes the mold 101 with at least a first clamshell part 102 and a second clamshell part 104. The mold 101 (e.g., parts 102, 104) may be arranged to receive an elongate ice ingot 106 therebetween. In such an arrangement, device 100 may begin to shape the ice into ice structures shaped by cavities (102*a*-102*q*, 104*a*-104*q*) associated with the mold 101.

At block 1104, the process 1100 includes receiving an elongate ice ingot at the mold. For example, an ice ingot 106 may be received on two or more offset supports 126 of the conveyor system 116. The ingot may be advanced to a position substantially under mold 101 (i.e., clamshell parts 102, 104).

At block 1106, the process 1100 includes causing the first clamshell part 102 to turn about a first pivot point 109 toward the second surface s2 and causing the second clamshell part 104 to turn about the second pivot point 114 toward the first surface s1 to at least partially encapsulate the elongate ice ingot 106. Similarly, the process 1100 may also include causing movement along a third pivot point 117 and a fourth pivot point 119 to enable parts 102, 104 to symmetrically hinge. For example, the first clamshell part 102 may be configured to turn about the first pivot point 109 to arrange the first surface s1 from about zero degrees to about 30 degrees from a longitudinal plane L of the device 100 and toward the second surface s2. The second clamshell part 104 may be configured to turn about the second pivot point 114 to arrange the second surface s2 from about zero degrees to about 30 degrees from the longitudinal plane L of the device 100 and toward the first surface s1.

At block 1108, the process 1100 includes causing a first flow of fluid through the first channel. For example, processor 1003 may trigger water supply 1010 and fluid pump 1008 to provide water to inlets 150 152 within part 102, which may flow through channel 164, for example.

At block 1110, the process 1100 includes causing a second flow of fluid through the second channel. For example, processor 1003 may trigger water supply 1010 and fluid pump 1008 to provide water to inlets within part 104 to flow through a channel of part 104. Block 1108 and block 1110 may be performed simultaneously or may be performed offset in time, but fluid provided to both parts 102, 104 may be a substantially continuous flow through the channels (e.g., channels 164, etc.) once the water begins flowing to ensure mold heating and enable melting and shaping of ice ingot 106 during an ice shaping process. The first flow of fluid in the first part 102 and the second flow of fluid in the second part 104 may be thermally heated to a predefined temperature, as described elsewhere herein.

At block 1112, the process 1100 includes causing the first clamshell part 102 and the second clamshell part 104 to compress the elongate ice ingot 106 during the first and second flows of the fluid such that the elongate ice ingot 106 selectively melts to form a plurality of sufficiently distinct ice structures, as defined by the first plurality of mold cavities 102*a*-102*q* and the second plurality of mold cavities 104*a*-104*q*. For example, causing the first clamshell part 102 and the second clamshell part 104 to compress the elongate ice ingot 106 at include providing, by the first clamshell part 102, a tension force on a first side 106*a* of the elongate ice ingot 106 while the second clamshell part 104 provides an equal and opposite tension force on a second and opposite side 106*b* of the elongate ice ingot 106.

In some embodiments, the plurality of sufficiently distinct ice structures include a plurality ice spheres shaped according to the first plurality of mold cavities 102*a*-102*q* and the second plurality of mold cavities 104*a*-104*q* and formed by joining the first surface s1 to the second surface s2 over a predefined time period.

In some embodiments, the process 1100 may further include providing a conveyor system (e.g., conveyor system 116) including a conveyance portion (e.g., conveyance belt 124) and a plurality of offset supports 126. The conveyor system 116 may be arranged substantially parallel to the mold 101 and beneath a bottom surface of the mold 101. The process 1100 may further include causing the conveyor system 116 to receive the elongate ice ingot 106 at two or more of the offset supports 126 and advance the conveyance portion 124 to move the elongate ice ingot 106 to a predefined position substantially along a bottom surface of the mold to align the ice for shaping. The process 1100 may further include causing, transport of the plurality of sufficiently distinct ice structures when released from the plurality of mold cavities and in response to detecting completion of an ice shaping process.

In some embodiments, the mold 101 further includes a drain system (e.g., outlets 154, 156) that drains fluid from the first plurality of mold cavities 102*a*-102*q* and the second plurality of mold cavities 104*a*-104*q*. In some embodiments, the first and second plurality of mold cavities (102*a*-102*q*, 104*a*-104*q*) are arranged to form a shape selected from the group consisting of: a cuboid shape, a polyhedron shape, a sphere shape, a heart shape, a diamond shape, a clover shape, a polygon shape, and a hemispherical shape. In some embodiments, the drain system includes one or more pressure relief pin holes 168 (FIG. 4H). For example, the drain system may include a pressure relief pin hole in each of the first plurality of mold cavities 102*a*-102*q* and a pressure relief pin hole in each of the second plurality of mold cavities 104*a*-104*q*. In some embodiments, each part 102, 104 may include at least one pressure relief pin hole 168 to relieve air and/or water pressure from channels and/or apertures in parts 102, 104. Each pressure relief pin hole 168 may function as a drain channel to or through portions of one or more layers of parts 102, 104. Such relief pin holes 168 may ensure an enhanced level of quality to the resulting shaped ice by allowing hot water (generated from melting the ingot 106 in the parts 102, 104) a place to drain. Relief pin holes 168 may provide an advantage of releasing pressure between the ice being shaped and the mold parts to avoid water build up and melt rivers that may degrade or otherwise mar the surface of the ice being shaped. For example, pressure relief pin holes 168 may avoid formation of bumps or trails on the shaped ice by avoiding excess water to flow around the surface of the ice being shaped by the mold cavities 102*a*-102*q*, 104*a*-104*q*.

In some embodiments, each mold cavity 102*a*-102*q*, 104*a*-104*q* may include a pressure relief pin hole 168 to relieve air and/or water pressure as the ice ingot 106 is shaped, for example. In some embodiments, each pressure relief pin hole 168 is substantially centered on each mold cavity portion, for example, on a rear wall of the respective cavity that drains toward other layers (e.g., layers shown in FIGS. 4A-6B) of the mold parts 102, 104. In some embodiments, each pressure relief pin hole 168 is integrated into every other mold cavity, rather than each mold cavity. In some embodiments, each pressure relief pin hole 168 is integrated into every two or every three mold cavities, rather than each mold cavity. In some embodiments, two or more pressure relief pin holes 168 are provided for each mold cavity.

The relief pin hole 168 may have a cross section with a circular shape, a square shape, a rectangular shape or a triangular shape. The cross section may be equal through the pin hole 168 or tapered from one or both ends toward a center cross section. In some embodiments, the diameter of the pressure relief pin hole 168 may be about 0.31 centimeters; about 0.025 centimeters to about 0.1 centimeters; about 0.1 to about 0.2 centimeters; about 0.2 centimeters to about 0.3 centimeters, or about 0.3 to about 0.31 centimeters.

Described herein are various example ice shaping devices and methods. Some examples described herein may be used in combination and/or may be used independently.

Provided below is a list of examples, each of which may include aspects of any of the other examples disclosed herein. Furthermore, aspects of any example described above may be implemented in any of the numbered examples provided below.

Depending on the example, certain acts, events, or functions of any of the processes or algorithms described herein can be performed in a different sequence, may be added, merged, or left out altogether. Thus, in certain examples, not all described acts or events are necessary for the practice of the processes.

Example 1. An apparatus comprising: a support frame; a mold for shaping ice ingots, the mold including: a first clamshell part coupled to a first pivot point installed on the support frame, the first clamshell part having a first plurality of mold cavities on a first surface and a first channel embedded behind the first surface and configured to receive a first flow of fluid; a second clamshell part coupled to a second pivot point installed on the support frame and substantially adjacent to the first pivot point, the second clamshell part having a second plurality of mold cavities on a second surface and a second channel embedded behind the second surface and configured to receive a second flow of fluid; a positioning means configured to dispose the first surface of the first clamshell part against a first side surface of an elongate ice ingot and a second surface of the second clamshell part against a second side surface of the elongate ice ingot, the first side surface of the elongate ice ingot being opposite the second side surface of the elongate ice ingot; and at least one fluid inlet valve for each of the first clamshell part and the second clamshell part, the at least one fluid inlet valve being configured to control the first flow of fluid through the first channel associated with the first clamshell part, and the second flow of fluid through the second channel associated with the second clamshell part.

Example 2. The apparatus of any of the prior examples, but in particular example 1, wherein: the first clamshell part is configured to turn about the first pivot point to arrange the first surface from about zero degrees to about 30 degrees from a longitudinal plane of the apparatus and toward the second surface; the second clamshell part is configured to turn about the second pivot point to arrange the second surface from about zero degrees to about 30 degrees from the longitudinal plane of the apparatus and toward the first surface.

Example 3. The apparatus of any of the prior examples, but in particular example 1, wherein the positioning means is further configured to: cause the first clamshell part and the second clamshell part to compress the elongate ice ingot during the first and second flows of the fluid such that the elongate ice ingot selectively melts to form a plurality of sufficiently distinct ice structures as defined by the first plurality of mold cavities and the second plurality of mold cavities.

Example 4. The apparatus of any of the prior examples, but in particular example 3, wherein the plurality of sufficiently distinct ice structures comprise a plurality ice spheres shaped according to the first plurality of mold cavities and the second plurality of mold cavities and formed by compressing the elongate ice ingot until joining the first surface to the second surface over a predefined time period.

Example 5. The apparatus of any of the prior examples, but in particular example 1, wherein: a plurality of shaped cavities is defined when the first surface of the first clamshell part is placed adjacent to the second surface of the second clamshell part.

Example 6. The apparatus of any of the prior examples, but in particular example 1, wherein: the first clamshell part further comprises a first set of outlets for draining the flow of fluid away from the first clamshell part; and the second clamshell part further comprises a second set of outlets for draining the flow of fluid away from the second clamshell part.

Example 7. The apparatus of Example 1, wherein: at least one cavity in the first plurality of mold cavities includes a pressure relief pin hole; and at least one cavity in the second plurality of mold cavities includes a pressure relief pin hole.

Example 8. The apparatus of any of the prior examples, but in particular example 1, further comprising an input chamber and an output chamber in a first layer of the first clamshell part; wherein the first channel associated with the first clamshell part comprises a plurality of input channels and a plurality of output channels, wherein: the plurality of input channels and the plurality of output channels are located in a second layer of the first clamshell part, the plurality of input channels being fluidly connected to the input chamber and the plurality of output channels being fluidly connected to the output chamber.

Example 9. The apparatus of any of the prior examples, but in particular example 1, wherein the fluid is water and the first flow of fluid and the second flow of fluid are constant during a shaping process, the fluid being at a temperature between about 37 degrees Celsius and about 98 degrees Celsius.

Example 10. The apparatus of any of the prior examples, but in particular example 1, wherein the positioning means is configured to cause the first clamshell part to turn about the first pivot point in a first direction toward the second surface and cause the second clamshell part to turn about the second pivot point in a second direction toward the first surface to at least partially encapsulate the elongate ice ingot until the first surface of the first clamshell part contacts the second surface of the second clamshell part.

Example 11. The apparatus of any of the prior examples, but in particular example 1, wherein the positioning means is further configured to cause the first clamshell part and the second clamshell part to maintain a constant force on the elongate ice ingot until completion of an ice shaping process. further comprising a conveyor system including a conveyance portion and a plurality of offset supports, the conveyor system being arranged substantially parallel to the mold and beneath a bottom surface of the mold, wherein the conveyor system is configured to: receive the elongate ice ingot at two or more of the offset supports and advance the conveyance portion to move the elongate ice ingot to a predefined position substantially along a bottom surface of the mold; and transport a plurality of sufficiently distinct ice structures formed in the plurality of mold cavities at completion of an ice shaping process.

Example 12. The apparatus of any of the prior examples, but in particular example 1, further comprising a computing device, the computing device including at least one processor and memory storing instructions that when executed cause the at least one processor to generate and trigger display of at least one user interface configured to receive user input corresponding to at least one of: a mold clamping metric, a recipe for shaping the elongate ice ingot, or a mold size.

Example 13. The apparatus of any of the prior examples, but in particular example 1, wherein the mold further comprises a drain system that drains fluid from the first plurality of mold cavities and the second plurality of mold cavities.

Example 14. The apparatus of any of the prior examples, but in particular example 1, wherein the first and second plurality of mold cavities are arranged to form a shape selected from the group consisting of: a cuboid shape, a polyhedron shape, a sphere shape, a heart shape, a diamond shape, a clover shape, a polygon shape, and a hemispherical shape.

Example 15. A method of manufacturing a plurality of ice structures, the method comprising: providing a mold for shaping ice, the mold comprising: a first clamshell part coupled to a first pivot point installed on a support, the first clamshell part having a first plurality of mold cavities on a first surface and a first channel embedded behind the first surface; a second clamshell part coupled to a second pivot point installed on the support and substantially adjacent to the first pivot point, the second clamshell part having a second plurality of mold cavities on a second surface and a second channel embedded behind the second surface, wherein the first surface substantially faces the second surface at a predefined angle from a longitudinal plane of the mold; receiving an elongate ice ingot at the mold; causing the first clamshell part to turn about the first pivot point toward the second surface and causing the second clamshell part to turn about the second pivot point toward the first surface to at least partially encapsulate the elongate ice ingot; causing a first flow of fluid through the first channel; causing a second flow of fluid through the second channel, wherein the first flow of fluid and the second flow of fluid are thermally heated to a predefined temperature; and causing the first clamshell part and the second clamshell part to compress the elongate ice ingot during the first and second flows of the fluid such that the elongate ice ingot selectively melts to form a plurality of sufficiently distinct ice structures as defined by the first plurality of mold cavities and the second plurality of mold cavities.

Example 16. The method of any of the prior examples, but in particular example 15, wherein: the first clamshell part is configured to turn about the first pivot point to arrange the first surface from about zero degrees to about 30 degrees from a longitudinal plane of a device housing the mold and toward the second surface; the second clamshell part is configured to turn about the second pivot point to arrange the second surface from about zero degrees to about 30 degrees from the longitudinal plane of a device housing the mold and toward the first surface.

Example 17. The method of any of the prior examples, but in particular example 15, wherein causing the first clamshell part and the second clamshell part to compress the elongate ice ingot comprises providing, by the first clamshell part, a tension force on a first side of the elongate ice ingot while the second clamshell part provides an equal and opposite tension force on a second and opposite side of the elongate ice ingot.

Example 18. The method of any of the prior examples, but in particular example 15, wherein the plurality of sufficiently distinct ice structures comprise a plurality ice spheres shaped according to the first plurality of mold cavities and the second plurality of mold cavities and formed by joining the first surface to the second surface over a predefined time period.

Example 19. The method of any of the prior examples, but in particular example 15, wherein the method further comprises: providing a conveyor system comprising a conveyance portion and a plurality of offset supports, the conveyor system being arranged substantially parallel to the mold and beneath a bottom surface of the mold; and causing the conveyor system to receive the elongate ice ingot at two or more of the offset supports and advance the conveyance portion to move the elongate ice ingot to a predefined position substantially along a bottom surface of the mold; causing, transport of the plurality of sufficiently distinct ice structures when released from the plurality of mold cavities and in response to detecting completion of an ice shaping process.

Example 20. The method of any of the prior examples, but in particular example 15, wherein the mold further comprises a drain system that drains fluid from the first plurality of mold cavities and the second plurality of mold cavities.

Example 21. The method of any of the prior examples, but in particular example 20, wherein the drain system comprises: a pressure relief pin hole in each of the first plurality of mold cavities; and a pressure relief pin hole in each of the second plurality of mold cavities.

Example 22. The method of any of the prior examples, but in particular example 15, wherein the first and second plurality of mold cavities are arranged to form a shape selected from the group consisting of: a cuboid shape, a polyhedron shape, a sphere shape, a heart shape, a diamond shape, a clover shape, a polygon shape, and a hemispherical shape.

Example 23. An apparatus comprising: a support structure; a mold for shaping ice ingots, the mold including: a first mold housing movably coupled to a guide rail and being configured to slide along the guide rail, the first mold housing comprising at least one channel for receiving a flow of fluid, and a second mold housing fixedly coupled to the support structure and fixedly coupled to an end portion of the guide rail, the second mold housing comprising at least one channel for receiving the flow of fluid; a positioning means for disposing a first surface of the first mold housing against a first side surface of an elongate ice ingot and a second surface of the second mold housing against a second side surface of the elongate ice ingot, the first side surface of the elongate ice ingot being opposite the second side surface of the elongate ice ingot; and fluid inlet valve for each of the first mold housing and the second mold housing, the at least one fluid inlet valve being configured to control the flow of fluid through the at least one channel associated with the first mold housing, and through the at least one channel associated with the second mold housing.

Example 24. The apparatus of example 23, wherein: a plurality of mold cavities is defined when the first surface of the first mold housing is placed adjacent to the second surface of the second mold housing.

Example 25. The apparatus of any of the prior examples, but in particular example 23, wherein: the first mold housing further comprises a first set of outlets for draining the flow of fluid away from the first mold housing; and the second mold housing further comprises a second set of outlets for draining the flow of fluid away from the second mold housing.

Example 26. The apparatus of any of the prior examples, but in particular example 23, further comprising an input chamber and an output chamber in a first layer of the first mold housing; wherein the at least one channel associated with the first mold housing comprises a plurality of input channels and a plurality of output channels, wherein: the plurality of input channels and the plurality of output channels are located in a first layer of the first mold housing, the plurality of input channels being fluidly connected to the input chamber and the plurality of output channels being fluidly connected to the output chamber, and the input chamber and the output chamber are located in a second layer of the first mold housing.

Example 27. The apparatus of any of the prior examples, but in particular example 23, wherein the fluid is water and the flow of fluid is constant during a shaping process, the fluid comprising water at a temperature between about 37 degrees Celsius and about 98 degrees Celsius.

Example 28. The apparatus of any of the prior examples, but in particular example 23, wherein: the positioning means is configured to enable a lateral movement of the first mold housing until the first surface of the first mold housing contacts the second surface of the second mold housing.

Example 29. The apparatus of any of the prior examples, but in particular example 23, wherein: the first mold housing and the second mold housing are parallel to a longitudinal plane of the apparatus.

Example 30. The apparatus of any of the prior examples, but in particular example 23, wherein the positioning means is configured to enable a lateral movement of the first mold housing until the first side surface of the elongate ice ingot is in contact with the first mold portion and the second side surface of the elongate ice ingot is in contact with the second mold portion, wherein the positioning means is further configured to maintain a constant force on the elongate ice ingot.

Example 31. The apparatus of any of the prior examples, but in particular example 23, further comprising: a trap door assembly comprising: a first hingedly coupled plate having a first lengthwise side opposite a second lengthwise side and a first widthwise side opposite a second widthwise side; and a second hingedly coupled plate having a third lengthwise side opposite a fourth lengthwise side and a third widthwise side opposite a second widthwise side; and a linear actuator, wherein the trap door assembly is coupled to the linear actuator by a cradle assembly along the second widthwise side and along the fourth widthwise side.

Example 32. The apparatus of any of the prior examples, but in particular example 31, further comprising at least one air knife oriented to blow air toward a region proximal to the first widthwise side of the trap door assembly.

Example 33. The apparatus of any of the prior examples, but in particular example 31, wherein the linear actuator is configured to cause the first hingedly couple plate and the second hingedly coupled plate to hinge from an initial configuration into a harvesting configuration, wherein: the initial configuration comprises the first hingedly coupled plate and the second hingedly coupled plate being aligned substantially normal to a longitudinal plane of the apparatus; and the harvesting configuration comprises the first hingedly coupled plate and the second hingedly coupled plate being positioned at an acute angle to the longitudinal plane of the apparatus to form a slot between the first hingedly coupled plate and the second hingedly coupled plate.

Example 34. The apparatus of any of the prior examples, but in particular example 33, wherein the acute angle of the first hingedly coupled plate and the second hingedly coupled plate is from about 1 degree to about 45 degrees.

Example 35. The apparatus of any of the prior examples, but in particular example 31, wherein: the first mold housing and the second mold housing are configured to maintain tension against an ice ingot placed between the first mold housing and the second mold housing, the tension being maintained during heating of the first mold housing and the second mold housing and removed upon detecting that the first mold housing and the second mold housing are located a predefined distance apart.

Example 36. The apparatus of any of the prior examples, but in particular example 35, wherein removing the tension triggers: the positioning means to cause the first mold housing to move in a substantially horizontal direction to increase a distance from the second mold housing and trigger a tilting of the first mold housing and the second mold housing to cause removal of ice structures from the first mold housing and the second mold housing onto the first hingedly coupled plate or the second hingedly coupled plate; and the linear actuator to cause movement of the first hingedly coupled plate and the second hingedly coupled plate to an acute angle to a longitudinal plane of the apparatus to form a slot between the first hingedly coupled plate and the second hingedly coupled plate.

Example 37. The apparatus of any of the prior examples, but in particular example 23, wherein the first mold housing and the second mold housing each include a plurality of cavities configured to form ice structures.

Example 38. The apparatus of any of the prior examples, but in particular example 23, further comprising a computing device, the computing device including at least one processor and memory storing instructions that when executed by the processor cause the at least one processor to generate and trigger display of at least one user interface configured to receive user input corresponding to at least one of: a mold clamping metric, a recipe for shaping the elongate ice ingot, or a mold size.

Example 39. A method for shaping ice, the method comprising: providing a mold comprising a plurality of channels and a plurality of mold cavities; providing a positioning means for moving at least one portion of the mold; providing a fluid source for continually flowing fluid through the plurality of channels of the mold; receiving an ice ingot in the mold; causing the mold to at least partially encapsulate the ice ingot; causing a flow of the fluid through the plurality of channels of the mold, wherein the fluid is thermally heated to a predefined temperature for flowing through the plurality of channels of the mold; and causing the at least one portion of the mold to press against at least one surface of the ice ingot during the flow of fluid such that the ice ingot selectively melts to form a plurality of sufficiently distinct ice structures as defined by the plurality of mold cavities.

Example 40. The method of any of the prior examples, but in particular example 39, further comprising: providing a trap door substantially parallel to the mold and beneath a bottom surface of the mold; and causing the trap door to catch and transport the plurality of sufficiently distinct ice structures when released from the plurality of mold cavities and in response to detecting completion of an ice shaping process.

Example 41. The method of any of the prior examples, but in particular example 39, wherein the mold further comprises a drain system that drains fluid from the plurality of mold cavities.

Example 42. The method of any of the prior examples, but in particular example 39, wherein the plurality of mold cavities is a shape selected from the group consisting of: a cuboid shape, a polyhedron shape, a sphere shape, a heart shape, a diamond shape, a clover shape, a polygon shape, and a hemispherical shape.

The processes described herein, and variations thereof, can be embodied and/or implemented at least in part as a machine configured to receive a computer-readable medium storing computer-readable instructions. The instructions may be executed by computer-executable components integrated with the system and one or more portions of the processor on a computing device in communication with various components of the device for producing and/or shaping clear ice, such as but not limited to its various valves. The computer-readable medium can be stored on any suitable computer-readable media such as RAMs, ROMs, flash memory, EEPROMs, optical devices (e.g., CD or DVD), hard drives, floppy drives, or any suitable device. The computer-executable component may be an application-specific processor, ASIC, PLC, or the like, but any suitable dedicated hardware or hardware/firmware combination can alternatively or additionally execute the instructions.

As used in the description and claims, the singular form "a", "an" and "the" include both singular and plural references unless the context clearly dictates otherwise. For example, the term "mold" may include, and is contemplated to include, a plurality of molds. At times, the claims and disclosure may include terms such as "a plurality," "one or more," or "at least one;" however, the absence of such terms is not intended to mean, and should not be interpreted to mean, that a plurality is not conceived.

The term "about" or "approximately," when used before a numerical designation or range (e.g., to define a length or pressure), indicates approximations which may vary by (+) or (−) 5%, 1% or 0.1%. All numerical ranges provided herein are inclusive of the stated start and end numbers. The term "substantially" indicates mostly (i.e., greater than 50%) or essentially all of a device, substance, or composition.

As used herein, the term "comprising" or "comprises" is intended to mean that the devices, systems, and methods include the recited elements, and may additionally include any other elements. "Consisting essentially of" shall mean that the devices, systems, and methods include the recited elements and exclude other elements of essential significance to the combination for the stated purpose. Thus, a system or method consisting essentially of the elements as defined herein would not exclude other materials, features, or steps that do not materially affect the basic and novel characteristic(s) of the claimed disclosure. "Consisting of" shall mean that the devices, systems, and methods include the recited elements and exclude anything more than a trivial or inconsequential element or step. Embodiments defined by each of these transitional terms are within the scope of this disclosure.

The examples and illustrations included herein show, by way of illustration and not of limitation, specific embodiments in which the subject matter may be practiced. Other embodiments may be utilized and derived therefrom, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. An apparatus comprising:

a support frame;

a mold for shaping ice ingots, the mold including:

a first clamshell part coupled to a first pivot point installed on the support frame, the first clamshell part having a first plurality of mold cavities on a first surface and a first channel embedded behind the first surface and configured to receive a first flow of fluid, wherein at least one cavity in the first plurality of mold cavities includes a pressure relief pin hole;

a second clamshell part coupled to a second pivot point installed on the support frame and substantially adjacent to the first pivot point, the second clamshell part having a second plurality of mold cavities on a second surface and a second channel embedded behind the second surface and configured to receive a second flow of fluid, wherein at least one cavity in the second plurality of mold cavities includes a pressure relief pin hole;

a positioner configured to dispose the first surface of the first clamshell part against a first side surface of an elongate ice ingot and a second surface of the second clamshell part against a second side surface of the elongate ice ingot, the first side surface of the elongate ice ingot being opposite the second side surface of the elongate ice ingot; and at least one fluid inlet valve for each of the first clamshell part and the second clamshell part, the at least one fluid inlet valve being configured to control the first flow of fluid through the first channel associated with the first clamshell part, and the second flow of fluid through the second channel associated with the second clamshell part, a conveyor system including a conveyance portion and a plurality of offset supports, the conveyor system being arranged substantially parallel to the mold and beneath a bottom surface of the mold, wherein the conveyor system is configured to:

receive the elongate ice ingot at two or more of the offset supports and advance the conveyance portion to move the elongate ice ingot to a predefined position substantially along a bottom surface of the mold; and transport a plurality of distinct ice structures formed in the first plurality of mold cavities and the second plurality of mold cavities at completion of an ice shaping process.

2. The apparatus of claim 1, wherein:

the first clamshell part is configured to turn about the first pivot point to arrange the first surface from about zero degrees to about 30 degrees from a longitudinal plane of the apparatus and toward the second surface;

the second clamshell part is configured to turn about the second pivot point to arrange the second surface from about zero degrees to about 30 degrees from the longitudinal plane of the apparatus and toward the first surface.

3. The apparatus of claim 1, wherein the positioner is further configured to:

cause the first clamshell part and the second clamshell part to compress the elongate ice ingot while the first flow of fluid and the second flow of fluid flow such that the elongate ice ingot selectively melts to form a plurality of distinct ice structures as defined by the first plurality of mold cavities and the second plurality of mold cavities.

4. The apparatus of claim 3, wherein the plurality of distinct ice structures comprise a plurality of ice spheres shaped according to the first plurality of mold cavities and the second plurality of mold cavities and formed by compressing the elongate ice ingot until joining the first surface to the second surface over a predefined time period.

5. The apparatus of claim 1, wherein:

a plurality of shaped cavities is defined when the first surface of the first clamshell part is placed adjacent to the second surface of the second clamshell part.

6. The apparatus of claim 1, wherein:

the first clamshell part further comprises a first set of outlets for draining the first flow of fluid away from the first clamshell part; and the second clamshell part further comprises a second set of outlets for draining the second flow of fluid away from the second clamshell part.

7. The apparatus of claim 1, further comprising an input chamber and an output chamber in a first layer of the first clamshell part;

wherein the first channel associated with the first clamshell part comprises a plurality of input channels and a plurality of output channels, wherein:

the plurality of input channels and the plurality of output channels are located in a second layer of the first clamshell part, the plurality of input channels being fluidly connected to the input chamber and the plurality of output channels being fluidly connected to the output chamber.

8. The apparatus of claim 1, wherein the first flow of fluid and the second flow of fluid comprise water flowing at a constant rate during a shaping process, the first flow of fluid and the second flow of fluid being at a temperature between about 37 degrees Celsius and about 98 degrees Celsius.

9. The apparatus of claim 1, wherein the positioner is configured to cause the first clamshell part to turn about the first pivot point in a first direction toward the second surface and cause the second clamshell part to turn about the second pivot point in a second direction toward the first surface to at least partially encapsulate the elongate ice ingot until the first surface of the first clamshell part contacts the second surface of the second clamshell part.

10. The apparatus of claim 1, wherein the positioner is further configured to cause the first clamshell part and the second clamshell part to maintain a constant force on the elongate ice ingot until completion of an ice shaping process.

11. The apparatus of claim 1, further comprising a computing device, the computing device including at least one processor and memory storing instructions that when executed cause the at least one processor to generate and trigger display of at least one user interface configured to receive user input corresponding to at least one of: a mold clamping metric, a recipe for shaping the elongate ice ingot, or a mold size.

12. The apparatus of claim 1, wherein the mold further comprises a first outlet valve that drains the first flow of fluid from the first plurality of mold cavities and a second outlet valve that drains the second flow of fluid from the second plurality of mold cavities.

13. The apparatus of claim 1, wherein the first plurality of mold cavities and the second plurality of mold cavities are arranged to form a shape selected from the group consisting of: a cuboid shape, a polyhedron shape, a sphere shape, a heart shape, a diamond shape, a clover shape, a polygon shape, and a hemispherical shape.

14. An apparatus comprising:

a support frame;

a mold for shaping ice ingots, the mold including:

a first clamshell part coupled to a first pivot point installed on the support frame, the first clamshell part having a first plurality of mold cavities on a first surface and a first channel embedded behind the first surface and configured to receive a first flow of fluid, wherein at least one cavity in the first plurality of mold cavities includes a pressure relief pin hole;

a second clamshell part coupled to a second pivot point installed on the support frame and substantially adjacent to the first pivot point, the second clamshell part having a second plurality of mold cavities on a second surface and a second channel embedded behind the second surface and configured to receive a second flow of fluid, wherein at least one cavity in the second plurality of mold cavities includes a pressure relief pin hole;

a positioner configured to dispose the first surface of the first clamshell part against a first side surface of an elongate ice ingot and a second surface of the second clamshell part against a second side surface of the elongate ice ingot, the first side surface of the elongate ice ingot being opposite the second side surface of the elongate ice ingot; and at least one fluid inlet valve for each of the first clamshell part and the second clamshell part, the at least one fluid inlet valve being configured to control the first flow of fluid through the first channel associated with the first clamshell part, and the second flow of fluid through the second channel associated with the second clamshell part;

an input chamber and an output chamber in a first layer of the first clamshell part, wherein the first channel associated with the first clamshell part comprises a plurality of input channels and a plurality of output channels, and wherein the plurality of input channels and the plurality of output channels are located in a second layer of the first clamshell part, the plurality of input channels being fluidly connected to the input chamber and the plurality of output channels being fluidly connected to the output chamber.

15. The apparatus of claim 14, wherein:

the first clamshell part is configured to turn about the first pivot point to arrange the first surface from about zero degrees to about 30 degrees from a longitudinal plane of the apparatus and toward the second surface;

the second clamshell part is configured to turn about the second pivot point to arrange the second surface from about zero degrees to about 30 degrees from the longitudinal plane of the apparatus and toward the first surface.

16. The apparatus of claim 14, wherein the positioner is further configured to:

cause the first clamshell part and the second clamshell part to compress the elongate ice ingot while the first flow of fluid and the second flow of fluid flow such that the elongate ice ingot selectively melts to form a plurality of distinct ice structures as defined by the first plurality of mold cavities and the second plurality of mold cavities.

17. The apparatus of claim 14, wherein:

the first clamshell part further comprises a first set of outlets for draining the first flow of fluid away from the first clamshell part; and the second clamshell part further comprises a second set of outlets for draining the second flow of fluid away from the second clamshell part.

18. The apparatus of claim 14, wherein the positioner is configured to cause the first clamshell part to turn about the first pivot point in a first direction toward the second surface and cause the second clamshell part to turn about the second pivot point in a second direction toward the first surface to at least partially encapsulate the elongate ice ingot until the first surface of the first clamshell part contacts the second surface of the second clamshell part.

19. The apparatus of claim 14, wherein the positioner is further configured to cause the first clamshell part and the second clamshell part to maintain a constant force on the elongate ice ingot until completion of an ice shaping process.

20. The apparatus of claim 14, further comprising:

a conveyor system including a conveyance portion and a plurality of offset supports, the conveyor system being arranged substantially parallel to the mold and beneath a bottom surface of the mold, wherein the conveyor system is configured to:

receive the elongate ice ingot at two or more of the offset supports and advance the conveyance portion to move the elongate ice ingot to a predefined position substantially along a bottom surface of the mold; and transport a plurality of distinct ice structures formed in the first plurality of mold cavities and the second plurality of mold cavities at completion of an ice shaping process.

21. A method of manufacturing a plurality of ice structures, the method comprising:

providing a mold for shaping ice, the mold comprising:

a first clamshell part coupled to a first pivot point installed on a support, the first clamshell part having a first plurality of mold cavities on a first surface and a first channel embedded behind the first surface;

a second clamshell part coupled to a second pivot point installed on the support and substantially adjacent to the first pivot point, the second clamshell part having a second plurality of mold cavities on a second surface and a second channel embedded behind the second surface, wherein the first surface substantially faces the second surface at a predefined angle from a longitudinal plane of the mold;

receiving an elongate ice ingot at the mold;

causing the first clamshell part to turn about the first pivot point toward the second surface and causing the second clamshell part to turn about the second pivot point toward the first surface to at least partially encapsulate the elongate ice ingot;

causing a first flow of fluid through the first channel;

causing a second flow of fluid through the second channel, wherein the first flow of fluid and the second flow of fluid are thermally heated to a predefined temperature; and causing the first clamshell part and the second clamshell part to compress the elongate ice ingot while the first flow of fluid and the second flow of fluid flow such that the elongate ice ingot selectively melts to form a plurality of distinct ice structures as defined by the first plurality of mold cavities and the second plurality of mold cavities, providing a conveyor system including a conveyance portion and a plurality of offset supports, the conveyor system being arranged substantially parallel to the mold and beneath a bottom surface of the mold;

causing the conveyor system to receive the elongate ice ingot at two or more of the offset supports and advance the conveyance portion to move the elongate ice ingot to a predefined position substantially along a bottom surface of the mold;

causing transport of the plurality of distinct ice structures when released from the first plurality of mold cavities and the second plurality of mold cavities and in response to detecting completion of an ice shaping process, wherein the mold further comprises a drain system that drains fluid from the first plurality of mold cavities and the second plurality of mold cavities, the drain system comprising a pressure relief pin hole in each of the first plurality of mold cavities and a pressure relief pin hole in each of the second plurality of mold cavities.

22. The method of claim 21, wherein:

the first clamshell part is configured to turn about the first pivot point to arrange the first surface from about zero degrees to about 30 degrees from a longitudinal plane of a device housing the mold and toward the second surface;

the second clamshell part is configured to turn about the second pivot point to arrange the second surface from about zero degrees to about 30 degrees from the longitudinal plane of a device housing the mold and toward the first surface.

23. The method of claim 21, wherein causing the first clamshell part and the second clamshell part to compress the elongate ice ingot comprises providing, by the first clamshell part, a tension force on a first side of the elongate ice ingot while the second clamshell part provides an equal and opposite tension force on a second and opposite side of the elongate ice ingot.

24. The method of claim 21, wherein the plurality of distinct ice structures comprise a plurality ice spheres shaped according to the first plurality of mold cavities and the second plurality of mold cavities and formed by joining the first surface to the second surface over a predefined time period.

25. The method of claim 21, wherein the first plurality of mold cavities and the second plurality of mold cavities are arranged to form a shape selected from the group consisting of: a cuboid shape, a polyhedron shape, a sphere shape, a heart shape, a diamond shape, a clover shape, a polygon shape, and a hemispherical shape.

* * * * *